US008793831B2

(12) United States Patent
Katou et al.

(10) Patent No.: US 8,793,831 B2
(45) Date of Patent: Aug. 5, 2014

(54) CLEANING DEVICE

(75) Inventors: Makoto Katou, Tokyo (JP); Susumu Fujinami, Tokyo (JP); Kimie Sannomiya, Tokyo (JP); Yukio Noda, Tokyo (JP); Tomohisa Hirata, Tokyo (JP); Yutaka Hamano, Tokyo (JP); Takuaki Harada, Tokyo (JP)

(73) Assignee: Kao Corporation, Tokyo (JP)

( * ) Notice: Subject to any disclaimer, the term of this patent is extended or adjusted under 35 U.S.C. 154(b) by 52 days.

(21) Appl. No.: 13/578,761

(22) PCT Filed: Feb. 10, 2011

(86) PCT No.: PCT/JP2011/052867

§ 371 (c)(1),
(2), (4) Date: Sep. 11, 2012

(87) PCT Pub. No.: WO2011/099561

PCT Pub. Date: Aug. 18, 2011

(65) Prior Publication Data

US 2013/0000064 A1 Jan. 3, 2013

(30) Foreign Application Priority Data

| | | |
|---|---|---|
| Feb. 12, 2010 | (JP) | 2010-029087 |
| Sep. 30, 2010 | (JP) | 2010-222545 |
| Sep. 30, 2010 | (JP) | 2010-222551 |
| Sep. 30, 2010 | (JP) | 2010-222784 |
| Feb. 4, 2011 | (JP) | 2011-022672 |
| Feb. 4, 2011 | (JP) | 2011-022673 |

(51) Int. Cl.

| | |
|---|---|
| ***A47L 13/16*** | (2006.01) |
| ***A47L 13/20*** | (2006.01) |
| ***A47L 13/44*** | (2006.01) |

(52) U.S. Cl.
USPC ..... 15/228; 15/144.1; 15/231

(58) Field of Classification Search
USPC ..... 15/144.1, 209.1, 228, 231
See application file for complete search history.

(56) References Cited

U.S. PATENT DOCUMENTS 5,426,809 A 6/1995 Muta
6,317,917 B1 * 11/2001 Hsu ..... 15/228

(Continued)

FOREIGN PATENT DOCUMENTS

JP 10-6775 Y 5/1935
JP 49-68263 U 9/1972

(Continued)

OTHER PUBLICATIONS

International Search Report Issued Apr. 5, 2011 in PCT/JP11/052867 Filed Feb. 10, 2011.

*Primary Examiner* — Randall Chin
(74) *Attorney, Agent, or Firm* — Oblon, Spivak, McClelland, Maier & Neustadt, L.L.P.

(57) ABSTRACT

A lower face of a base body (15) includes a wave-like corrugated surface portion (19) of which cross-section in a direction perpendicular to a predetermined direction along which cleaning is performed with a cleaning device body (11) in a planar view is wave-shaped as having a ridge portion (17) and a valley portion (18) arranged alternately and continuously. The valley portion (18) of the wave-like corrugated surface portion (19) includes an oblique valley portion (18*a*) of which end part is opened to a side portion of the base body (15) facing to the predetermined direction as being extended obliquely against the predetermined direction to obliquely guide objects such as dust to be stuck to a cleaning sheet (13) in accordance with wiping of the surface to be cleaned.

13 Claims, 28 Drawing Sheets

(56) References Cited

U.S. PATENT DOCUMENTS

| | | | | |
|---|---|---|---|---|
| 7,127,772 | B2 * | 10/2006 | Dingert et al. | 15/228 |
| D644,386 | S | 8/2011 | Tawara et al. | |
| D660,536 | S * | 5/2012 | Weaver et al. | D32/51 |
| 2005/0040644 | A1 | 2/2005 | Tawara et al. | |
| 2006/0048327 | A1 | 3/2006 | Lacotta et al. | |
| 2006/0230567 | A1 | 10/2006 | Harper et al. | |
| 2007/0223267 | A1 | 9/2007 | Kazinczi | |
| 2010/0080052 | A1 | 4/2010 | Kazinczi | |

FOREIGN PATENT DOCUMENTS

| | | | |
|---|---|---|---|
| JP | 63-150663 | U | 10/1988 |
| JP | 4-114620 | A | 4/1992 |
| JP | 6-78872 | A | 3/1994 |
| JP | 6-21421 | Y2 | 6/1994 |
| JP | 6-62960 | | 9/1994 |
| JP | 6-311954 | A | 11/1994 |
| JP | 3018118 | | 8/1995 |
| JP | 2507300 | Y2 | 5/1996 |
| JP | 9 135799 | | 5/1997 |
| JP | 9-140650 | A | 6/1997 |
| JP | 9-206205 | A | 8/1997 |
| JP | 9-224896 | A | 9/1997 |
| JP | 10-52391 | A | 2/1998 |
| JP | 11-206662 | A | 8/1999 |
| JP | 2001 173618 | | 6/2001 |
| JP | 2001 238839 | | 9/2001 |
| JP | 2001 299659 | | 10/2001 |
| JP | 2003 184835 | | 7/2003 |
| JP | 2004-180896 | A | 7/2004 |
| JP | 2005-103196 | A | 4/2005 |
| JP | 2005 168972 | | 6/2005 |
| JP | 2006-305242 | A | 11/2006 |
| JP | 2007 54337 | | 3/2007 |
| JP | 2007 82723 | | 4/2007 |
| JP | 2007-247907 | A | 9/2007 |
| JP | 2008-503075 | A | 1/2008 |
| JP | 2008 511409 | | 4/2008 |
| JP | 2003-523240 | A | 8/2009 |
| SG | 63841 | A1 | 1/2001 |
| WO | WO 01/62132 | A2 | 8/2001 |

* cited by examiner

CLEANING DEVICE

CROSS REFERENCE TO RELATED APPLICATION

This application is a 371 of PCT/JP11/052,867, filed on Feb. 10, 2011, and claims priority to the following Japanese Patent Applications: 2010-029087, filed on Feb. 12, 2010; 2010-222551, filed on Sep. 30, 2010; 2010-222545, filed on Sep. 30, 2010; 2010-222784, filed on Sep. 30, 2010; 2011-022672, filed on Feb. 4, 2011; and 2011-022673, filed on Feb. 4, 2011.

TECHNICAL FIELD

The present invention relates to a cleaning device to remove dust and dirt on a surface to be cleaned with a cleaning device body to which a cleaning sheet is attached as covering a cleaning surface.

BACKGROUND ART

With a cleaning device to remove dust and dirt on a surface to be cleaned such as a floor surface with a cleaning device body to which a cleaning sheet made of non-woven fabric or the like as covering a cleaning surface, cleaning can be readily performed while dust and dirt are stuck to the cleaning sheet by wiping the surface to be cleaned with holding a handle portion attached to the cleaning device body by hand.

According to such a cleaning device, when a lower face of the cleaning device body to be the cleaning surface is simply a flat surface, it becomes difficult to wipe the surface to be cleaned with the entire cleaning surface as dust and dirt being easily stuck to a circumferential section of the cleaning surface. Accordingly, various types of cleaning devices having improved cleaning efficiency have been developed by devising a shape of a cleaning surface of a cleaning device body (e.g., refer to Patent Literature 1 and Patent Literature 2).

Further, as a cleaning device to perform cleaning of a floor surface, there have been known various cleaning devices respectively including a cleaning head to which a mop, a cleaning sheet or the like is attached and a handle which is rotatably joined to an upper face of the cleaning head via a joint portion. It is common for these cleaning devices that the handle is capable of performing a 360-degree rotation in the circumferential direction about the joint portion as well as the handle is rotated in the up-down direction against the cleaning head. Accordingly, cleaning of a floor surface and the like can be effectively performed while the cleaning surface of the cleaning head is oriented in an arbitrary direction (e.g., refer to Patent Literature 3).

Further, as a handle of such a cleaning device, there has been developed that a plurality of cylindrical pipes are integrated and joined in the axial direction with a pipe joint structure in which a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion between the male-side end portion and the female-side end portion from the outside (e.g., refer to Patent Literature 4).

Further, as the structure of the joint portion enabling the handle to be rotated in the circumferential direction as well as the up-down direction, there has been generally known a structure in which a bifurcated head-side yoke portion arranged at an upper face center section of the cleaning head and a bifurcated handle-side yoke portion arranged at a lower end part of the handle are joined via a joint member including a first rotational axial center portion and a second rotational axial center portion of which center axes are orthogonal, for example (e.g., refer to Patent Literature 3).

Further, as a cleaning device to remove dust and dirt as wiping a floor surface, there has been popularly used a cleaning device in which a handle having length on the order of 100 to 150 cm, for example, being suitable for performing cleaning operation while standing is joined to a cleaning device body with a mop or the like.

Further, there has been known a cleaning device capable of being easily hanged in which an end cap made of synthetic resin is attached to an end part of a handle so as to prevent a cleaning device body from being damaged and to be capable of being stored in a stable state as being hanged to a hook member arranged at a wall surface or the like when not in use (e.g., refer to Patent Literature 5).

Further, as a cleaning device to perform cleaning of a floor surface, there have been known various cleaning devices respectively including a cleaning head to which a disposable cleaning sheet is attached to be replaceable in a detachably attached manner and a handle which is rotatably joined to an upper face of the cleaning head via a joint portion. In such a cleaning device, a cleaning sheet attachment made of soft elastic material with an engagement slit is arranged at four locations as being adjacent to each corner section of the rectangular cleaning head. The cleaning sheet can be easily attached to the cleaning head to be replaceable in a detachably attachable manner by performing attaching as squeezing end parts of the cleaning sheets into the slits of the cleaning sheet attachments at the upper face of the cleaning head after the cleaning sheet is wound to the cleaning head as covering a bottom face of the cleaning head from the lower side (e.g., refer to Patent Literature 7).

Further, there has been developed a cleaning device which prevents a cleaning sheet from being easily detached from a cleaning head during cleaning as improving attaching characteristics of the cleaning sheet attached as being squeezed into a sheet attachment (e.g., refer to Patent Literature 8). In the cleaning device of Patent Literature 8, each engagement slit arranged at the cleaning sheet attachment made of soft elastic material includes a holding slit formed into a saw-tooth shape as being extended in a direction at a right angle against a direction of tension force acting on the cleaning sheet and a plurality of opening slits extended continuously and radially from a center section of the holding slit. Then, end parts of the cleaning sheet are attached to the saw-tooth-shaped holding slits, so that the cleaning sheet can be reliably held after attached.

CITATION LIST

Patent Literature

Patent Literature 1: Singapore Patent No. 63841
Patent Literature 2: JP 2007-54337A
Patent Literature 3: JP-U6-21421A
Patent Literature 4: US 2005040644 (A1)
Patent Literature 5: JP 2004-180896A
Patent Literature 6: US 2006230567(A1)
Patent Literature 7: JP-U 49-68263
Patent Literature 8: Japanese Utility-Model No. 2507300

SUMMARY OF INVENTION

The present invention provides a cleaning device to wipe a surface to be cleaned with a cleaning sheet which is attached as covering a cleaning surface being a lower face of a base body. The cleaning device includes a cleaning device body which includes a cleaning head and a base body attached as covering a lower face of the cleaning head, and a handle portion which is attached to a face at the opposite side to the lower face of the cleaning head. The lower face of the base body includes a wave-like corrugated surface portion of which cross-section in a direction perpendicular to a predetermined direction along which cleaning is performed with the cleaning device body in a planar view is wave-shaped as having a ridge portion and a valley portion arranged alternately and continuously. The valley portion of the wave-like corrugated surface portion includes an oblique valley portion of which an end part is opened to a side portion of the base body facing to the predetermined direction as being extended obliquely against the predetermined direction.

Preferably, the handle portion is a handle and the handle is formed by joining a plurality of cylindrical pipes with a pipe joint structure for integrally joining a pair of the cylindrical pipes in an axial direction. Preferably, in the pipe joint structure, a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion from the outside between the male-side end portion and the female-side end portion. Preferably, the female-side end portion includes a positioning guide rib which inwardly projects from an inner circumferential surface of the female-side end portion at a section being apart from the female-side projection insertion hole in a circumferential direction, the male-side end portion includes a guide groove extended from a top edge part of the male-side end portion in an axial direction at a section being apart from the male-side projection insertion hole in the circumferential direction as corresponding to the positioning guide rib, and the male-side end portion is inserted to the female-side end portion until the male-side projection insertion hole is matched to the female-side projection insertion hole while the positioning guide rib of the female-side end portion is guided as being engaged with the guide groove of the male-side end portion.

Preferably, the handle portion is a handle and the handle is formed by joining a plurality of cylindrical pipes with a pipe joint structure for integrally joining a pair of the cylindrical pipes in an axial direction. Preferably, in the pipe joint structure, a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion from the outside between the male-side end portion and the female-side end portion. Preferably, an abutment rib which abuts to an end surface of the female-side end portion from a back side is arranged at the sleeve-like member continuously or discontinuously in a circumferential direction as inwardly projecting from an inner circumferential surface of a section covering the joint line portion, an insertion guide slope portion extended as being sloped outwardly in the circumferential direction toward a top end side of the sleeve-like member is arranged at the abutment rib continuously or discontinuously in the circumferential direction, and the male-side end portion of the one cylindrical pipe is inserted to the female-side end portion as being guided by the insertion guide slope portion in a state that the sleeve-like member is attached to the female-side end portion of the other cylindrical pipe while the end surface is abutted to an abutment surface of the abutment rib.

Preferably, the handle portion is a handle and an end cap is attached to an upper end part of the handle. Preferably, the end cap attached to the upper end part of the handle through an attachment hole is made of elastic material and a cover end surface of the end cap arranged to cover an end surface portion of the handle is formed as an oblique surface against a perpendicular surface to a center axis direction of the handle, so that a taper-shaped top edge section of the end cap forms a cushion portion capable of being elastically deformed inwardly and outwardly in a radial direction as having the center axis direction of the handle as the center.

Preferably, the handle portion is a handle and a joint structure of a cleaning head is provided to enable the handle to perform a 360-degree rotation in a circumferential direction about a joint portion in a state that the handle is arranged approximately in parallel to the cleaning head. Preferably, the joint structure of the cleaning head forms the joint portion capable of being rotated in an up-down direction and the circumferential direction by joining a bifurcated head-side yoke portion arranged as projecting from an upper face of the cleaning head and a bifurcated handle-side yoke portion arranged at a lower end part of the handle via a joint member which includes a first rotational axial center portion and a second rotational axial center portion of which center axes are orthogonal. Preferably, mutually-distant opposed surfaces of a pair of yoke projection portions structuring the head-side yoke portion respectively have a symmetrically mountain-shaped outer circumferential portion which includes slope portions at both sides of a crest portion, a pair of yoke pieces structuring the handle-side yoke portion has lateral width being approximately the same as space width between the opposed surfaces of the pair of yoke projection portions, an edge portion of either yoke piece is capable of being abutted to an outer circumferential portion of the opposed surface of either yoke projection portion in a state that the handle is arranged approximately in parallel to the cleaning head. Preferably, the edge portion of either yoke piece is arranged to be movable as running over or sliding down along the outer circumferential portion of the opposed surface of either yoke projection portion in accordance with rotation of the handle in the circumferential direction in a state of being arranged approximately in parallel to the cleaning head.

Preferably, a cleaning sheet attachment which attaches a cleaning sheet to be replaceable in a detachably attachable manner is arranged at an upper face portion of the cleaning head and edge parts of the cleaning sheet which is wound as covering a bottom surface portion of the cleaning head are attached to the cleaning sheet attachment so as to maintain a state that the cleaning sheet is attached to the cleaning head. Preferably, the cleaning sheet attachment is structured by forming a holding slit and an opening slit at an attaching member, the holding slit is formed into a saw-tooth shape or a waveform shape as being extended in a direction at a right angle or approximately at a right angle against a direction of tension force acting on the cleaning sheet, the opening slit includes a two-line slit having two lines extended at one side as being continued to the holding slit at a center section of the holding slit and an oblique slit extended at the other side obliquely against an extending direction of the holding slit as sandwiching the holding slit, and the oblique slit includes a base end portion being adjacent to the holding slit and a widening portion at a top end side from the base end portion having slit width which is wider than that of the base end portion.

BRIEF DESCRIPTION OF DRAWINGS

FIG. 8(*b*) is a broken perspective view illustrating a situation of the jointing pipe members which structure the rod portion of the handle portion.

FIG. 8(*c*) is a broken perspective view illustrating a situation of the jointing pipe members which structure the rod portion of the handle portion.

FIG. 9(*b*) is a longitudinal sectional view in a traverse direction along A-A of (a) of the cylindrical pipe member having the male-side end portion and the female-side end portion which structure the pipe joint structure.

FIG. 9(*c*) is a bottom view of the cylindrical pipe member having the male-side end portion and the female-side end portion which structure the pipe joint structure as viewing FIG. 9(*a*) from direction B.

FIG. 10(*b*) is a longitudinal sectional view in a traverse direction along A-A of FIG. 10(*a*) viewing from the lower side illustrating a state that the sleeve-like member is attached to the female-side end portion.

FIG. 13(*b*) is a longitudinal sectional view in a longitudinal direction illustrating the other pipe joint structure.

FIG. 15(*b*) is a side view illustrating a main part of the handle with the end cap.

FIG. 15(*c*) is a rear view illustrating a main part of the handle with the end cap.

FIG. 15(*d*) is an end view illustrating a main part of the handle with the end cap.

FIG. 16(*b*) is a perspective view illustrating the cleaning device which includes the handle with the end cap.

FIG. 21(*b*) is a perspective view illustrating a situation to rotate the handle in the circumferential direction against the cleaning head.

FIG. 21(*c*) is a perspective view illustrating a situation to rotate the handle in the circumferential direction against the cleaning head.

FIG. 22(*b*) is a perspective view illustrating a situation to rotate the handle in the circumferential direction against the cleaning head.

FIG. 22(*c*) is a perspective view illustrating a situation to rotate the handle in the circumferential direction against the cleaning head.

FIG. 22(*d*) is a perspective view illustrating a situation to rotate the handle in the circumferential direction against the cleaning head.

FIG. 22(*e*) is a perspective view illustrating a situation to rotate the handle in the circumferential direction against the cleaning head.

FIG. 22(*f*) is a perspective view illustrating a situation to rotate the handle in the circumferential direction against the cleaning head.

FIG. 22(*g*) is a perspective view illustrating a situation to rotate the handle in the circumferential direction against the cleaning head.

FIG. 26(*b*) is an enlarged perspective view of part A of FIG. 26(*a*).

FIG. 27(*b*) is a bottom view of a cleaning device body exemplifying another embodiment of the wave-like corrugated surface portion.

FIG. 27(*c*) is a bottom view of a cleaning device body exemplifying another embodiment of the wave-like corrugated surface portion.

FIG. 27(*d*) is a bottom view of a cleaning device body exemplifying another embodiment of the wave-like corrugated surface portion.

FIG. 27(*e*) is a bottom view of a cleaning device body exemplifying another embodiment of the wave-like corrugated surface portion.

FIG. 27(*f*) is a bottom view of a cleaning device body exemplifying another embodiment of the wave-like corrugated surface portion.

DESCRIPTION OF EMBODIMENTS

Figure 1:
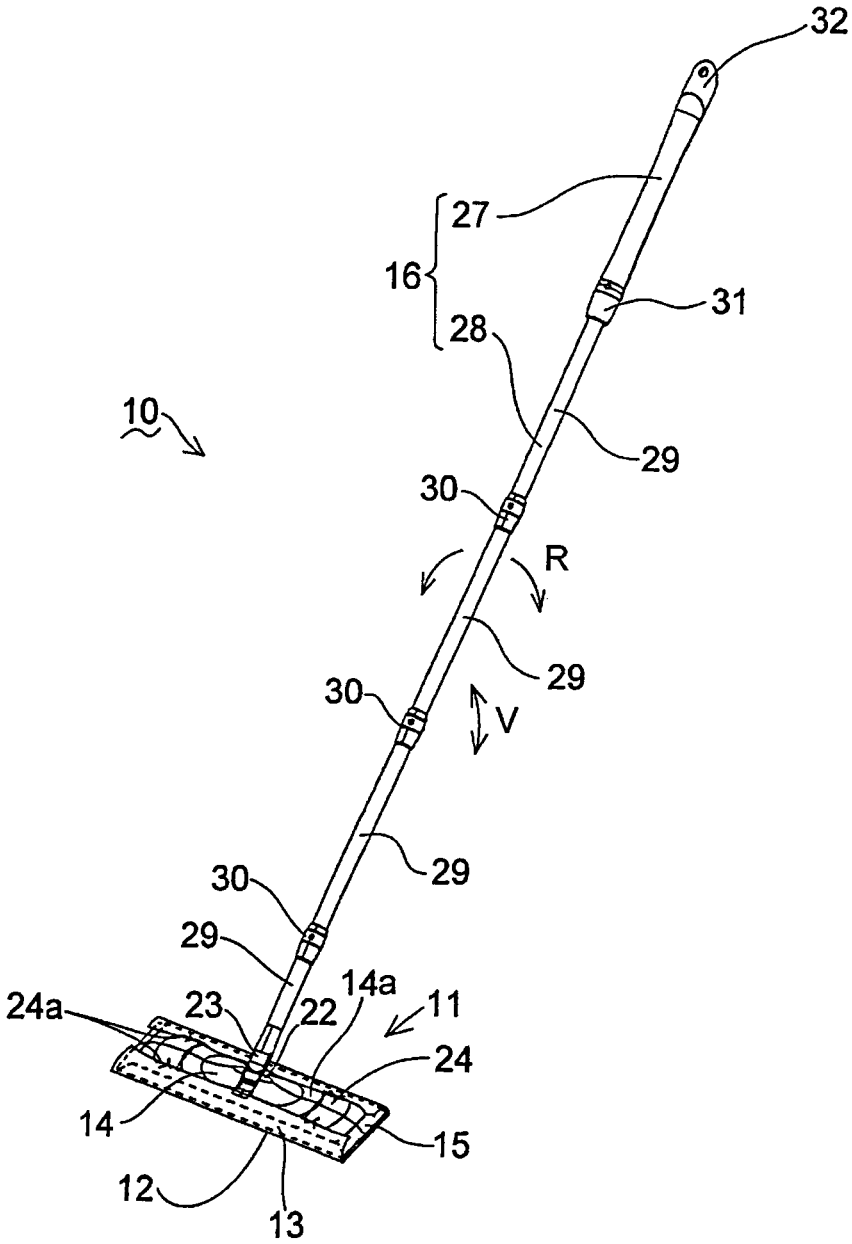
FIG. 1 is a perspective view illustrating an overall structure of a cleaning device according to a preferable embodiment of the present invention.

According to cleaning devices of Patent Literature 1 or Patent Literature 2, dust and dirt can be easily taken to the inside from a circumferential section of a cleaning surface as the cleaning surface at a lower surface of a cleaning device body made of elastic cushion material having a curved shape, or an uneven surface to be cleaned can be easily cleaned and dirt on a surface to be cleaned can be easily scraped as a number of irregularities or wave-like projections being arranged at a cleaning surface. According to such cleaning devices, although the abovementioned functions are effectively produced, solid matters particularly such as dust, hair and dirt are more likely to be accumulated as some ranges inside the cleaning surface. For this reason, it has been desired to develop a new technology enabling to effectively perform cleaning of a surface to be cleaned while solid matters such as dust, hair and dirt are to be stuck to a wide range of a cleaning sheet attached as covering a cleaning surface.

According to a pipe joint structure of Patent Literature 4, occurrence of loose or breakage at a joint portion can be effectively prevented even when bend stress is applied to the joint portion during cleaning with a cleaning device and each pair of cylindrical pipes can be integrally joined in the axial direction in a detachably attachable manner easily with a simple structure. However, it has been desired to develop a new technology for performing smoother joining operation of the cylindrical pipes or for preventing an engaging projection engaged at the time of usage from being easily detached from a male-side projection insertion hole.

According to a traditional joint structure with which a head-side yoke portion arranged at a cleaning head and a handle-side yoke portion arranged at a lower end part of a handle are joined via a joint member having a first rotational axial center portion and a second rotational axial center portion, cleaning of a floor surface and the like can be effectively performed while rotating a cleaning head in the circumferential direction even in a state that the handle is tilted against the cleaning head over a remarkable angle range from a state that the handle is vertically raised. However, in a state that the handle is arranged approximately in parallel to the cleaning head as the handle being further tilted, it becomes difficult to smoothly rotate the cleaning head in the circumferential direction as a result of interference between the head-side yoke portion and the handle-side yoke portion and difficulty of transmitting of rotational force from the handle to a joint portion.

Therefore, since the handle is to be arranged approximately in parallel to the cleaning head when the cleaning head is put into a low space such as a space below a bed, for example, it becomes difficult to perform cleaning of a floor surface around bed legs, for example, while rotating the cleaning head in the circumferential direction. For this reason, it has been desired to develop a new technology enabling the cleaning head to be smoothly rotated in the circumferential direction even when the cleaning head is put into such a low space.

Meanwhile, recently, there have been developed various cleaning devices respectively enabling only a cleaning sheet to be disposal as dust and dirt being stuck to the cleaning sheet by attaching the cleaning sheet made of non-woven fabric or the like to a cleaning device body to be replaceable in a detachably attachable manner as covering a lower face of the cleaning device body having a rectangular plane shape, for example, to be a cleaning surface (e.g. refer to Patent Literature 6). In such a cleaning device, since the lower face of the cleaning device body is formed to be a stable placing surface onto a floor surface or the like, the cleaning device is stored or temporarily placed in a state that a handle is propped to a wall surface or the like while the cleaning device body is kept placed on a floor surface or the like.

However, according to the handle equipped with a traditional end cap, although hanging from a hook member or the like arranged on a wall surface or the like is facilitated, stability when being propped to a wall surface or the like is not taken into account. For this reason, it has been desired to develop a technology to improve stability when a handle is propped. Particularly, with recent cleaning devices, in most cases, a handle is joined to an upper face of a cleaning device body via a rotary joint, for example, to be capable of performing a 360-degree rotation in the circumferential direction as well as being rotatable in the up-down direction and the handle is easily to be in an unstable state when being propped. For this reason, it has been further desired to develop a technology to improve stability of a handle when propped.

According to a cleaning device of Patent Literature 8, it is possible to prevent a cleaning sheet attached to a cleaning head from being easily detached therefrom by attaching edge parts of the cleaning sheet to a saw-tooth-shaped holding slit. However, it has been desired to develop a new technology to further improve operability for attaching a cleaning sheet.

The present invention relates to a cleaning device capable of effectively performing cleaning of a surface to be cleaned while solid matters such as dust, hair and dirt are to be stuck to a wide range of area of a cleaning sheet attached as covering a cleaning surface of a cleaning device body.

The present invention relates to a cleaning device having a pipe joint structure with which each pair of cylindrical pipes structuring a handle can be joined more smoothly, an engaging project is reliably engaged with a male-side projection insertion hole, and the engaging projection can be prevented from being easily detached from the male-side projection insertion hole at the time of usage.

The present invention relates to a cleaning device which includes an end-cap-equipped handle for a cleaning device capable of effectively improving stability when the handle of the cleaning device is propped to a wall surface or the like.

The present invention relates to a cleaning device which has a joint structure of a cleaning head capable of effectively performing cleaning while the cleaning head is rotated in the circumferential direction with operation from a handle even at a low or narrow space as setting the handle to be smoothly rotatable in the circumferential direction about a joint portion even in a state that the handle is arranged approximately in parallel to the cleaning head.

The present invention relates to a cleaning device capable of further improving operability for attaching a cleaning sheet as well as preventing the cleaning sheet attached to a cleaning head from being easily detached.

The present invention provides a cleaning device to wipe a surface to be cleaned with a cleaning sheet which is attached as covering a cleaning surface being a lower face of a base body. The cleaning device includes a cleaning device body which includes a cleaning head and a base body attached as covering a lower face of the cleaning head, and a handle portion which is attached to a face at the opposite side to the lower face of the cleaning head. The lower face of the base body includes a wave-like corrugated surface portion of which cross-section in a direction perpendicular to a predetermined direction along which cleaning is performed with the cleaning device body in a planar view is wave-shaped as having a ridge portion and a valley portion arranged alternately and continuously. The valley portion of the wave-like corrugated surface portion includes an oblique valley portion of which an end part is opened to a side portion of the base body facing to the predetermined direction as being extended obliquely against the predetermined direction.

Here, in the embodiments of the present invention, directions of front-rear, right-left and up-down are defined for convenience to simply describe relative relation among structural components of the present invention. Directions for manufacturing or usage for actualizing the present invention are not limited to the above.

Preferably, the handle portion is a handle and the handle is formed by joining a plurality of cylindrical pipes with a pipe joint structure for integrally joining a pair of the cylindrical pipes in an axial direction. Preferably, in the pipe joint structure, a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion from the outside between the male-side end portion and the female-side end portion. Preferably, the female-side end portion includes a positioning guide rib which inwardly projects from an inner circumferential surface of the female-side end portion at a section being apart from the female-side projection insertion hole in a circumferential direction, the male-side end portion includes a guide groove extended from a top edge part of the male-side end portion in an axial direction at a section being apart from the male-side projection insertion hole in the circumferential direction as corresponding to the positioning guide rib, and the male-side end portion is inserted to the female-side end portion until the male-side projection insertion hole is matched to the female-side projection insertion hole while the positioning guide rib of the female-side end portion is guided as being engaged with the guide groove of the male-side end portion.

Preferably, the handle portion is a handle and the handle is formed by joining a plurality of cylindrical pipes with a pipe joint structure for integrally joining a pair of the cylindrical pipes in an axial direction. Preferably, in the pipe joint structure, a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion from the outside between the male-side end portion and the female-side end portion. Preferably, an abutment rib which abuts to an end surface of the female-side end portion from a back side is arranged at the sleeve-like member continuously or discontinuously in a circumferential direction as inwardly projecting from an inner circumferential surface of a section covering the joint line portion, an insertion guide slope portion extended as being sloped outwardly in the circumferential direction toward a top end side of the sleeve-like member is arranged at the abutment rib continuously or discontinuously in the circumferential direction, and the male-side end portion of the one cylindrical pipe is inserted to the female-side end portion as being guided by the insertion guide slope portion in a state that the sleeve-like member is attached to the female-side end portion of the other cylindrical pipe while the end surface is abutted to an abutment surface of the abutment rib.

Preferably, the handle portion is a handle and an end cap is attached to an upper end part of the handle. Preferably, the end cap attached to the upper end part of the handle through an attachment hole is made of elastic material and a cover end surface of the end cap arranged to cover an end surface portion of the handle is formed as an oblique surface against a perpendicular surface to a center axis direction of the handle, so that a taper-shaped top edge section of the end cap forms a cushion portion capable of being elastically deformed inwardly and outwardly in a radial direction as having the center axis direction of the handle as the center.

Preferably, the handle portion is a handle and a joint structure of a cleaning head is provided to enable the handle to perform a 360-degree rotation in a circumferential direction about a joint portion in a state that the handle is arranged approximately in parallel to the cleaning head. Preferably, the joint structure of the cleaning head forms the joint portion capable of being rotated in an up-down direction and the circumferential direction by joining a bifurcated head-side yoke portion arranged as projecting from an upper face of the cleaning head and a bifurcated handle-side yoke portion arranged at a lower end part of the handle via a joint member which includes a first rotational axial center portion and a second rotational axial center portion of which center axes are orthogonal. Preferably, mutually-distant opposed surfaces of a pair of yoke projection portions structuring the head-side yoke portion respectively have a symmetrically mountain-shaped outer circumferential portion which includes slope portions at both sides of a crest portion, a pair of yoke pieces structuring the handle-side yoke portion has lateral width being approximately the same as space width between the opposed surfaces of the pair of yoke projection portions, an edge portion of either yoke piece is capable of being abutted to an outer circumferential portion of the opposed surface of either yoke projection portion in a state that the handle is arranged approximately in parallel to the cleaning head. Preferably, the edge portion of either yoke piece is arranged to be movable as running over or sliding down along the outer circumferential portion of the opposed surface of either yoke projection portion in accordance with rotation of the handle in the circumferential direction in a state of being arranged approximately in parallel to the cleaning head.

Here, in the present invention, the state that the handle is arranged approximately in parallel to the cleaning head denotes a state that the handle is arranged approximately in parallel to the cleaning surface of the cleaning head. Further, approximate parallelization includes a state that the handle is extended obliquely against the cleaning surface of the cleaning head at a gentle oblique angle on the order of 10° to 20°, for example, as well as a state that the handle is extended in parallel to the cleaning surface of the cleaning head.

Preferably, a cleaning sheet attachment which attaches a cleaning sheet to be replaceable in a detachably attachable manner is arranged at an upper face portion of the cleaning head and edge parts of the cleaning sheet which is wound as covering a bottom surface portion of the cleaning head are attached to the cleaning sheet attachment so as to maintain a state that the cleaning sheet is attached to the cleaning head. Preferably, the cleaning sheet attachment is structured by forming a holding slit and an opening slit at an attaching member, the holding slit is formed into a saw-tooth shape or a waveform shape as being extended in a direction at a right angle or approximately at a right angle against a direction of tension force acting on the cleaning sheet, the opening slit includes a two-line slit having two lines extended at one side as being continued to the holding slit at a center section of the holding slit and an oblique slit extended at the other side obliquely against an extending direction of the holding slit as sandwiching the holding slit, and the oblique slit includes a base end portion being adjacent to the holding slit and a widening portion at a top end side from the base end portion having slit width which is wider than that of the base end portion.

A cleaning device 10 illustrated in FIG. 1 according to a preferable embodiment of the present invention is used for performing cleaning operation with a disposable cleaning sheet 13 attached to be replaceable in a detachably attachable manner as covering a cleaning surface 12 of a cleaning device body 11, for example, having a floor surface as a surface to be cleaned. The cleaning device 10 of the present embodiment has a function to enable to perform cleaning of a surface to be cleaned while having solid matters particularly such as dust, hair and dirt stuck to a wide range of area of the cleaning sheet 13 which covers the cleaning surface 12 of the cleaning device body 11 when wiping the surface to be cleaned with the cleaning device body 11.

Figure 2A:
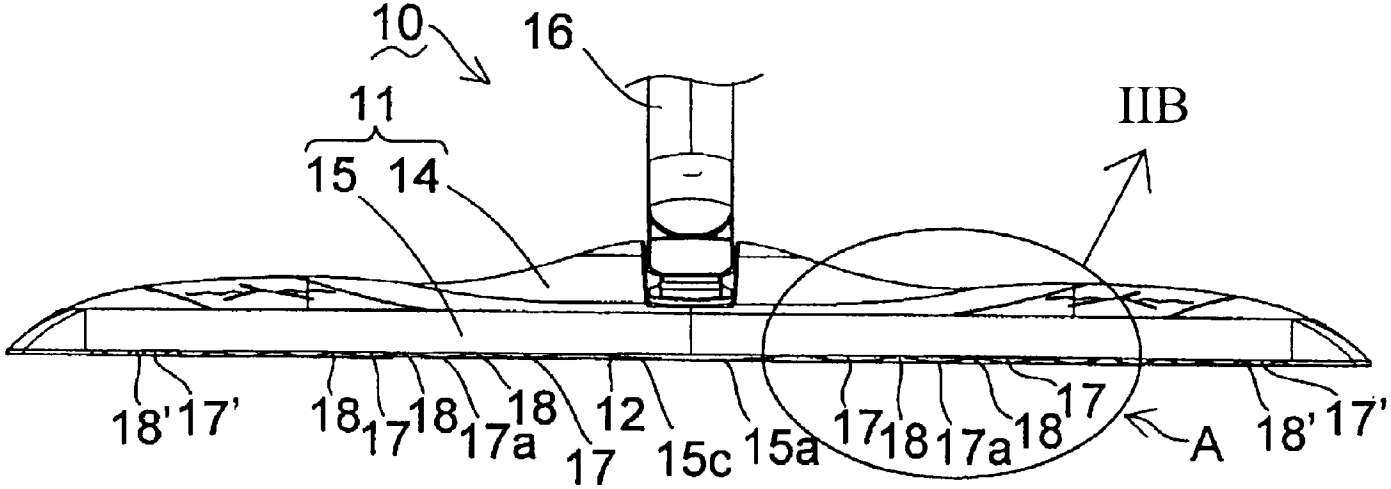
FIG. 2A is a front view of a cleaning device body illustrating a main part of the cleaning device according to the preferable embodiment of the present invention.
Figure 2B:
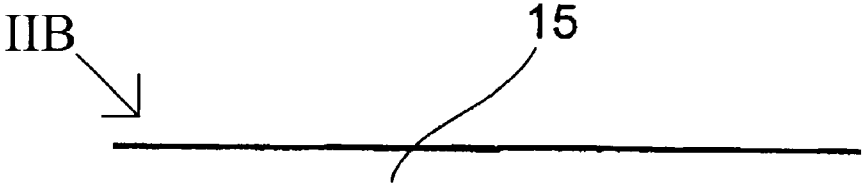
FIG. 2B is an enlarged view of portion IIB of the main part of the cleaning device illustrated in FIG. 2A.
Figure 2B:
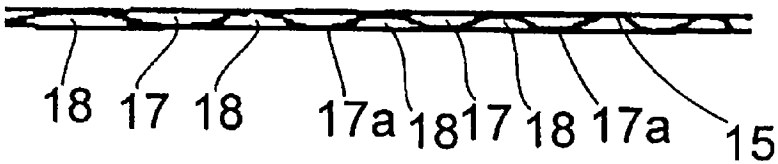
Figure 2C:
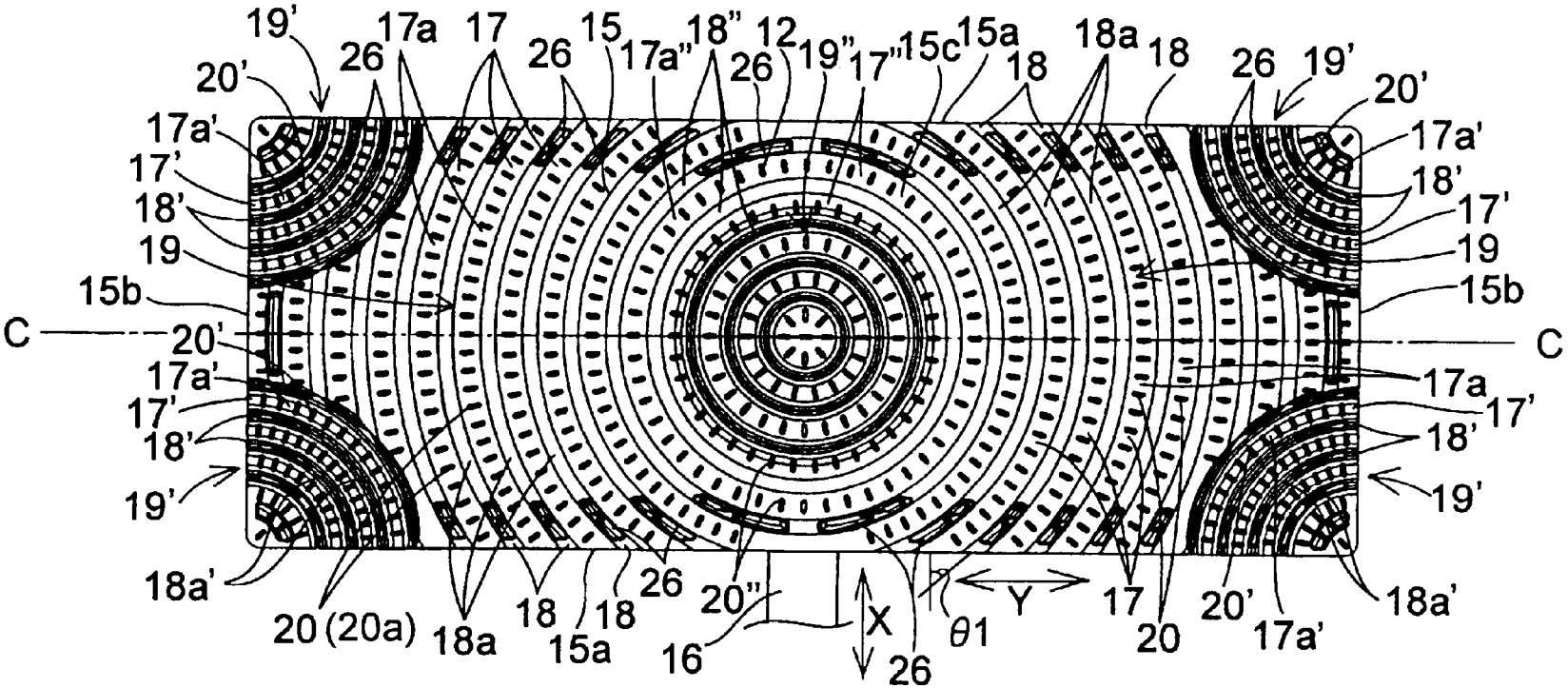
FIG. 2C is a bottom view of the cleaning device body illustrating a main part of the cleaning device according to the preferable embodiment of the present invention.

The cleaning device 10 of the present embodiment is provided with the cleaning device body 11 which includes a cleaning head 14 and an elastically deformable base body 15 attached as covering a lower face of the cleaning head 14 and a handle portion 16 which is attached to a face at the opposite side to the lower face of the cleaning head 14. The cleaning sheet 13 is attached as covering the lower face (the cleaning surface 12) of the base body 15 and the surface to be cleaned is wiped with the cleaning sheet 13. As in FIGS. 2A-C illustrating a state that the cleaning sheet 13 is not attached, the lower face of the base body 15 includes a wave-like corrugated surface portion 19 of which vertical cross-section is wave-shaped as having ridge portions 17 and valley portions 18 arranged alternately and continuously in a direction (perpendicular direction) Y perpendicular to a predetermined direction X along which cleaning is performed with the cleaning device body 11 in a planar view of the lower face of the base body 15. The valley portions 18 of the wave-like corrugated surface portion 19 are provided with oblique guide portions (oblique valley portions) 18*a* of which end parts are opened to a side portion 15*a* of the base body 15 facing to the predetermined direction X as being extended obliquely against the predetermined direction X. According to the oblique guide portions (oblique valley portions) 18*a*, objects to be stuck to the cleaning sheet 13 (solid matters such as dust like lint, hair and dirt) can be guided obliquely along the surface of the cleaning sheet 13 as being stuck to the cleaning sheet 13 in accordance with wiping on the surface to be cleaned. Further, it is preferable that the ridge portions 17 of the wave-like corrugated surface portion 19 are provided with a plurality of projection ribs 20 projecting from crest portions 17*a* of the ridge portions 17 at intervals in the extending direction of the crest portions 17*a* at least at sections along the oblique guide portions (oblique valley portions) 18*a* of the valley portions 18.

Here, the predetermined direction X in which cleaning is performed with the cleaning device body 11 is a direction (cleaning direction) in which cleaning can be efficiently performed with the cleaning device body 11 and is a direction being selectable for a user of the cleaning device 10 in accordance with a situation of a place to be cleaned. For example, the present embodiment is described as the cleaning direction being the direction X which is perpendicular to a long side portion 15*a* of the base body 15 having a rectangular plane shape. However, it is also possible that the cleaning direction is to be the direction Y which is perpendicular to a short side direction of the base body 15.

Further, in the present application, the oblique guide portion 18*a* denotes the valley portions 18 of the wave-like corrugated surface portion 19, also being oblique valley portions or oblique groove portions, capable of obliquely guiding objects to be stuck to the cleaning sheet 13 generally toward directions to the center of the base body 15 in accordance with wiping on the surface to be cleaned.

Further, in the cleaning device 10 of the present embodiment, the wave-like corrugated surface portion 19 at the lower face of the base body 15 is arranged as a part of a corrugated surface extended in a watering manner over the entire surface of the base body 15. The corrugated surface extended in a watering manner is a corrugated surface extended circularly over the entire surface of the base body 15.

Figure 3:
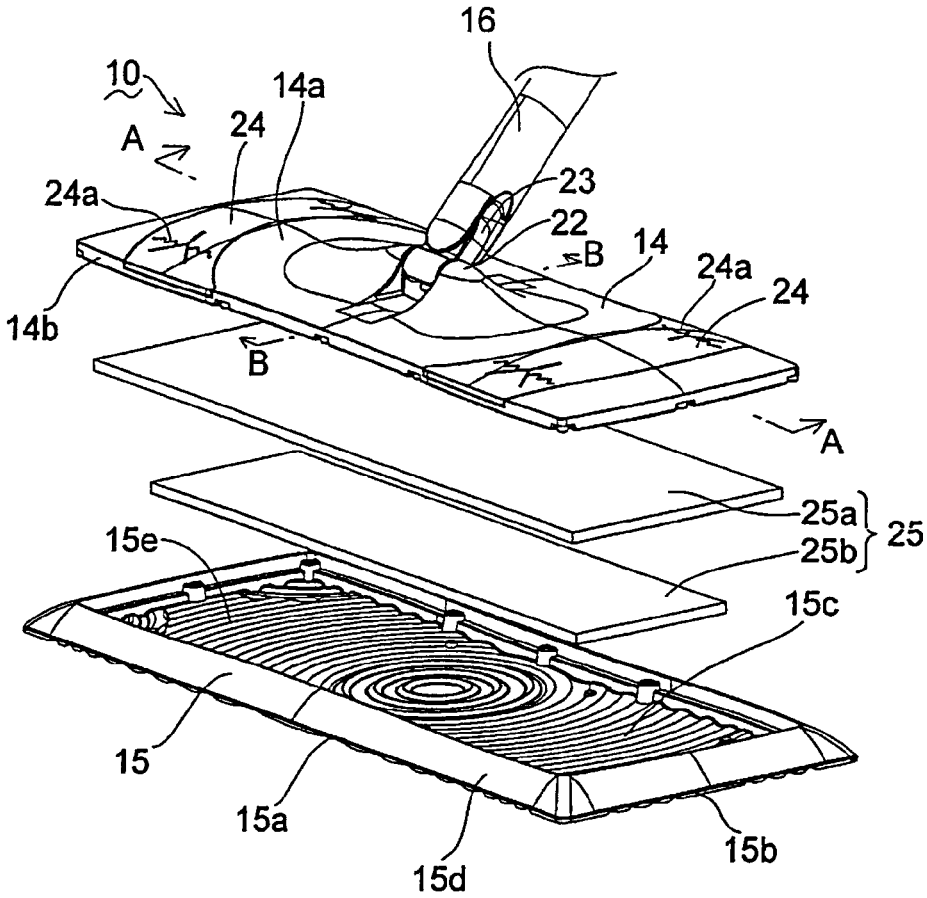
FIG. 3 is an exploded perspective view illustrating a structure of the cleaning device body.
Figure 4:
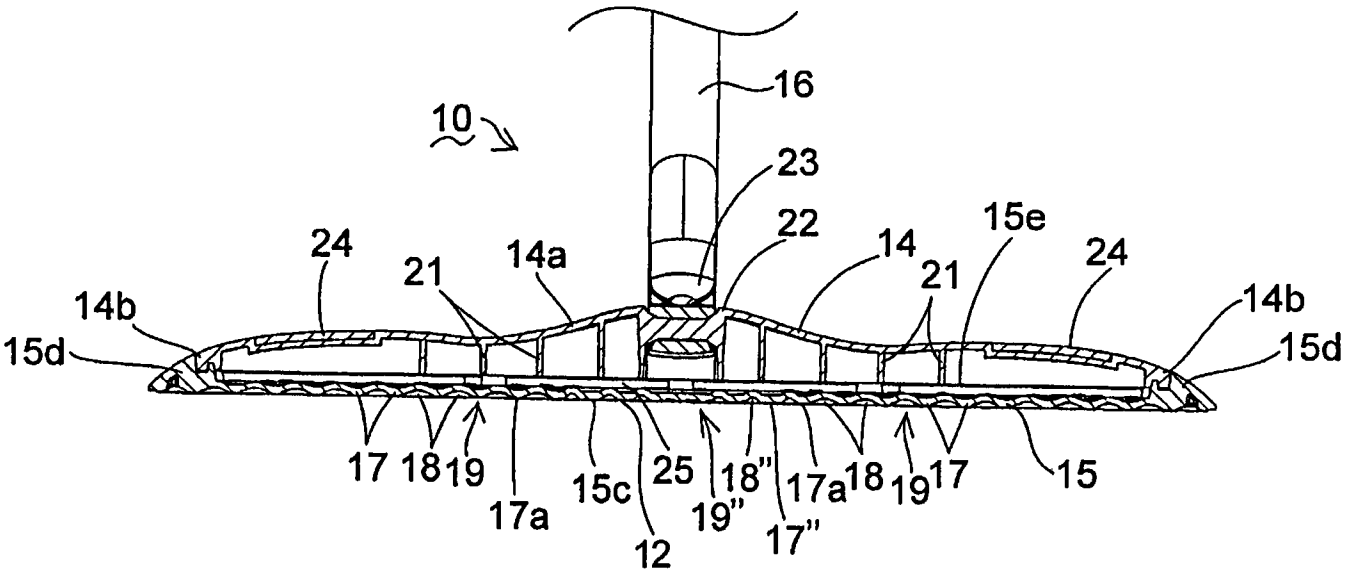
FIG. 4 is a sectional view along A-A of FIG. 3 illustrating a structure of the cleaning device body.

In the present embodiment, as illustrated in FIGS. 3 and 4 as well, the cleaning head 14 structuring the cleaning device body 11 is a plastic-made flat-plate-shaped member having a rectangular plane shape of which long side is on the order of 200 to 300 mm and of which short side is on the order of 50 to 150 mm. A circumferential part of a top face portion 14*a* of the cleaning head 14 forms a circumferential wall portion 14*b* as being folded downward. In a flat hollow portion at the lower face side of the cleaning head 14 surrounded by the circumferential wall portion 14*b* in four directions, a plurality of reinforcement ribs 21 are arranged as projecting downwardly from the top face portion 14*a* longitudinally and transversely across the hollow portion.

A handle support joint portion 22 is integrally arranged at an upper face of the top face portion 14*a* of the cleaning head 14 being a face at the opposite side to a lower face which is an opening face of the cleaning head 14 as raising a center section thereof. A rotary joint portion 23 arranged at a lower end part of the handle portion 16 is joined to the handle support joint portion 22, so that cleaning operation with the cleaning device 10 can be performed as rotationally moving the handle portion 16 in the lateral direction as well as the up-down direction against the cleaning device body 11.

A publicly known sheet holding portion 24 or a later-mentioned cleaning sheet attachment 24 as the sheet holding portion 24 made of elastic material in which engagement slits 24*a* are formed is arranged at the top face portion 14*a* of the cleaning head 14. The cleaning sheet 13 can be easily attached to the cleaning device body 11 (refer to FIG. 1) to be replaceable in a detachably attachable manner by performing engagement as squeezing end parts of the cleaning sheet 13 into the engagement slits 24*a* of the sheet holding portion 24 arranged at the top face portion 14*a* after the cleaning sheet 13 is wound to the cleaning head 14 as covering the lower face (cleaning surface 12) of the base body 15 which is integrally attached to the lower face side of the cleaning head 14.

The base body 15 structuring the cleaning device body 11 along with the cleaning head 14 is made of urethane, ethylene-vinyl acetate copolymer (EVA) resin or the like, for example as elastically deformable synthetic resin. The base body 15 has a rectangular plane shape which is a size larger than the cleaning head 14. The base body 15 includes a bottom face portion 15*c* and a circumferential wall portion

15*d* which is arranged at a circumferential section of the bottom face portion 15*c*. The bottom face portion 15*c* is formed thin as having thickness on the order of 0.5 to 3 mm, for example. The circumferential wall portion 15*d* has an approximately triangular sectional shape. A concave fitting portion 15*e* to which the cleaning head 14 is fitted is formed at the upper face side of the base body 15 surrounded by the circumferential wall portion 15*d* in four directions.

Figure 5:
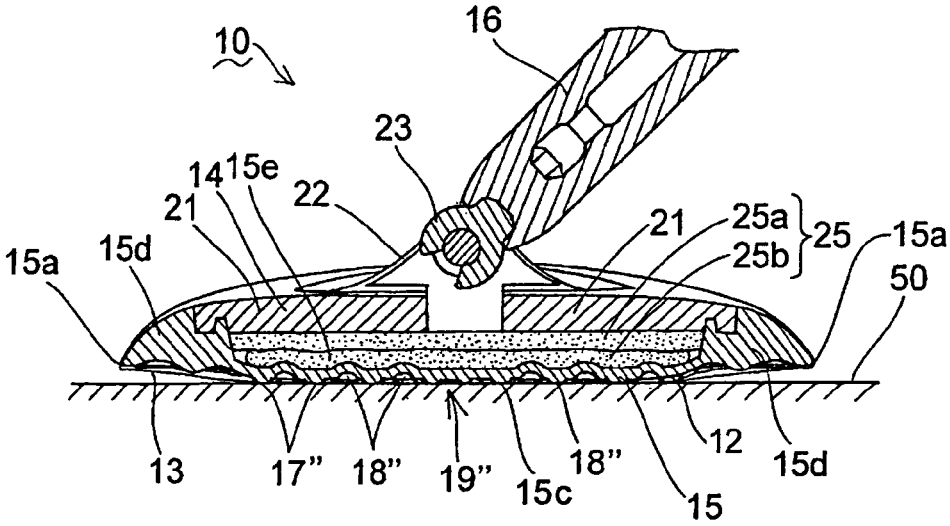
FIG. 5 is a schematic sectional view along B-B of FIG. 3 illustrating a structure of the cleaning device body.

In the present embodiment, as illustrated in FIG. 5 as well, the cleaning head 14 is fitted to the concave fitting portion 15*e* and is bonded to the base body 15 with adhesive and the like after interposing a cushion member 25 between the lower face of the cleaning head 14 and the bottom face portion 15*c* of the base body 15. Thus, the cleaning device body 11 integrating the above is formed.

The cushion member 25 interposed between the lower face of the cleaning head 14 and the base body 15 is made of sponge (of which material is urethane foam, for example), for example, as cushion material being softer than the base body 15. In the present embodiment, the cushion member 25 includes an upper sponge member 25*a* having a rectangular plane shape of which size is approximately the same as the concave fitting portion 15*e* of the base body 15 and a lower sponge member 25*b* having a rectangular plane shape which is a size smaller than the upper sponge member 25*a*. The cushion member 25 is attached over approximately entire area of the lower face of the cleaning head 14 so as to fill clearance between the plurality of reinforcement ribs 21 arranged at the lower face side of the cleaning head 14 and the bottom face portion 15*c* of the base body 15 in a state that the sponge members 25*a*, 25*b* are stacked.

Since the cleaning device 11 is formed as interposing the cushion member 25 between the lower face of the cleaning head 14 and the bottom face portion 15*c* of the base body 15, the bottom face portion 15*c* of the base body 15 can be pushed out by the cushion member 25 in a state of being planarly supported from the back face side thereof. In addition, it is possible to obtain a state that the lower face of the bottom face portion 15*c* to be the cleaning surface 12 downwardly projects to be a curved shape being gently curved with gentle elastic urging force of the cushion member 25 (refer to FIG. 5). With the above, in a state that only slight pressing force is applied from the handle portion 16 to the cleaning device body 11, for example, cleaning operation can be performed with a soft feeling as the curved cleaning surface 12 being fitted to a surface 50 to be cleaned and solid matters such as dust, hair and dirt can be taken to the vicinity of a center section of the cleaning sheet 13. Meanwhile, in a state that considerable pressing force is applied from the handle portion 16 to the cleaning device body 11 for performing cleaning operation by pressing the cleaning surface 12 to the surface 50 to be cleaned, the lower face of the base body 15 covered by the cleaning sheet 13 can be a flat surface fitted to the surface 50 to be cleaned over a wide area with a soft cushion feeling as the cushion member 25 being easily crushed with a balanced manner over the entire cushion member 25.

Besides sponge, for example, a flat bag or the like in which air or liquid is encapsulated can be used as the cushion material being softer than the base body 15 for the cushion member 25 to be interposed between the lower face of the cleaning head 14 and the bottom face portion 15*c* of the base body 15.

In the present embodiment, since the circumferential wall portion 15*d* structuring the circumferential section of the base body 15 has an approximately triangular sectional shape, an outer circumferential section of the base body 15 becomes to an acutely-tapered surface against the lower face of the base body 15. Accordingly, even against a floor surface at a corner section of a wall surface and the floor surface of a floor surface at a recessed corner section of a wall surface, cleaning operation can be performed effectively while the outer circumferential section of the base body 15 is abutted to the wall surface.

Further, in the present embodiment, a variety of publicly-known cleaning sheets such as olefinic ultrafine non-woven fabric, for example, can be used as the cleaning sheet 13 to which dust, dirt and the like are stuck as being attached to the cleaning device body 11 as covering the cleaning surface 12.

In the cleaning device 10 of the present embodiment, as illustrated in FIGS. 2A-C and 4, the lower face of the bottom face portion 15*c* of the base body 15 includes the wave-like corrugated surface portion 19 of which vertical cross-section is wave-shaped as having the ridge portions 17 and the valley portions 18 arranged alternately and continuously in the direction (perpendicular direction) Y perpendicular to the predetermined direction X along which cleaning is performed with the cleaning device body 11 in a planar view of the lower face of the base body 15. In the present embodiment, the base body 15 has a rectangular plane shape. Then, the predetermined direction X in which cleaning can be effectively performed with the cleaning device body 11 is a direction along a short side portion 15*b* of the base body 15 (cleaning device body 11) and the direction Y perpendicular to the predetermined direction X of the cleaning device body 11 in a planar view of the lower face of the base body 15 is a direction along the long side portion 15*a* of the base body 15 (cleaning device body 11).

In the present embodiment, the wave-like corrugated surface portion 19 is structured as a part of the watering corrugated surface extended in a circular manner from the center section of the base body 15. That is, in the present embodiment, a watering-like corrugated surface is formed at approximately entire area of the lower face of the base body 15 except for four corner sections. The wave-like corrugated surface portion 19 is formed in a manner that end parts of the valley portions 18 in an area sandwiched by the sixth valley portion 18 and the tenth valley portion 18 from the center section of the watering-like corrugated surface are opened to the long side portion 15*a* of the base body 15 (refer to FIGS. 2A-C. A pair of the wave-like corrugated portions 19 is arranged at both sides in the long side portion 15*a* direction as sandwiching the center section of the base body 15.

Further, each of the valley portions 18 of the wave-like corrugated surface portion 19 is curved to be arc-shaped and is extended obliquely against the predetermined direction X in which cleaning is performed with the cleaning device body 11 toward a center line C in the short side direction of the base body 15 from the end part being opened to the long side portion 15*a* of the base body 15. Thus, the valley portions 18 along the approximately entire length become to the oblique guide portions (oblique valley portions) 18*a* capable of guiding objects to be stuck to the cleaning sheet 13 (solid matters such as dust, hair and dirt) in the oblique direction along the surface of the cleaning sheet 13 in accordance with wiping on the surface to be cleaned.

Further, in the present embodiment, the valley portions 18 of the wave-like corrugated surface portion 19 are formed as grooves respectively having an approximate arc-shaped section which has width on the order of 2 to 10 mm, for example, and depth on the order of 0.5 to 3 mm from the crest portion 17*a* of the ridge portion 17, for example. In total, ten pieces of the valley portions 18 of the wave-like corrugated surface portion 19 are arranged concentrically about the center section of the base body 15 as having 5 pieces arranged respectively at both sides in the long side portion 15*a* direction as sandwiching the center section. Further, with respect to the valley portions 18 of the wave-like corrugated surface portion 19, a spread angle θ1 (refer to FIG. 2C) of the oblique guide portion (oblique valley portion) 18*a* against the predetermined direction X is arranged to be larger than 0° and smaller than 90°. It is preferable to be not less than 10° and not more than 80°, and is more preferable to be not less than 15° and not more than 75°. Here, when the valley portion 18 is arc-shaped, the spread angle θ1 denotes an angle between a tangential line in contact with the valley portion 18 and the cleaning direction X. Since the spread angle of the oblique guide portion (oblique valley portion) 18*a* is arranged as described above, objects to be stuck are more likely to be spread at the time of cleaning along the oblique guide portion (oblique valley portion) 18*a* as being stuck to the surface of the cleaning sheet 13. Thus, cleaning can be performed effectively using the entire cleaning sheet 13. Here, in both cases that the spread angle θ1 is 0° (that is, a case that the valley portion 18 is arranged along the short side direction of the base body 15) and that the spread angle θ1 is 90° (that is the valley portion 18 is arranged along the long side direction of the base body 15), objects to be stuck are more unlikely to be spread to a wide range of area of the surface of the cleaning sheet 13.

In the present embodiment, the ridge portions 17 and the valley portions 18 of the wave-like corrugated surface portion 19 are placed symmetrically as sandwiching the center line C in the short side direction of the base body 15. Accordingly, solid matters such as dust can be stuck to a wide range of area of the surface of the cleaning sheet 13 in cases that the surface to be cleaned is wiped while moving the cleaning device body 11 backward in the predetermined direction (cleaning direction) X and that the surface to be cleaned is wiped while moving the cleaning device body 11 frontward and backward in the predetermined direction in a reciprocated manner as well as a case that the surface to be cleaned is wiped while moving the cleaning device body 11 frontward in the predetermined direction X, for example. Further, solid matters such as dust can be stuck more effectively by appropriately switching the front and back as rotating the base body 15 against the handle portion 16 by 180°.

Further, in the present embodiment, a center wave-like corrugated surface portion 19" including a plurality of ridge portions 17" and valley portions 18" which are circular-ring-shaped as being concentrically placed are formed at the center section of the lower face of the base body 15 sandwiched by the wave-like corrugated surface portion 19 of the both sides as a part of the watering-like corrugated surface. The valley portions 18" of the center wave-like corrugated surface portion 19" respectively have a closed circular ring shape without having an end part opened to the long side portion 15*a* of the base body 15.

Further, in the present embodiment, deep groove portions 26 formed by cutting further deeply into the bottom parts of the valley portions 18, 18', 18" are arranged at sections of the respective valley portions 18, 18" overlapped with the circumferential wall portion 15*d* of the base body 15 having an approximately triangular sectional shape as well as at a section of a valley portion 18' of a later-mentioned auxiliary wave-like corrugated surface portion 19' overlapped with the circumferential wall portion 15*b*. Owing to that the deep groove portions 26 are arranged at the sections of the valley portions 18, 18', 18" overlapping with the circumferential wall portion 15*b*, the circumferential wall portion 15*d* having large thickness becomes partly thin and the top end of the acute outer circumferential part of the circumferential wall portion 15*d* becomes more likely to be downwardly bent. Accordingly, it is possible to effectively avoid the outer circumferential part from being turned upward when the outer circumferential part of the base body 15 is abutted to a wall surface of a corner section against a floor surface, for example.

Here, owing to that the circumferential wall portion 15*b* having large thickness is arranged to be partly thin, the deep groove portion 26 also has an effect to prevent occurrence of strain during cooling in a molding process when manufacturing the base body 15 with molding.

Then, in the present embodiment, sections sandwiched by the respective adjacent valley portions 18 of the wave-like corrugated surface portion 19 are arranged as being the ridge portions 17. In the present embodiment, since the valley portions 18 curved as being arc-shaped and obliquely extended are the oblique guide portions (oblique valley portions) 18*a* along the approximately entire length, the plurality of projection ribs 20 are arranged along approximately entire length of the respective ridge portions 17 at least as sections of the respective ridge portions 17 along the oblique guide portions (oblique valley portions) 18*a* of the valley portions 18. The plurality of projection ribs 20 is arranged as projecting from the crest portions 17*a* of the respective ridge portions 17 at intervals on the order of 2 to 10 mm in the extending direction of the crest portions 17*a*, for example.

Further, in the present embodiment, the projection ribs 20 are line-shaped rib pieces 20*a* which are arranged at the ridge portions 17 preferably in a width direction being perpendicular (at a right angle) to the extending direction of the oblique guide portions (oblique valley portions) 18*a* of the valley portions 18 in a planar view of the lower face of the base body. Owing to that the projection ribs 20 are the line-shaped rib pieces 20*a* arranged in the width direction of the ridge portions 17, it becomes possible to more effectively perform a function to feed stuck objects as being guided by the oblique guide portions (oblique valley portions) 18*a* along the surface of the cleaning sheet 13 in the direction to the adjacent valley portion 18 via clearance between the projection ribs 20 as spreading objects to be stuck sandwiched by a section of the surface of the cleaning sheet 13 contacting to the ridge portion 17 and the surface to be cleaned or objects to be stuck existing at a periphery of a section of the surface of the cleaning sheet 13 contacting to the projection ribs 20 in the direction to the adjacent valley portion 17. In addition, the projection ribs 20 also has a function to further facilitate sticking of grime, dust and the like on the surface to be cleaned to the cleaning sheet 13 owing to a scraping effect.

The cleaning device 10 of the present embodiment includes the line-shaped rib pieces 20 which are arranged obliquely against the predetermined direction X. With the line-shaped rib pieces 20 described above, objects to be stuck such as dust are more likely to be spread to the entire surface of the cleaning sheet 13 and grime, dust and the like on the surface to be cleaned are much more likely to be stuck to the cleaning sheet 13.

Here, in the light of easiness of movement of dust and the like and easiness of manufacturing the base body 15, height of the projection ribs 20 (distance from a crest part of the ridge portion 17 to a crest part of the projection rib 20) is preferably in a range between 0.3 mm and 1 mm and more preferably in a range between 0.4 mm and 0.7 mm from a viewpoint of capability of eliminating dust and the like on the surface to be cleaned and capability of widely spreading dust and the like as being stuck to the cleaning sheet 13. Meanwhile, depth of the valley portions 18 (distance from a crest part of the ridge portion 17 to a deepest part of the valley portion 18) is preferably in a range between 0.7 mm and 3 mm and more preferably in a range between 0.8 mm and 2 mm. It is preferable that the height of the projection ribs 20 is smaller than the depth of the valley portions 18.

In the present embodiment, a plurality of projection ribs 20" is arranged as projecting from the crest portions 17*a*" of the respective ridge portions 17" at intervals in the extending direction of the crest portions 17*a*" as line-shaped rib pieces arranged in the width direction of the ridge portions 17" also at the plurality of circular-ring-shaped ridge portions 17" of the center wave-like corrugated surface portion 19". Since the projection ribs 20" are arranged also at the ridge portions 17" of the center wave-like corrugated surface portion 19", stuck objects to be guided by the valley portions 18 of the wave-like corrugated surface portion 19 are fed along the surface of the cleaning sheet 13 in directions of the valley portions 18" of the center wave-like corrugated surface portion 19" via clearance between the projection ribs 20" in accordance with wiping of the surface to be cleaned. Accordingly, objects to be stuck can be stuck to a wider area.

Further, in the present embodiment, width of the crest portions 17*a*, 17*a*" of the ridge portions 17, 17" of the wave-like corrugated surface portion 19 and the center wave-like corrugated surface portion 19" structured respectively with a corrugated surface extended from the center section of the base body 15 in a circular watering manner is widened stepwise or gradually toward the ridge portions 17, 17" at the center side. Accordingly, it is preferable that the crest portion 17*a*" of the ridge portion 17" at least at the center section where the handle portion 16 is joined to the cleaning head 14 is a plane-shaped crest portion having considerable width. Owing to that the crest portion 17*a*" of the ridge portion 17" at the center section where the handle portion 16 is joined is formed as the plane-shaped crest portion, pressing load can be supported by wide area due to the plane-shaped crest portion 17*a*" in a stable state at the center section of the vicinity of the handle portion 16 where large pressing load is applied when pressing force is applied from the handle portion 16 to the cleaning device body 11 for performing cleaning operation as pressing the cleaning surface 12 to the surface to be cleaned. Accordingly, it is possible to effectively avoid the valley portions 18" from being easily crushed. Preferably, the crest portion 17*a*" of the ridge portion 17" at least at the center section has a plane-shaped crest part and the rest of the crest portions 17*a* have curved crest parts. With the above, the entire lower face of the base body 15 can be a flat surface when pressing force is applied from the handle portion 16 to the cleaning device body 11.

Further, in the cleaning device 10 of the present embodiment, the auxiliary wave-like corrugated surface portion 19' of which vertical cross-section in the predetermined direction X along which cleaning is performed with the cleaning device body 11 is wave-shaped as having the ridge portions 17' and the valley portions 18' arranged alternately and continuously is arranged respectively at four corner sections at the lower face of the base body 15.

In the present embodiment, each of the auxiliary wave-like corrugated surface portions 19' includes four valley portions 18' extended as being quadrant-shaped concentrically about each corner. One end part of each valley portion 18' is opened to the short side portion 15*b* of the base body 15 having a rectangular plane shape and the other end part thereof is opened to the long side portion 15*a* of the base body 15 having the rectangular plane shape. Since each valley portion 18' is extended as being quadrant-shaped, the approximately entire length thereof becomes an auxiliary oblique guide portion (auxiliary oblique valley portion) 18*a*' which is extended obliquely against the short side portion 15*b* in a curved state.

Sections sandwiched by the respective adjacent valley portions 18' of the auxiliary wave-like corrugated surface portion 19' are arranged as being the ridge portions 17'. In the present embodiment, since the valley portions 18' are the auxiliary oblique guide portions (auxiliary oblique valley portions) 18*a*' along the approximately entire length, it is preferable that a plurality of projection ribs 20' is arranged along the approximately entire length of the respective ridge portions 17' at least as sections of the respective ridge portions 17' along the auxiliary oblique guide portions (auxiliary oblique valley portions) 18*a*' of the valley portions 18'. The plurality of projection ribs 20 is line-shaped rib pieces which are arranged at the ridge portions 17' preferably in a width direction being perpendicular (at a right angle) to the extending direction of the valley portions 18' in a plain view of the lower face of the base body 15. The plurality of projection ribs 20 is arranged as projecting from the crest portions 17*a*' of the respective ridge portions 17' at intervals on the order of 2 to 10 mm in the extending direction of the crest portions 17*a*', for example.

Owing to that the auxiliary wave-like corrugated surface portion 19' including the valley portions 18' of which end parts are opened to the short side portion 15*b* as being extended obliquely against the short side portion 15*b* and the ridge portions 17' having the plurality of projection ribs 20' at the crest portions 17*a*' is arranged at the lower face of the base body 15, objects being solid matters such as dust can be stuck to a wide range of area of the cleaning sheet 13 which covers the cleaning surface 12 as being guided by the valley portions 18' and the projection ribs 20' of the ridge portions 17' even when cleaning operation is performed with the cleaning device body 11 along a corner section between a floor surface and a wall surface, for example, as the cleaning direction being the direction Y which is perpendicular to the predetermined direction X in a planar view of the lower face of the base body 15.

Further, in the present embodiment, since the other ends of the valley portions 18' of the auxiliary wave-like corrugated surface portion 19' are opened to the long side portion 15*a* of the base body 15, objects being solid matters such as dust can be stuck to a wider range of area of the cleaning sheet 13 which covers the cleaning surface 12 as being guided by the valley portions 18' and the projection ribs 20' of the ridge portions 17' along with the valley portions 18 and the projection ribs 20 of the ridge portions 17 of the wave-like corrugated surface portion 19 even when cleaning operation is performed with the cleaning device body 11 in the predetermined direction X.

As illustrated in FIGS. 1 and 3, the cleaning device 10 of the present embodiment includes a handle 16 as a handle portion attached to the top face portion 14*a* of the cleaning head 14. The handle 16 as the handle portion includes a holding portion 27 at an upper end part and a handle body 28 interposed between the cleaning head 14 and the holding portion 27. The handle body 28 is assembled so that the handle portion 16 including the holding portion 27 has length on the order of 100 to 150 cm as a whole, for example, to be suitable for performing cleaning operation by joining a plurality of cylindrical pipes 29 in the axial direction via a joint portion of a later-mentioned joint structure 30. The rotary joint portion 23 is arranged at a lower end part of the handle body 28. As described above, the handle portion 16 becomes capable of being rotated in the up-down direction and the lateral direction against the cleaning device body 11 by rotatably joining the rotary joint portion 23 to the handle support joint portion 22 which is arranged at the top face portion 14*a* of the cleaning head 14. The holding portion 27 is attached to the upper end part of the handle body 28 in a detachably attachable manner via a joint portion 31 which has approximately similar structure as the later-mentioned cylindrical pipe joint structure 30.

Figure 6:
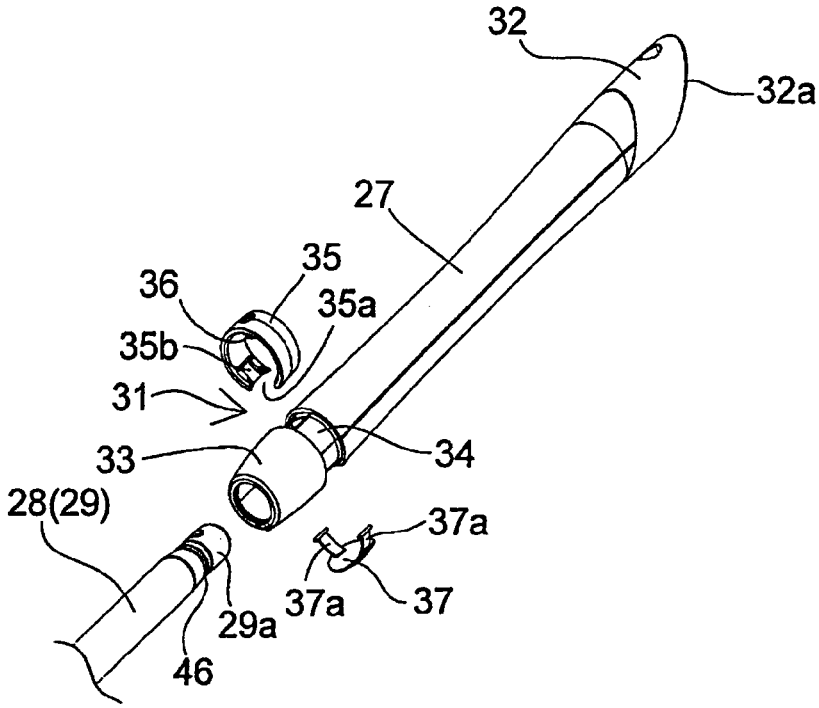
FIG. 6 is an exploded perspective view illustrating a holding portion of a handle portion.

The holding portion 27 being a molded component made of acrylonitrile butadiene styrene (ABS), for example, has an approximately cylindrical shape of which diameter and outline are suitable for holding by hand, as illustrated in FIG. 6 as well. In the present embodiment, an antislip end member 32 made of ethylene-vinyl acetate (EVA) resin, for example, as soft material is integrally attached to the upper end part of the holding portion 27 as an end cap. Since the end cap 32 is attached to the upper end part of the holding portion 27, the cleaning device 10 can be more unlikely to fall as increasing friction force between a wall surface and the upper end part of the holding portion 27 to be abutted to the wall surface as described later. Further, owing to that an end surface of the end cap 32 is formed to be a taper surface 32*a* having an oblique surface by performing cutting, molding or the like obliquely, the friction force can be further increased as the upper end part of the holding portion 27 being abutted to the wall surface in a stable state.

A joint portion 31 for joining the handle body 28 is arranged at the lower end part of the holding portion 27. The joint portion 31 includes an end sleeve portion 33 to which an uppermost cylindrical pipe 29 structuring the handle body 28 is to be inserted, a circular zonal groove 34 which is formed with a cutout of an outer circumferential surface at the lower end part of the holding portion 27, a cutout ring member 35 which has an engaging projection 36 at the inner circumferential surface thereof, a button member 37 which is to be attached to a cutout portion 35*a* of the cutout ring member 35, and the like. The joint portion 31 joins the handle body 28 in a detachably attachable manner with a detachably attachable structure being similar to the later-mentioned pipe joint structure 30 in a state that a diameter-reduced male-side end portion 29*a* of the cylindrical pipe 29 of the handle body 28 is inserted to the end sleeve portion 33.

In the present embodiment, the handle body 28 of the handle 16 is formed by joining the plurality of cylindrical pipes 29 with the pipe joint structure 30 for integrally joining a pair of the cylindrical pipes 29 in the axial direction. That is, the cleaning device 10 is put into market in a state of being separated into components such as the cleaning head 14, cylindrical pipes 29 and the like as being a package of the components for convenience of transportation and distribution. At the time of usage, the components are to be assembled. According to the pipe joint structure 30 of the present embodiment, joining operation of each pair of the cylindrical pipes 29 can be performed smoothly when the handle body 28 of the handle 16 is formed as integrally joining the plurality of cylindrical pipes 29 in the axial direction.

Figure 8A:
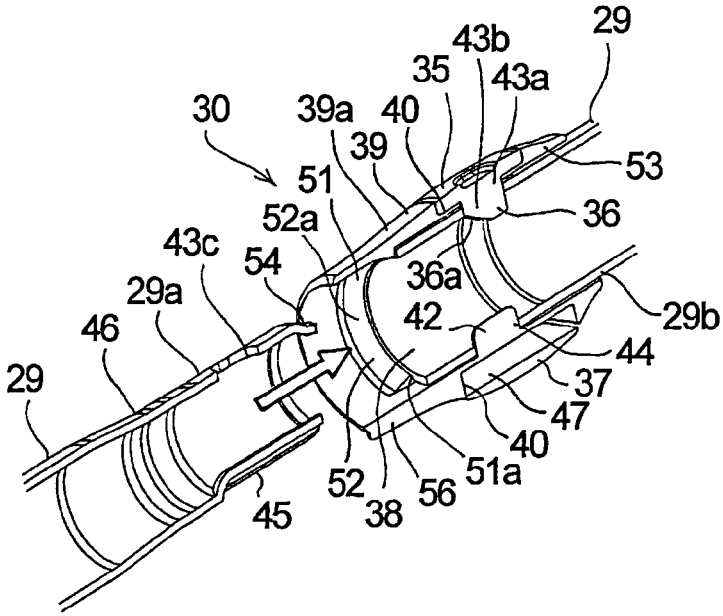
FIG. 8(*a*) is a broken perspective view illustrating a situation of jointing pipe members which structure the rod portion of the handle portion.
Figure 8B:
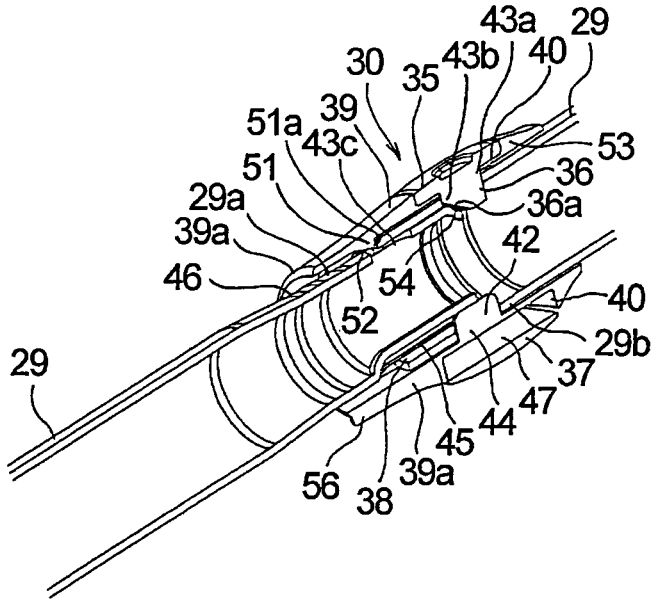
Figure 8C:
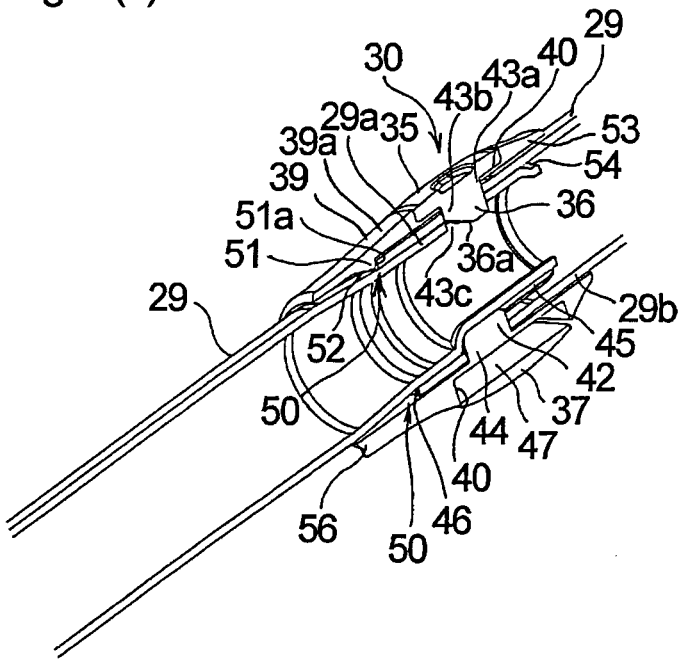

Further, the pipe joint structure 30 has a function to enable to perform cleaning operation in a further stable state while the engaging projection 36 (refer to FIG. 8(*c*)) inserted to from the outside and engaged with a male-side projection insertion hole 43*c* and a female-side projection insertion hole 43*b* which are matched for integrally joining each pair of the cylindrical pipes 29 is prevented from being easily detached from the male-side projection insertion hole 43*c* during usage of the cleaning device 10.

Further, as illustrated in FIGS. 8(*a*) to 8(*c*), the pipe joint structure 30 has a function to effectively avoid difficulty of joining due to interference between the end surface of the male-side end portion 29*a* and the end surface of the female-side end portion 29*b* by correcting positional misalignment of center axes even in a case that the male-side end portion 29*a* is inserted to the female-side end portion 29*b* with the misalignment of the center axes when the male-side end portion 29*a* of one end cylindrical pipe 29 among each pair of the cylindrical pipes 29 is to be inserted to the female-side end portion 29*b* of the other cylindrical pipe 29 when the male-side end portion 29*a* of the one cylindrical pipe 29 out of each pair of the cylindrical pipes 29 is to be inserted to the female-side end portion 29*b* of the other cylindrical pipe 29.

Figure 9A:
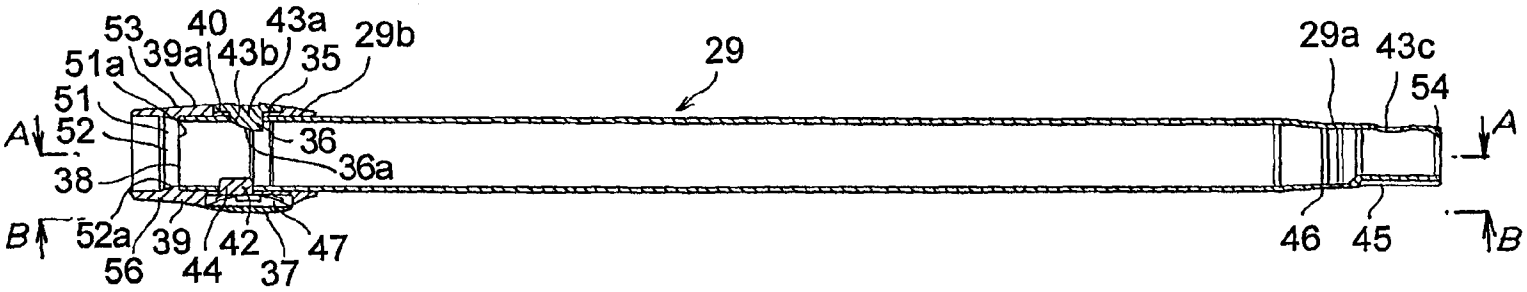
FIG. 9(*a*) is a longitudinal sectional view in a longitudinal direction of a cylindrical pipe member having a male-side end portion and a female-side end portion which structure a pipe joint structure.
Figure 9B:
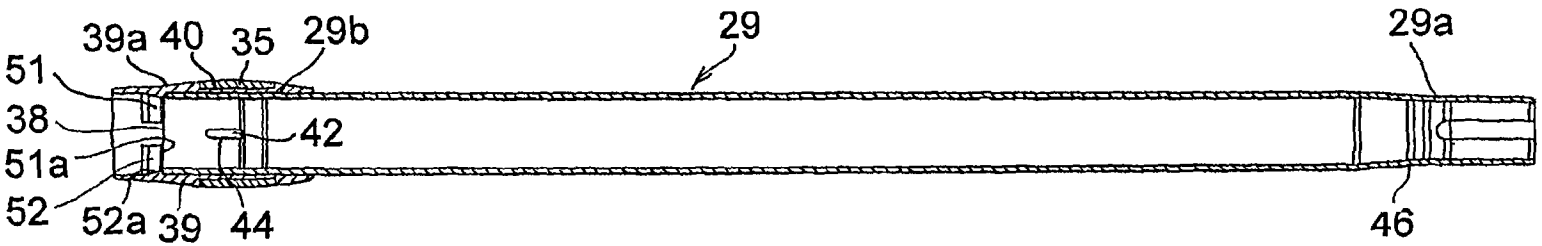
Figure 9C:
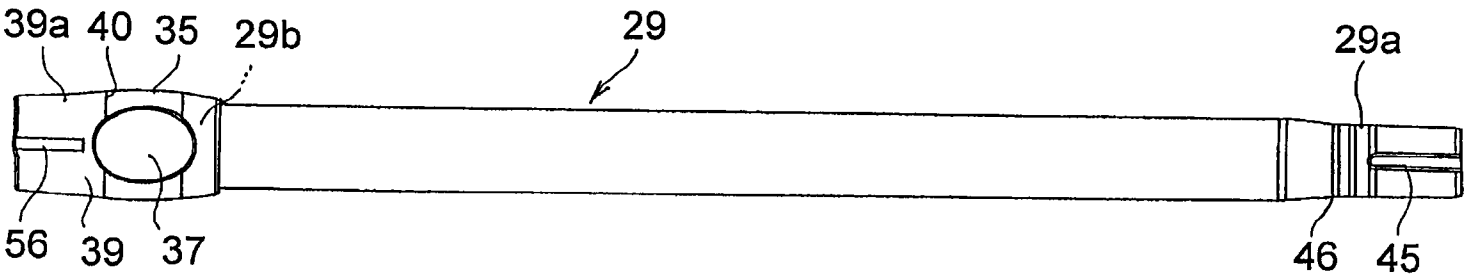

As illustrated in FIGS. 8(*a*) to 8(*c*), the pipe joint structure 30 is a joint portion structure in which the male-side end portion 29*a* of one cylindrical pipe 29 is inserted to the female-side end portion 29*b* of the other cylindrical pipe 29, the engaging projection 36 is engaged from the outside after the male-side projection insertion hole 43*c* and the female-side projection insertion hole 43*b* are matched, and a sleeve-like member 39 is attached as covering a joint line portion 50 between the male-side end portion 29*a* and the female-side end portion 29*b*. As illustrated in FIGS. 9(*a*) to 9(*c*) as well, the female-side end portion 29*b* is provided with a positioning guide rib 42 which inwardly projects from an inner circumferential surface of the female-side end portion 29*b* at a section being apart from the female-side projection insertion hole 43*b* in the circumferential direction. The male-side end portion 29*a* is provided with a guide groove 45 extended from a top edge part of the male-side end portion 29*a* in the axial direction at a section corresponding to the positioning guide rib 42 as being apart from the male-side projection insertion hole 43*c* in the circumferential direction. The male-side end portion 29*a* is inserted to the female-side end portion 29*b* until the male-side projection insertion hole 43*c* is matched to the female-side projection insertion hole 43*b* while the positioning guide rib 42 of the female-side end portion 29*b* is guided as being engaged with the guide groove 45 of the male-side end portion 29*a*.

Further, in the present embodiment, the positioning guide rib 42 is arranged at a part at the radially opposite side to the female-side projection insertion hole 43*b* as being apart from the female-side projection insertion hole 43*b* in the circumferential direction. The guide groove 45 is arranged at a part at the radially opposite side to the male-side projection insertion hole 43*c* as being apart from the male-side projection insertion hole 43*c* in the circumferential direction. The male-side end portion 29*a* is the diameter-reduced end portion of the one cylindrical pipe 29.

Further, in the present embodiment, the positioning guide rib 42 formed integrally with the sleeve-like member 39 as projecting from the inner surface of the sleeve-like member 39 inwardly projects from the inner circumferential surface of the female-side end portion 29*b* as being inserted to and engaged with a positioning engagement hole 44 formed at the female-side end portion 29*b* when the sleeve-like member 39 is attached to the female-side end portion 29*b*.

Figure 10A:
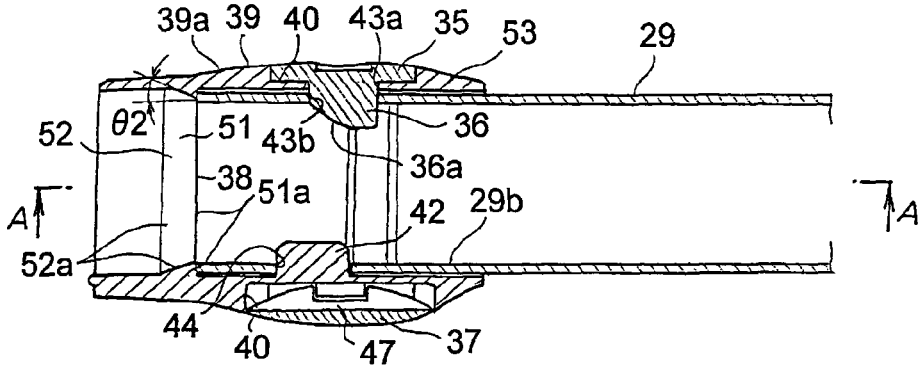
FIG. 10(*a*) is a longitudinal sectional view in a longitudinal direction illustrating a state that a sleeve-like member is attached to the female-side end portion.
Figure 10B:
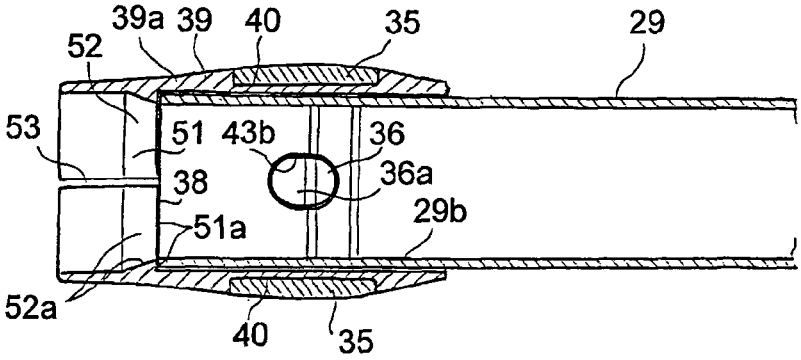

Further, as illustrated in FIGS. 8(*a*) to 8(*c*), 10(*a*) and 10(*b*), in the pipe joint structure 10, an abutment rib 51 which abuts to the end surface of the female-side end portion 29*b* from the back side is arranged at the sleeve-like member 39 continuously or discontinuously in the circumferential direction as inwardly projecting from the inner circumferential surface of a section covering the joint line portion 50. FIG. 8(*a*) and the like illustrate a case that the abutment rib 51 is arranged continuously in the circumferential direction as being circular-shaped with a cutout at a part in the circumferential direction. An insertion guide slope portion 52 extended as being sloped outwardly in the circumferential direction toward a top end side of the sleeve-like member 39 at the axially opposite side of the sleeve-like member 39 to an abutment surface 51*a* (refer to FIGS. 10(*a*) and 10(*b*)) with the female-side end portion 29*b* is arranged at the abutment rib 51 continuously or discontinuously in the circumferential direction. FIG. 8(*a*) and the like illustrate a case that the insertion guide slope portion 52 is arranged continuously in the circumferential direction. The male-side end portion 29*a* of the one cylindrical pipe 29 is inserted to the female-side end portion 29*b* as being guided by the insertion guide slope portion 52 as illustrated in FIGS. 8(*a*) to 8(*c*) in a state that the sleeve-like member 39 is attached to the female-side end portion 29*b* of the other cylindrical pipe 29 while the end surface of the female end portion is abutted to the abutment surface 51*a* of the abutment rib 51 as illustrated in FIGS. 10(*a*) and 10(*b*).

Further, in the present embodiment, the male-side end portion 29*a* is the diameter-reduced end portion of the one cylindrical pipe 29.

The handle body 28 is assembled so that the handle portion 16 including the holding portion 27 has length on the order of 100 to 150 cm as a whole, for example, to be suitable for performing cleaning operation by joining the plurality of cylindrical pipes 29 made of aluminum alloy or acrylonitrile butadiene styrene (ABS), for example, in the axial direction via the pipe joint structure 30. The lower end part of the handle body 28 is rotatably connected to the cleaning head 14 via the rotary joint portion 23 (refer to FIG. 1).

In the present embodiment, each pair of the cylindrical pipes 29, 29 among the plurality of cylindrical pipes 29 structuring the handle body 28 is integrally joined respectively in the axial direction via the joint portion having the pipe joint structure 30. That is, in the present embodiment, as illustrated in FIGS. 8(*a*) to 8(*c*), the diameter-reduced male-side end portion 29*a* of the one cylindrical pipe 29 is inserted to a pipe insertion opening 38 of the female-side end portion 29*b* of the other cylindrical pipe 29, the engaging projection 36 is inserted and engaged from the outside after the male-side projection insertion hole 43*c* and the female-side projection insertion hole 43*b* are matched, and the sleeve-like member 39 is attached as covering the joint line portion 50 between the male-side end portion 29*a* and the female-side end portion 29*b* from the outside. Thus, the joint portion is structured.

Figure 7:
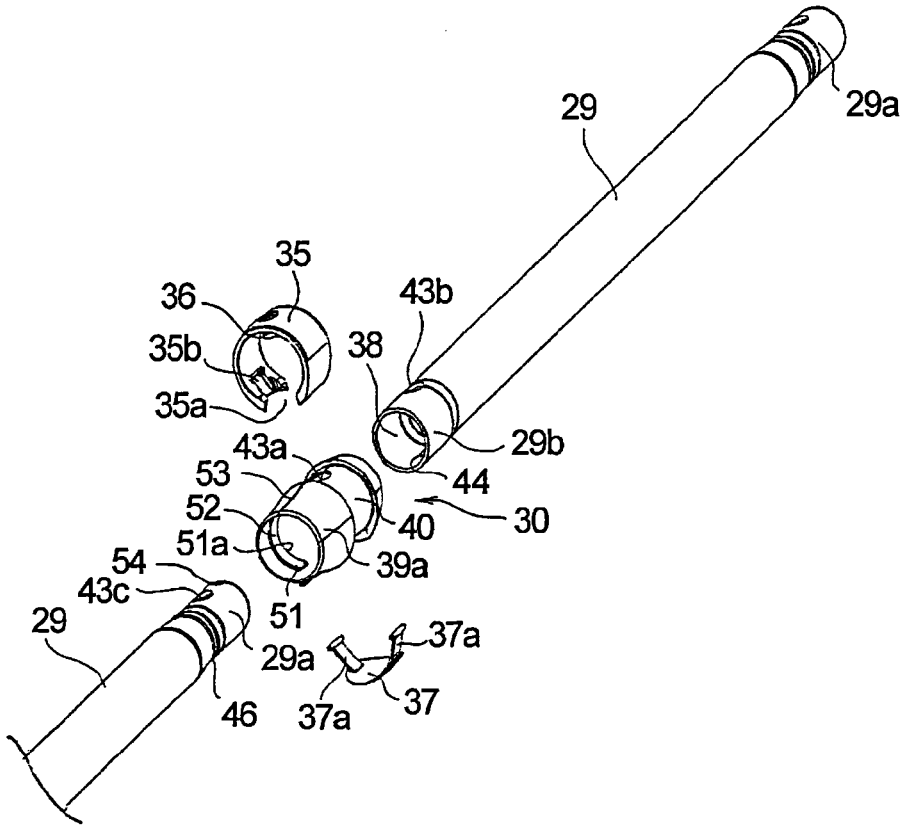
FIG. 7 is an exploded perspective view illustrating a joint portion of a rod portion of the handle portion.

In the present embodiment, as illustrated in FIG. 7 as well, the sleeve-like member 39 includes a sleeve body 39*a*, the cutout ring member 35 and the button member 37. As illustrated in FIGS. 9(*a*) to 9(*c*) as well, the sleeve-like member 39 is a hollow cylindrical member of which inner diameter is approximately the same as the outer diameter of the cylindrical pipe 29 and of which outer circumferential surface is shaped so that an axially-intermediate section is smoothly swelled as the axially-intermediate section between opening portions at both ends being formed thicker than sections at the vicinity of the opening portions. A circular zonal groove 40 extended in the circumferential direction is formed with a cutout having a zonal groove shape at the outer circumferential surface at the swelled axially-intermediate section of the sleeve-like member 39. As described later, the cutout ring member 35 and the button member 37 are attached to the circular zonal groove 40.

Further, a sleeve projection insertion hole 43*a* is formed as being opened at the circular zonal groove 40 of the sleeve body 39*a*. The engaging projection 36 arranged integrally with the cutout ring member 35 is inserted and attached to the sleeve projection insertion hole 43*a*. A cut 53 extended in the axial direction of the sleeve-like member 39 is formed to cross a center section of the sleeve projection insertion hole 43*a*. Owing to that the cut 53 is formed, the sleeve body 39*a* can be elastically deformed as being capable of increasing the diameter thereof. Accordingly, the sleeve body 39*a* can be attached to the female-side end portion 29*b* of the cylindrical pipe member 29.

Further, in the present embodiment, the circular abutment rib 51 is formed integrally with the sleeve body 39*a* as inwardly projecting from the inner circumferential surface of a section of the sleeve body 39*a* covering the joint line portion 50 between the male-side end portion 29*a* of the one cylindrical pipe 29 and the female-side end portion 29*b* of the other cylindrical pipe 29. The abutment rib 51 projects to the inner side (inner diameter side) slightly having the same height as the thickness of the end surface of the female-side end portion 29*b* of the other cylindrical pipe 29. The sleeve-like member 39 is attached to the female-side end portion 29*b* while the end surface of the female-side end portion 29*b* is abutted to the abutment surface 51*a* of the abutment rib 51 flatly-formed at the back end side of the sleeve body 39*a*.

In the present embodiment, the insertion guide slope portion 52 extended as being sloped outwardly in the circumferential direction toward the top end side of the sleeve-like member 39 from a section being axially opposite to the abutment surface 51*a* with the female-side end portion 29*b* is arranged at the abutment rib 51. In the present embodiment, the insertion guide slope portion 52 is arranged as a slope surface 52*a* being linearly sloped outwardly in the radial direction with a slope angle being preferably between 10° and 30° against the axial direction of the sleeve-like member 39.

Further, in the present embodiment, the positioning guide rib 42 is integrally arranged at the inner circumferential surface of the sleeve body 39*a* as projecting inwardly from a position at a radially opposite side to the sleeve projection insertion hole 43*a* (refer to FIGS. 8(*a*) to 8(*c*) and 10(*a*)). In the present embodiment, the positioning guide rib 42 is a plate-shaped rib having an approximately rectangular shape extended in the axial direction of the sleeve body 39*a*. The positioning guide rib 42 is inserted to and engaged with the positioning engagement hole 44 formed at the female-side end portion 29*b* when the sleeve body 39*a* is attached to the female-side end portion 29*b* of the other cylindrical pipe 29. Thus, the positioning guide rib 42 projects inwardly from the inner circumferential surface of the female-side end portion 29*b*.

In the present embodiment, the sleeve-like member 39 is formed by attaching the cutout ring member 35 and the button member 37 to the circular zonal groove 40 of the sleeve body 39*a* after the sleeve body 39*a* is attached to the female-side end portion 29*b* of the other cylindrical pipe 29. The sleeve body 39*a* is attached to the female-side end portion 29*b* while the positioning guide rib 42 is inserted to and engaged with the positioning engagement hole 44 formed at the female-side end portion 29*b* as being elastically deformed to increase the diameter with expansion of the cut 53. Further, with the above, the sleeve projection insertion hole 43*a* is placed to be matched to the female-side projection insertion hole 43*b* of the female-side end portion 29*b*.

As illustrated in FIG. 7, the cutout ring member 35 is a member being approximately-ring-shaped and zonal-plate-shaped having similar width to the circular zonal groove 40 of the sleeve body 39*a* as being formed with curvature to be arc-shape exceeding a half-round. The engaging projection 36 is arranged integrally therewith as inwardly projecting from the inner circumferential surface at a center section facing to the cutout portion 35*a*. Further, a leg-part engagement groove 35*b* is formed to be a cutout as being extended in the circumferential direction from the cutout portion 35*a* at the inner surface of a section continuing from the cutout portion 35*a* of the cutout ring member 35. The cutout ring member 35 is attached as being fitted from the outside to the circular zonal groove 40 of the sleeve body 39*a* in a state that the engaging projection 36 is inserted to and engaged with the sleeve projection insertion hole 43*a* of the sleeve body 39*a* and the female-side projection insertion hole 43*b* of the female-side end portion 29*b* which are matched while pushing out the cutout portion 35*a* with elastic deformation. With the above, the top end section of the engaging projection 36 is placed as inwardly projecting from the inner circumferential surface of the female-side end portion 29*b* of the other cylindrical pipe 29 in a state that a taper surface 36*a* formed at the top end section is oriented to the pipe insertion opening 38 side of the female-side end portion 29*b* (refer to FIGS. 8(*a*) and 9(*a*)).

Further, owing to pressing operation of the button member 37, the cutout ring member 35 becomes to function as an elastic portion which generates urging force inwardly in the radial direction as being deformed outwardly in the radial direction. Accordingly, the engaging projection 36 inwardly projects from the inner circumferential surface of the sleeve-like member 39 in a state that the engaging projection 36 integrated therewith is pressed from the outside.

The button member 37 being a plastic-made molded component having an oval plane shape of which outer circumferential surface is a gently-convexed curved surface (refer to FIG. 9(*c*)), for example, includes a pair of press leg portions 37*a* integrally extended from edge parts at both sides (refer to FIG. 7). The button member 37 is attached to cover the circular zonal groove 40 at the area of the cutout portion 35*a* in a state that clearance 47 is maintained against the circular zonal groove 40 while the press leg portions 37*a* are engaged respectively with the leg-part engagement grooves 35*b* at both sides sandwiching the cutout portion 35*a* of the cutout ring member 35 (refer to FIGS. 8(*a*) to 8(*c*) and 9(*a*)).

With the above, the sleeve-like member structured with the sleeve body 39*a*, the cutout ring member 35 and the button member 37 is attached to the female-side end portion 29*b* of the other cylindrical pipe 29 and the positioning guide rib 42 is arranged as inwardly projecting from the inner circumferential surface of the female-side end portion 29*b* in a state that the end surface of the female-side end portion 29*b* is abutted to the abutment surface 51*a* of the circular abutment rib 51.

As illustrated in FIGS. 7, 8(*a*) to 8(*c*), and 9(*a*) to 9(*c*), the male-side end portion 29*a* of the one pipe member 29 to be joined to the female-side end portion 29*b* of the other cylindrical pipe 29 is formed in a state of being diameter-reduced so as to have an outer diameter to be capable of being inserted to the pipe insertion opening 38 of the female-side end portion 29*b*. The male-side projection insertion hole 43*c* capable of being matched to the female-side projection insertion hole 43*b* of the female-side end portion 29*b* and the sleeve projection insertion hole 43*a* of the sleeve body 39*a* is opened and formed at the male-side end portion 29*a*. Further, a guide concave portion 54 being a running-over start part when the taper surface 36*a* of the engaging projection 36 runs over the outer circumferential surface of the male-side end portion 29*a* toward the male-side projection insertion hole 43*c* is arranged at the top edge part of the male-side end portion 29*a* at a section axially adjacent to the male-side projection insertion hole 43*c* by denting the top edge part to be a concave shape without reaching the male-side projection insertion hole 43*c*.

Further, the guide groove 45 linearly extended in the axial direction from the top edge part of the male-side end portion 29*a* as being placed at the radially opposite side to the male-side projection insertion hole 43*c* is formed at the male-side end portion 29*a* by forming a cutout at the male-side end portion 29*a* or denting the outer circumferential surface like a groove shape. The guide groove 45 is arranged from the top edge part of the male-side end portion 29*a* without reaching a base end portion 46 of the diameter-reduced male-side end portion 29*a* with width being slightly wider than the positioning guide rib 42 so that the positioning guide rib 42 of the female-side end portion 29*b* can be guided as being slidably engaged therewith.

Further, in the present embodiment, as described above, the abutment rib 51 projecting inwardly is circularly arranged at the inner circumferential surface at a position deviated to the top end side in the axially-intermediate section between opening parts of both sides as the section to cover the joint line portion 50 between the male-side end portion 29*a* and the female-side end portion 29*b*. The abutment rib 51 inwardly projects from the inner circumferential surface of the sleeve body 39*a* preferably having approximately the same height as the thickness of the end surface of the female-side end portion 29*b* of the other cylindrical pipe 29. The end surface of the female-side end portion 29*b* is abutted to the abutment surface 51*a* of the abutment rib 51 flatly-formed at the back end side of the sleeve body 39*a* (refer to FIGS. 10(*a*) and 10(*b*)). Here, the abutment rib 51 is not necessarily required to be arranged continuously in the circumferential direction along the entire circumference of the inner circumferential surface of the sleeve body 39*a*. The abutment rib 51 may be arranged with a cutout partly in the circumferential direction or may be arranged discontinuously in the circumferential direction. In the present embodiment, the abutment rib 51 is arranged circularly with a cutout partly in the circumferential direction in the light of easiness of molding the sleeve body 39*a* with synthetic resin, and the like (refer to FIGS. 7 and 8(*a*)).

In the present embodiment, the insertion guide slope portion 52 is arranged at the abutment rib 51 extended as being sloped outwardly in the circumferential direction toward the top end side of the sleeve-like member 39. In the present embodiment, the insertion guide slope portion 52 is arranged along the entire length in the circumferential direction of the abutment rib 51 having a cutout partly while the slope surface 52*a* is linearly sloped outwardly in the radial direction with a slope angle $\eta 2$ (refer to FIG. 10(*a*)) being preferably between 10° and 30° against the axial direction of the sleeve-like member 39.

Figure 11:
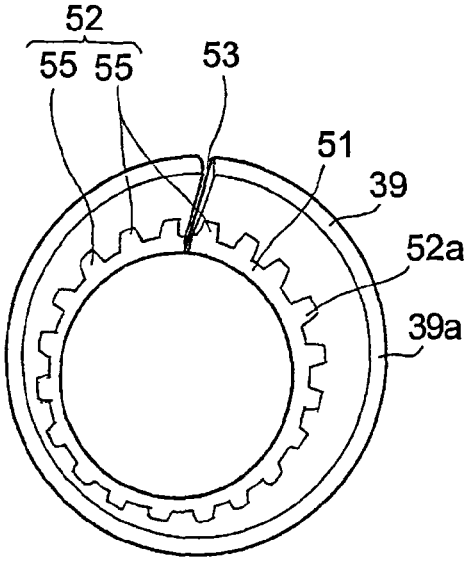
FIG. 11 is a perspective view illustrating another embodiment of the insertion guide slope portion viewing the inside of a sleeve-like member from the top end side.

Here, not necessarily required to be arranged continuously along the entire length of the abutment rib 51, the insertion guide slope portion 52 may be formed discontinuously in the circumferential direction as well. For example, as illustrated in FIG. 11, it is also possible that the insertion guide slope portion 52 is structured with a plurality of taper ribs 55 respectively having a taper surface as being arranged at predetermined intervals in the circumferential direction. It is preferable that the insertion guide slope portion 52 is arranged to be capable of covering at least three positions in the radial direction having the center axis of the sleeve-like member 39 as the center. Further, not necessarily required to be linearly sloped, the slope surface 52*a* of the insertion guide slope portion 52 to the outside in the radial direction may be also a slope surface sloped as being curved, for example.

For joining a pair of the cylindrical pipes 29, 29 in the present embodiment, the male-side end portion 29*a* of the one cylindrical pipe 29 is inserted to the pipe insertion opening 38 of the female-side end portion 29*b* of the other cylindrical pipe 29 to which the sleeve-like member 39 is attached, as illustrated in FIG. 8(*a*). Owing to that the guide groove 45 which is arranged at the male-side end portion 29*a* as being extended in the axial direction is guided as being engaged with the positioning guide rib 42 which projects from the inner surface of the female-side end portion 29*b* as illustrated in FIG. 8(*b*), such inserting operation can be smoothly performed in a stable state while positioning is performed.

Further, in the present embodiment, as illustrated in FIGS. 9(*a*) and 9(*c*), a marking portion 56 which indicates a position where the positioning guide rib 42 projects is arranged at a position of the outer circumferential surface of the sleeve-like member 39 circumferentially corresponding to the positioning guide rib 42 at the inner circumferential surface. When the male-side end portion 29*a* is to be inserted to the female-side end portion 29*b* while performing alignment of the guide groove 45 with the marking portion 56, the guide groove can be easily engaged with the positioning guide rib 42. Accordingly, inserting operation until the male-side projection insertion hole 43*c* is matched to the female-side projection insertion hole 43*b* and the sleeve projection insertion hole 43*a* can be performed more smoothly.

After the male-side end portion 29*a* is inserted until the top edge part of the male-side end portion 29*a* is abutted to the taper surface 36*a* of the engaging projection 36 which projects from the inner surface of the female-side end portion 29*b* (refer to FIG. 8(*b*)), the male-side end portion 29*a* is to be further inserted. Accordingly, owing to that the taper surface 36*a* of the engaging projection 36 runs over the outer circumferential surface of the male-side end portion 29*a* via the guide concave portion 54 at the top edge part of the male-side end portion 29*a*, the cutout ring member 35 is increased in diameter and the engaging projection 36 is pushed up.

When the male-side end portion 29*a* is inserted until the male-side projection insertion hole 43*c* of the male-side end portion 29*a* is matched to the female-side projection insertion hole 43*b* of the female-side end portion 29*b* and the sleeve projection insertion hole 43*a* of the sleeve body 39*a* as illustrated in FIG. 8(*c*), the engaging projection 36 is depressed with inward urging force of the cutout ring member 35 which is in a diameter-increased state. Owing to the depression of the engaging projection 36, the engaging projection 36 is locked and engaged concurrently with the male-side projection insertion hole 43*c* of the male-side end portion 29*a*, the female-side projection insertion hole 43*b* of the female-side end portion 29*b* and the sleeve projection insertion hole 43*a* of the sleeve body 39*a* in a state of lying astride the matched projection insertion holes 43*a*, 43*b*, 43*c*. Thus, the joint portion of the pair of cylindrical pipes 29, 29 is formed with the overlapped male-side end portion 29*a* and female-side end portion 29*b*.

In the present embodiment, in a state that the engaging projection 36 is engaged concurrently with the respective projection insertion holes 43*a*, 43*b*, 43*c* as illustrated in FIG. 8(*c*), the base end portion 46 of the diameter-reduced male-side end portion 29*a* is abutted to the opening circumferential portion of the pipe insertion opening 38 of the female-side end portion 29*b* at the joint line portion 50. Accordingly, owing to that the opening circumferential portion of the pipe insertion opening 38 of the female-side end portion 29*b* is supported by the base end portion 46, the pair of cylindrical pipes 29, 29 can be joined in a further stable state.

Figure 12:
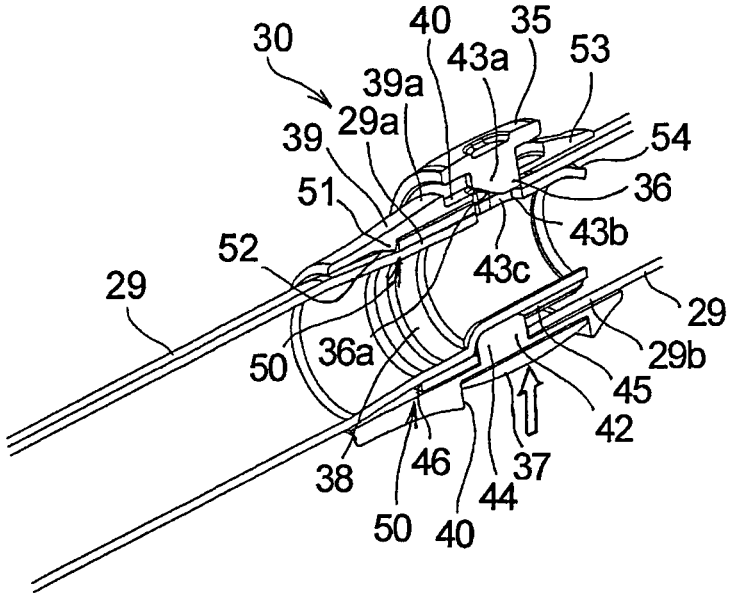
FIG. 12 is a broken perspective view illustrating a situation to release joining between the pipe members which structure the rod portion of the handle.

Further, in the present embodiment, for releasing the joined state of the pair of cylindrical pipes 29, 29 joined by the joint portion with the pipe joint structure 30, the button member 37 is pressed to reduce clearance 47 against the circular zonal groove 40 (refer to FIGS. 8(*a*) to 8(*c*)) as illustrated in FIG. 12. Owing to pressing of the button member 37, the cutout ring member 35 is pushed out outwardly along the outer circumferential surface of the circular zonal groove 40 as expanding the cutout portion 35*a* with pressing force via the press leg portions 37*a* which are engaged with the leg-part engagement grooves 35*b* (refer to FIG. 6). Since the cutout ring member 35 is pressed outwardly, the engaging projection 36 is disengaged at least from the male-side projection insertion hole 43*c* of the male-side end portion 29*a*. In this state, it is possible to easily release the joined state of the pair of cylindrical pipes 29, 29 by pulling out the male-side end portion 29*a* from the female-side end portion 29*b*.

According to the cleaning device 10 of the present embodiment having the above structure, cleaning of a surface to be cleaned can be effectively performed while having solid matters such as dust, hair and dirt stuck to a wide range of area of the cleaning sheet 13 which is attached as covering the cleaning surface 12 of the cleaning device body 11.

That is, according to the present embodiment, the lower face of the base body 15 structuring the cleaning device body 11 includes the wave-like corrugated surface portion 19 in which the ridge portions 17 and the valley portions 18 are continuously arranged. The valley portions 18 of the wave-like corrugated surface portion 19 are provided with the oblique guide portions (oblique valley portions) 18*a* of which end parts are opened to the long side portion 15*a* facing to the predetermined direction X in which cleaning is performed with the cleaning device body 11 as being extended obliquely against the predetermined direction X. Preferably, the ridge portions 17 of the wave-like corrugated surface portion 19 are provided with the plurality of projection ribs 20 projecting from the crest portions 17*a* at intervals in the extending direction of the crest portions 17*a*.

Accordingly, when the cleaning sheet 13 is attached as covering the cleaning surface 12 and the surface to be cleaned such as a floor surface is wiped as moving the cleaning device body 11 in the predetermined direction X while pressing force is applied to the handle portion 16, solid matters such as dust, hair and dirt existing on the surface to be cleaned are taken to the lower side of the cleaning surface 12 from sections of the cleaning sheet 13 contacted to the end parts of the valley portions 18 opened to the long side portion 15*a*. The taken solid matters such as dust becomes capable to be guided by the oblique guide portions (oblique valley portions) 18*a* along the surface of the cleaning sheet 13. A part of the obliquely guided solid matters such as dust is moved toward the ridge portions 17 as being separated from sections of the cleaning sheet 13 contacted to the oblique guide portions (oblique valley portion) 18*a* and is fed toward the adjacent valley portions 18 along the surface of the cleaning sheet 13 via sections of the cleaning sheet 13 contacted to clearance between the projection ribs 20 arranged at the crest portions 17*a* of the ridge portions 17 or as being hit to sections of the cleaning sheet 13 contacted to the projection ribs 20. Thus, solid matters are to be spread to the entire cleaning sheet 13. Further, hair and solid matters in close contact with the surface to be cleaned are trapped and stuck to the cleaning sheet 13 as being scraped by the projection ribs 20. With the above, solid matters such as dust, hair and dirt are to be stuck effectively to a wide range of area of the cleaning sheet 13 as objects to be stuck.

Further, according to the cleaning device 10 of the present embodiment, since the abovementioned pipe joint structure 30 is provided, each pair of the cylindrical pipes 29, 29 structuring the handle 16 being the handle portion can be joined more smoothly and the engaging projection 36 can be prevented from being easily detached from male-side projection insertion hole 43*c* during usage of the cleaning device 10.

That is, according to the present embodiment, since the pipe joint structure 30 is structured as including the positioning guide rib 42 which inwardly projects from the inner circumferential surface of the female-side end portion 29*b* and the guide groove 45 which is axially extended from the top edge part of the male-side end portion 29*a*, each pair of the cylindrical pipes 29, 29 can be smoothly joined in a more stable state by inserting the male-side end portion 29*a* to the female-side end portion 29*b* until the male-side projection insertion hole 43*c* is matched to the female-side projection insertion hole 43*b* while the positioning guide rib 42 of the female-side end portion 29*b* is guided as being engaged with the guide groove 45 of the male-side end portion 29*a*.

Further, since the positioning guide rib 42 is arranged integrally with the sleeve body 39*a*, the positioning guide rib 42 remains projecting inwardly from the inner circumferential surface of the female-side end portion 29*b* even when each pair of the cylindrical pipes 29, 29 is joined while pressing the button member 37. Therefore, the positioning guide rib 42 cannot be locked and engaged with a section other than the guide groove 34 of the male-side end portion 29*a* by mistake. Accordingly, the male-side end portion 29*a* can be inserted to the female-side end portion 29*b* until the male-side projection insertion hole 43*c* is matched to the female-side projection insertion hole 43*b* while the positioning guide rib 42 of the female-side end portion 29*b* is guided as being engaged with the guide groove 45 of the male-side end portion 29*a* and the engaging projection 36 can be reliably engaged and locked with the respective projection insertion holes 43*a*, 43*b*, 43*c*. Accordingly, it is possible to prevent trouble occurrence such that some pipe is disjoined when a cleaning device is used by a user with a faulty joint structure of locking and engaging of the engaging projection 36 with the male-side projection insertion hole 43*c* and the like.

Further, since the positioning guide rib 42 and the guide groove 45 which guide insertion of the male-side end portion 29*a* to the female-side end portion 29*b* are arranged at sections being opposite to the respective project insertion holes 43*a*, 43*b*, 43*c* in the radial direction as being apart therefrom, a groove for projection guiding continued to the opening circumferential portion as in a traditional joint structure is not required to be arranged at the opening circumferential portion of the male-side projection insertion hole 43*c* of the male-side end portion 29*a*. Accordingly, compared with the traditional joint structure in which a stepped section due to a cutout to be continued to a groove for projection guiding is formed at an opening circumferential portion of a male-side projection insertion hole by the groove for projection guiding continued to the male-side projection insertion hole having less engaging height between an engaging projection and the male-side projection insertion hole, the stepped section due to the cutout is removed from the opening circumferential portion of the male-side projection insertion hole 43*c*. Accordingly, it is possible to effectively prevent the engaging projection 36 from being easily detached from the male-side projection insertion hole 43*c* via such a stepped section. In addition, it is possible to prevent a trouble of an incorrect joint structure as guiding the positioning guide rib 42 to a groove for projection guiding.

Figure 13A:
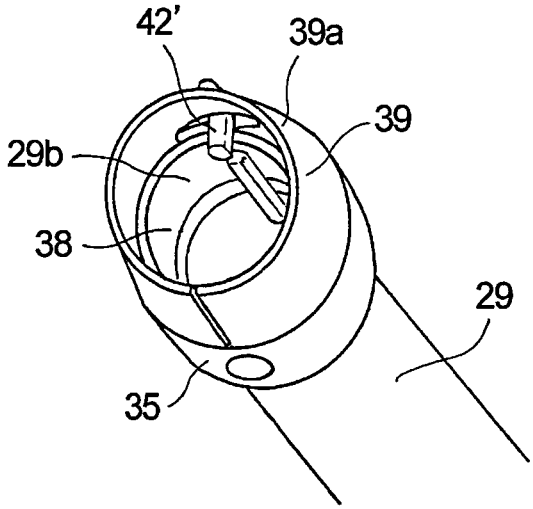
FIG. 13(*a*) is a perspective view of a female-side end portion illustrating another pipe joint structure.
Figure 13B:
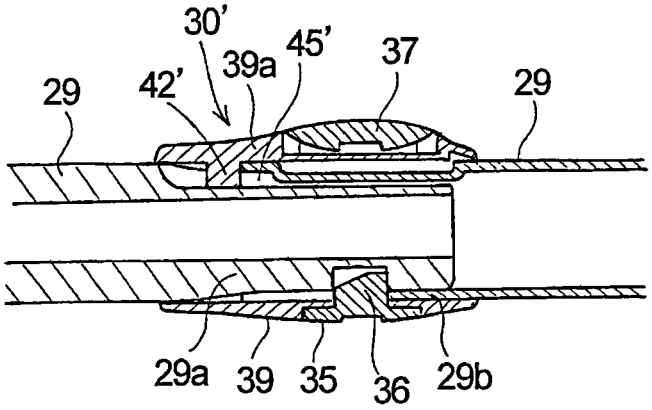

FIGS. 13(*a*) and 13(*b*) illustrate a pipe joint structure 30' according to another embodiment of the present invention. The pipe joint structure 30' illustrated in FIGS. 13(*a*) and 13(*b*), has an approximately similar structure to the pipe joint structure 30 of the above embodiment. Here, a positioning guide rib 42' inwardly projecting from the inner circumferential surface of the female-side end portion 29*b* is not inserted to and engaged with the positioning engagement hole 44 which is formed at the female-side end portion 29*b* but is arranged as a section integrally projecting from the inner circumferential surface of the sleeve-like member 39 as being placed at the outside of the opening circumferential portion of the pipe insertion opening 38 of the female-side end portion 29*b*.

According to the pipe joint structure 30' as well illustrated in FIGS. 13(*a*) and 13(*b*), similar function effects to the pipe joint structure 30 of the above embodiment are obtained by inserting the male-side end portion 29*a* to the female-side end portion 29*b* until the male-side projection insertion hole 43*c* is matched to the female-side projection insertion hole 43*b* while the positioning guide rib 42' of the female-side end portion 29*b* is guided as being engaged with a guide groove 45' of the male-side end portion 29*a*.

Further, according to the present embodiment, the abutment rib 51 is arranged at the sleeve-like member 39 which structures the pipe joint structure 30 as inwardly projecting from the inner circumferential surface of a section covering the joint line portion 50 between the male-side end portion 29*a* and the female-side end portion 29*b*. The insertion guide slope portion 52 extended as being sloped outwardly in the radial direction toward a top end side of the sleeve-like member 39. Accordingly, it is possible to effectively avoid difficulty of joining due to interference between the end surface of the male-side end portion 29*a* and the end surface of the female-side end portion 29*b* by correcting positional misalignment of center axes even in a case that the male-side end portion 29*a* of one end cylindrical pipe 29 is to be inserted to the female-side end portion 29*b* of the other cylindrical pipe 29 when the male-side end portion 29*a* of the one cylindrical pipe 29 is to be inserted to the female-side end portion 29*b* of the other cylindrical pipe 29 to which the sleeve-like member 39 is attached. Thus, each pair of the cylindrical pipes 29, 29 can be joined more smoothly.

Further, in the present embodiment, the sleeve-like member 39 is attached to the female-side end portion 29*b* of the other cylindrical pipe 29 in a state that the end surface thereof is abutted to the abutment surface 51*a* of the abutment rib 51 which inwardly projects from the inner circumferential surface thereof. Accordingly, even in a case that impact force is applied to the sleeve-like member 39 as a result of collision of any end surface of the cylindrical pipe 29 with a floor when the other cylindrical pipe 29 is dropped to the floor, for example, before the male-side end portion 29*a* of the one cylindrical pipe 29 is inserted and joined, it is possible to effectively avoid cracking and breakage of the engaging projection 36 of the sleeve-like member 39 which is inserted and attached to the female-side projection insertion hole 43*b* and the positioning guide rib 42 which inwardly projects from the inner circumferential surface of the female-side end portion 29*b* as such impact force is supported by the abutment surface 51*a*.

Here, the positioning guide rib 42 and the guide groove 45 may not be arranged at sections being opposite to the female-side projection insertion hole 43*b* and the male-side projection insertion hole 43*c* in the radial direction as long as being sections apart therefrom in the circumferential direction. Further, the male-side end portion is not necessarily required to be a diameter-reduced end part of a cylindrical pipe and the sleeve-like member is not necessarily required to include a sleeve body, a cutout ring member and a button member. Further, it is not necessarily required to arrange the guide concave portion 54 at a top edge part of the male-side end portion 29*a*. Furthermore, not being necessarily required to be arranged integrally with the inner surface of the sleeve-like member, the positioning guide rib may be arranged integrally with the inner surface of the female-side end portion.

Figure 14:
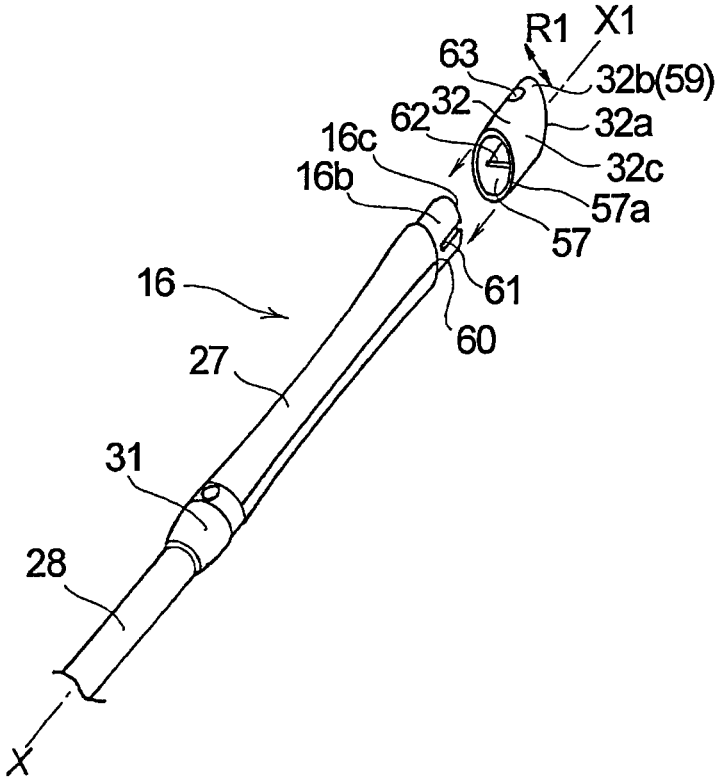
FIG. 14 is an exploded perspective view illustrating a main part of a handle with an end cap.
Figure 15A:
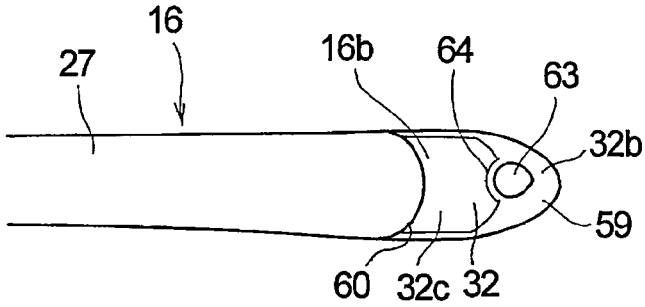
FIG. 15(*a*) is a front view illustrating a main part of the handle with the end cap.
Figure 15B:
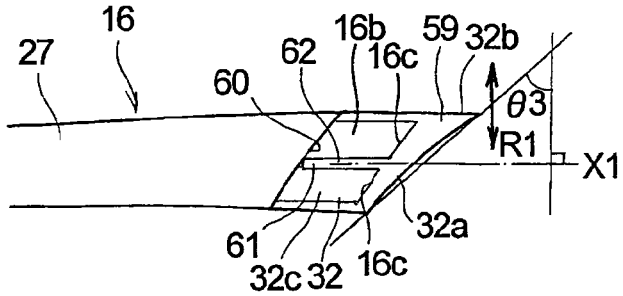
Figure 15C:
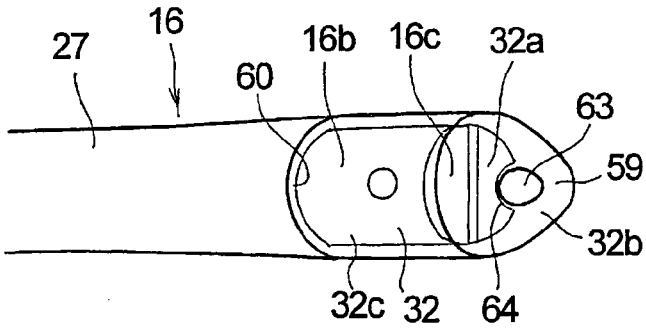
Figure 15D:
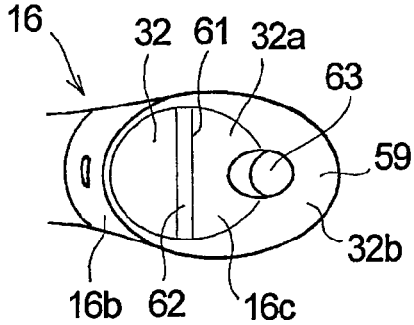

Further, in the present embodiment, an end cap 32 is attached to the upper end part 16*b* of the handle 16 as an antislip end member. Preferably, the end cap 32 is made of elastic material of which Rubber Hardness is in a range between 40 and 80. As illustrated in FIGS. 14 and 15(*a*) to 15(*d*), the end cap 32 is attached to the upper end part 16*b* of the handle 16 by fitting the upper end part 16*b* of the handle 16 to an attachment hole 57. Further, in the end cap 32, a cover end surface 32*a* arranged to cover an end surface portion 16*c* of the handle 16 is formed as an oblique surface with cutting, molding or the like as being oblique against a perpendicular face to the center axis direction X1 of the handle 16. Accordingly, a taper-shaped top edge section 32*b* of the end cap 32 forms a cushion portion 59 capable of being elastically deformed inwardly and outwardly in the radial direction R1 as having the center axis direction X1 of the handle 16 as the center. In the light of easiness of elastic deformation, it is preferable that the top end of the end surface portion 16*c* of the handle 16 does not reach the top edge section 32*b* of the end cap 32 and the cushion portion 59 projects further to the top end side from an upper end portion 16*b* of the handle 16 (refer to FIG. 15(*b*)). In the present embodiment, attaching of the end cap denotes integrating of the handle with the end cap by insert molding in addition to integrating of the handle with the end cap by hand or machine.

Here, Rubber Hardness denotes a value measured by durometer type A (shore A) which is defined in JIS K 6253.

In the present embodiment, the handle 16 to which the end cap 32 is attached includes an elongated rod-shaped handle body 28 and a holding portion 27 which is integrally joined and fixed to an upper part of the handle body 28. The handle 16 is joined to the cleaning device body 11 having the lower end part of the handle body 28 as a lower end part 16*a* of the handle 16 (refer to FIG. 16(*a*)) and the end cap 32 is attached to the handle 16 having the upper end part of the holding portion 27 as the upper end part 16*b* of the handle 16.

The holding portion 27 being a molding component made of acrylonitrile butadiene styrene (ABS) resin or polypropylene (PP) resin, for example, which is not elastically deformed in a substantial way has an appropriately cylindrical shape of which diameter and outline are suitable for holding by hand, as illustrated in FIG. 14. The upper end part 16*b* of the holding portion 27 (handle 16) has a sectional shape of which diameter is smaller than that of the holding portion 27 as interposing a circular stepped portion 60 chamfered obliquely against a face perpendicular to the center axis direction X1 of the handle 16. Owing to that the end cap 32 is attached as covering the diameter-reduced upper end part 16*b*, an outer circumferential surface of a circumferential wall portion 32*c* of the end cap 32 becomes to a surface continued to an outer circumferential surface of the holding portion 27.

In the present embodiment, the end surface portion 16*c* of the upper end part 16*b* of the holding portion 27 (handle 16) is formed as an oblique surface by performing cutting, molding or the like obliquely at a larger angle than an oblique angle θ3 of the cover end surface 32*a* of the end cap 32 against the face perpendicular to the center axis direction X1 of the handle 16 (refer to FIG. 15(*b*)). Further, an engagement cut 61 is formed at the diameter-reduced upper end part 16*b* of the holding portion 27 (handle 16) with cutting from the end surface portion 16*c* to the lower end part 16*a* side of the handle 16. For attaching the end cap 32, engagement is performed as inserting an engaging piece 62 arranged inside the attachment hole 57 of the end cap 32 to the engagement cut 61 (alternatively, the end cap 32 may be attached by sandwiching the engaging piece 52 with halved holding portion 27 with a structure that the holding portion 27 is halved in the axial direction). Further, an arc-shaped cutout 64 is formed at the top edge part of the end surface portion 16*c* of the holding portion 27 (handle 16) to avoid interference with a hanging hole 63 formed at the end cap 32 when the end cap 32 is attached (refer to FIGS. 15(*a*) and 15(*c*)).

As illustrated in FIGS. 15(*a*) to 15(*d*) as well, the end cap 32 attached to the upper end part 16*b* of the holding portion 27 (handle 16) is an elastic member made of various transparent, semi-transparent or opaque material preferably such as elastomer being styrene elastomer and the like, ethylene-vinyl acetate (EVA) resin, natural rubber, and synthetic rubber as relatively soft elastic material of which Rubber Hardness is in a range between 40 and 80. In the present embodiment, ethylene-vinyl acetate (EVA) resin is adopted. The end cap 32 has an approximately cylindrical shape having both end surfaces cut obliquely, for example. One end surface is an opening surface at which the attachment hole 57 is opened and the other end surface is the cover end surface 32*a* which covers the end surface portion 16*c* of the upper end part 16*b* of the holding portion 27 (handle 16).

The engaging piece 62 is arranged at the hollow inside of the attachment hole 57 of the end cap 32 across a sectional center portion in the radial direction. The engaging piece 62 is inserted to the engagement cut 61 formed at the diameter-reduced upper end part 16*b* of the holding portion 27 (handle 16) when the end cap 32 is attached. With the above, the attaching state of the end cap 32 can be maintained more strongly.

The hanging hole 63 is formed at the taper-shaped top edge section 32*b* of the cover end surface 32*a* of the end cap 32 as penetrating the top edge section 32*b*. Owing to that the hanging hole 63 is formed, it is possible to store the cleaning device 10 in a state of being hanged to a hook member attached to a wall surface 65, for example. Further, owing to that the hanging hole 64 is formed at the top edge section 32*b* of the end cap 32 and the arc-shaped cutout 64 is formed at the top edge part of the end surface portion 16*c* of the holding portion 27 (handle 16), it is possible to improve a function of the taper-shaped top edge section 32*b* of the cover end surface 32*a* of the end cap 32 as the cushion portion 59 capable of being elastically deformed inwardly and outwardly in the radial direction R1.

Here, an opening circumferential portion 57*a* formed by obliquely cutting the attachment hole 57 of the end cap 32 is shaped along a shape of the obliquely-chamfered circular stepped portion 60 of the upper end part 16*b* of the holding portion 27 (handle 16). Accordingly, the end cap 32 can be attached to the upper end part 16*b* of the holding portion 27 (handle 16) continuously without clearance.

Here, it is preferable that the oblique angle θ3 of the oblique surface being a cut surface of the cover end surface 32*a* of the end cap 32 as being obliquely cut, for example, is in an angle range between 30° and 60° against the perpendicular face to the center axis direction X1 of the handle 16. Owing to that the oblique angle θ3 of the oblique surface of the cover end surface 32*a* against the perpendicular face to the center axis direction X1 is in the range between 30° and 60°, the function as the cushion portion 59 can be performed without unnecessary prolongation of the end cap 32. In addition, operability of the cleaning device 10 can be improved when performing cleaning operation with the cleaning device 10 as the end cap 32 becomes more likely to be intimately contacted to a palm.

Further, it is preferable that the oblique surface being the cut surface of the cover end surface 32*a* of the end cap 32 as being obliquely cut, for example, is a curved surface as the cut surface (oblique surface) of the cover end surface 32*a* being curved in a concaved manner. Owing to that the cut surface (oblique surface) of the cover end surface 32*a* is the curved surface curved in the concaved manner, operability of the cleaning device 10 can be remarkably improved when performing cleaning operation with the cleaning device 10 as the end cap 32 becomes more likely to be intimately contacted to a palm.

According to the present embodiment, the handle 16 with the end cap 32 can be easily obtained to integrally join the end cap 32 to the handle 16 by attaching the abovementioned end cap 32 as fitting the upper end part 16*b* of the handle 16 (holding portion 27) to the attachment hole 57 while the engaging piece 62 is inserted to the engagement cut 61.

According to the abovementioned end-cap equipped handle 16, it is possible to effectively improve stability when the handle 16 of the cleaning device 10 is propped to the wall surface 65.

Figure 16A:
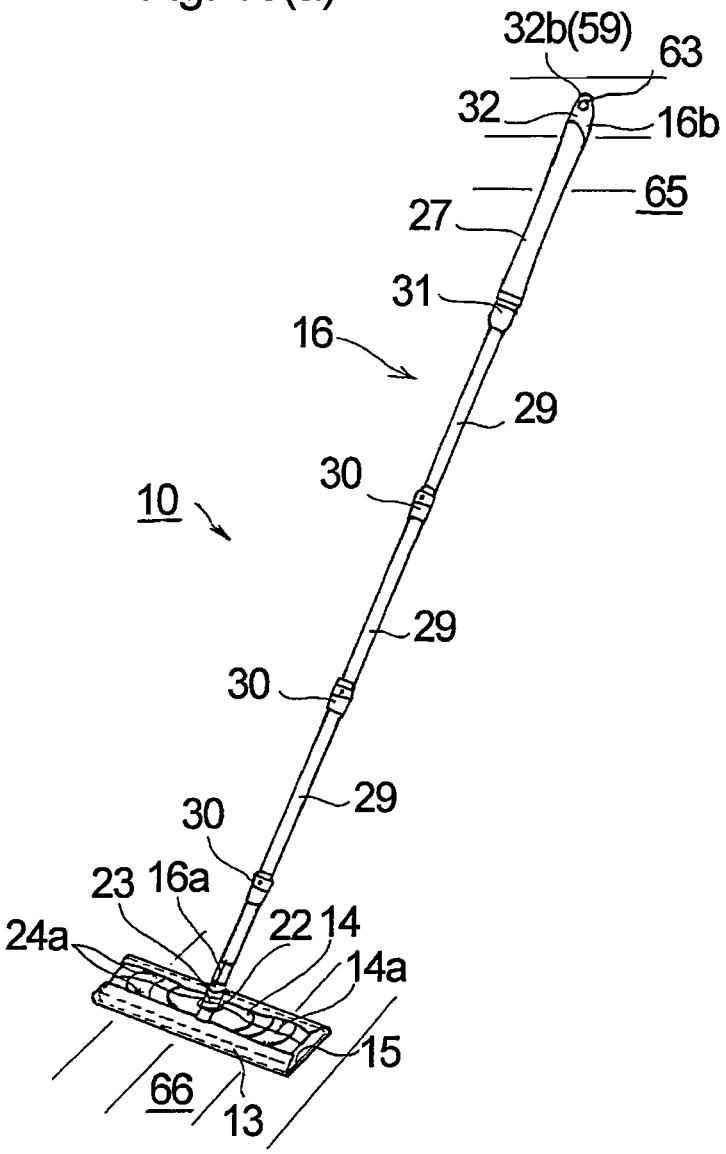
FIG. 16(*a*) is a perspective view illustrating a cleaning device which includes the handle with the end cap.
Figure 16B:
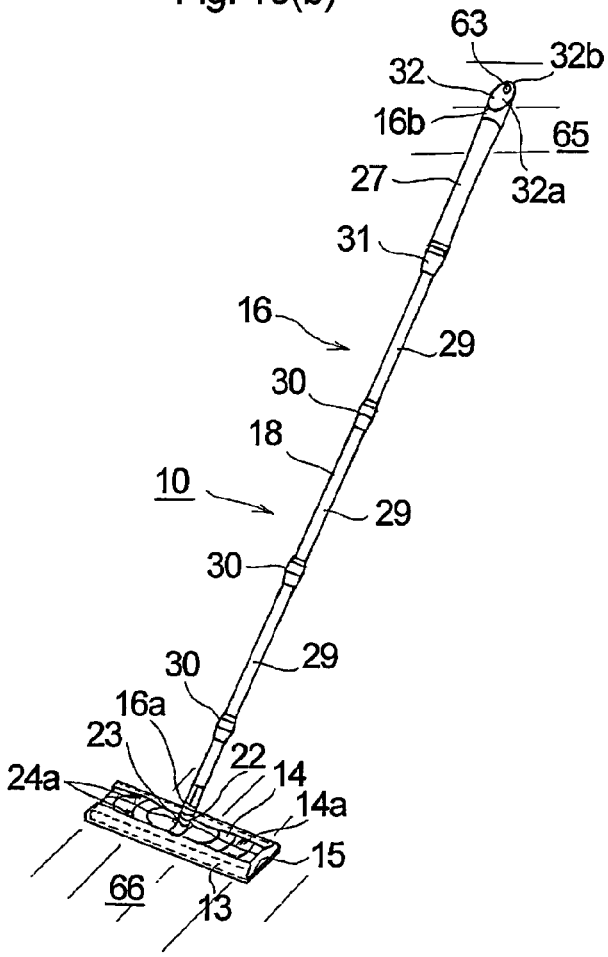

That is, according to the present embodiment, the end cap 32 attached to the upper end part 16*b* of the handle 16 is made of elastic material of which Rubber Hardness is preferably in the range between 40 and 80 and the cover end surface 32*a* arranged to cover the end surface portion 16*c* of the handle 16 is the oblique surface with cutting and the like obliquely against the surface perpendicular to the center axis direction X1 of the handle 16. Accordingly, for example, in a case of propping as the cover end surface 32*a* being faced to the wall surface 65 as illustrated in FIG. 16(*a*) or propping as the cover end surface 32*a* being opposed to the wall surface 65 as illustrated in FIG. 16(*b*), appropriate frictional force can be generated against the wall surface 65 owing to that the taper-shaped top edge section 32*b* of the end cap 32 which forms the cushion portion 59 as further projecting to the top end side from the upper end part 16*b* of the handle 16 (holding portion 27) is abutted to the wall surface 65 while being elastically deformed appropriately in the radial direction R1. With the above, stability can be effectively improved by preventing the propped handle 16 from easily falling. Further, combining of the handle 16 being substantially elastically undeformable and the end cap 32 made of elastic material attached to the upper end part 16*b* thereof contributes to effective improvement of the stability when the handle 16 is propped.

Further, since the end cap 32 attached to the upper end part 16*b* of the handle 16 has appropriate elasticity and includes the cover end surface 32*a* being the oblique surface with oblique cutting and the like, the end cap 32 is more likely to fit to a palm to hold the upper end part 16*b* of the handle 16. Accordingly, since pushing and pulling of the handle 16 can be easily performed in a state of softly grasping the end cap 32 without strongly grasping the handle 16, operability of the cleaning device 10 with sliding of the cleaning device body 11 along a floor surface 66 can be effectively improved.

Here, it is not necessarily required that the handle to which the end cap 32 is attached includes the handle body and the holding portion which may be capable of being assembled and disassembled. It is also possible to adopt a handle in which a handle body and a holding portion are integrated or a handle which does not particularly include a holding portion. Further, as the cleaning device body to which a handle is joined, cleaning device bodies in various types can be adopted as well as the type to attach a cleaning sheet to be replaceable in a detachably attachable manner.

Figure 17:
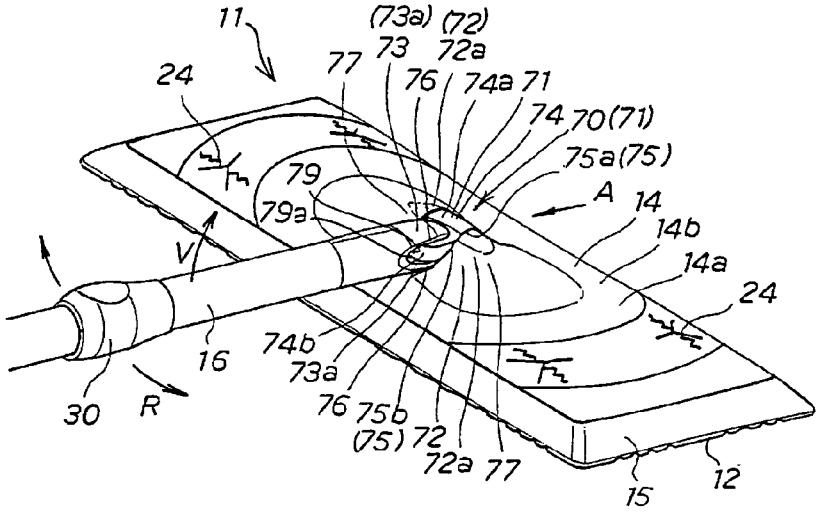
FIG. 17 is a perspective view of a main part illustrating a joint structure of a cleaning head.
Figure 18:
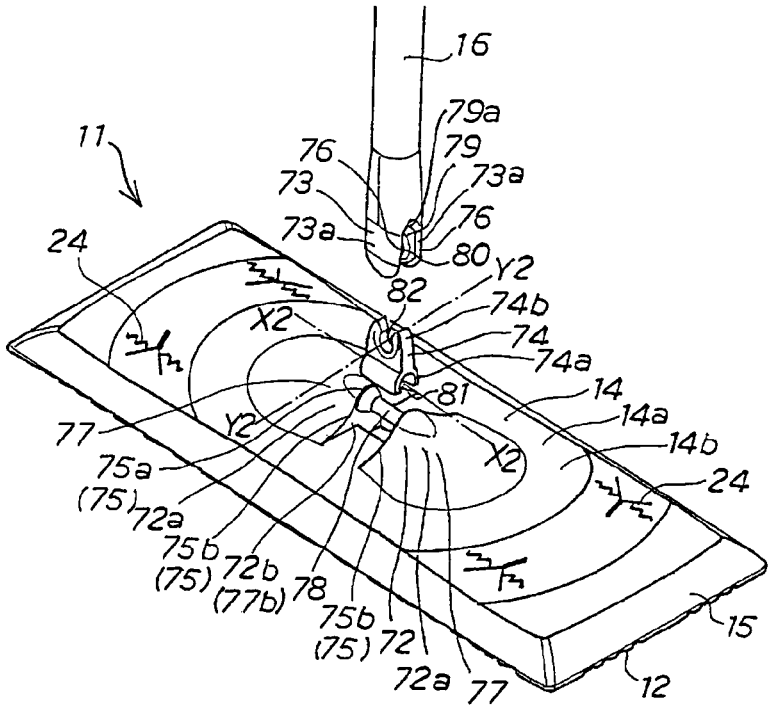
FIG. 18 is an exploded perspective view of a main part illustrating the joint structure of the cleaning head.
Figure 19:
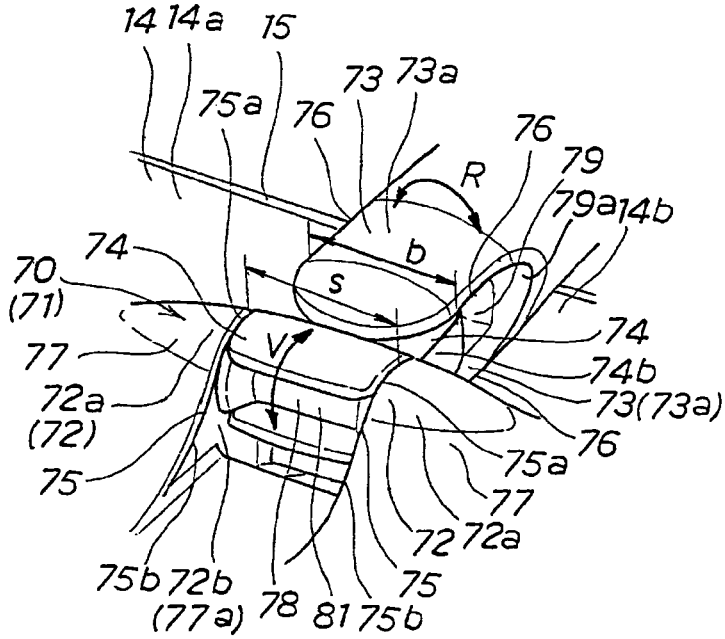
FIG. 19 is an enlarged perspective view of a main part illustrating the joint structure of the cleaning head viewing from direction A of FIG. 17.

The cleaning device 10 of the present embodiment has a joint structure 70 to rotatably join the handle 16 being the handle portion to the cleaning head 14. In the cleaning device 10 including the cleaning head 14 and the handle 16, the joint structure 70 of the cleaning head 14 is a joint structure to enable the handle 16 to perform 360-degree rotation in the circumferential direction about a joint portion 71 in a state that the handle 16 is arranged approximately in parallel to the cleaning head 14, as illustrated in FIG. 17. As illustrated in FIGS. 18 and 19 as well, a joint portion 71 capable of being rotated in the up-down direction and the circumferential direction is formed by joining a bifurcated head-side yoke portion (head-side bearing portion) 72 as a handle support joint portion 22 arranged as projecting from the upper face 14*a* of the cleaning head 14 and a bifurcated handle-side yoke portion (handle-side bearing portion) 73 as a rotary joint portion 23 arranged at the lower end part of the handle 16 via a joint member 74 which includes a first rotational axial center portion 74*a* and a second rotational axial center portion 74*b* of which center axes X2, Y2 are orthogonal. Mutually-distant opposed surfaces 72*b* of a pair of yoke projection portions (bearing projection portions) 72*a* structuring the head-side yoke portion 72 respectively have a symmetrically mountain-shaped outer circumferential portion 75 which includes slope portions 75*b* at both sides of a crest portion 75*a* (both sides of long sides of the cleaning head 14 having a rectangular plane shape in the present embodiment). A pair of yoke pieces (bearing members) 73*a* structuring the handle-side yoke portion 73 has lateral width b which is approximately the same as space width s between the opposed surfaces 72*b* of the pair of yoke projection portions 72*a* (refer to FIG. 19). In a state that the handle 16 is arranged approximately in parallel to the cleaning head 14 (refer to FIG. 17), an edge portion 76 of either yoke piece 73*a* is capable of being abutted to the outer circumferential portion 75 of the opposed surface 72*b* of either yoke projection portion 72*a*. The edge portion 76 of either yoke piece 73*a* is slidingly moved as maintaining an abutting state along the slope portion 75 and the crest portion 75*a* of the outer circumferential portion 75 of the opposed surface 72*b* of either yoke projection portion 72*a* in accordance with rotation of the handle 16 in the circumferential direction R in a state that the handle 16 is arranged approximately in parallel to the cleaning head 14 (refer to FIGS. 21(*a*) to 21(*c*) and 22(*a*) to 22(*g*)).

Further, in the present embodiment, the slope portions 75*b* of the outer circumferential portion 75 of the opposed surfaces 72*b* of the yoke projection portions 72*a* are curved slope portions which are curved in a concaved manner. The first rotational axial center portion 74*a* and the second rotational axial center portion 74*b* of the joint member 74 are arranged so that the center axes X2, Y2 thereof are orthogonal in a grade separation manner (refer to FIGS. 18 and 19).

Further, in the present embodiment, the pair of yoke projection portions 72*a* of the head-side yoke portion 72 is arranged as swell portions 77 swelled from the upper face center section of the cleaning head 14 and the opposed surfaces 72*b* are sheer surfaces 77*a* being sheer along a face which is approximately perpendicular to a bottom face of the cleaning head.

In the present embodiment, the cleaning head 14 structuring the cleaning device 10 has a rectangular plane shape of which long side is on the order of 200 to 300 mm and of which short side is on the order of 50 to 150 mm, as described above. The cleaning device body 11 is structured by attaching the elastically deformable base body 15 as covering the lower face of the head body 14*b* being a plastic-made plane-shaped member, for example. The cleaning sheet 13 is attached as covering the cleaning surface 12 as the lower face of the elastically deformable base body 15 being the cleaning surface 12. Further, the publicly known sheet holding portion 24 or the later-mentioned cleaning sheet attachment 24 as the sheet holding portion 24 made of elastic material in which the engagement slits 24*a* are formed at four corners is arranged at the upper face 14*a* of the head body 14*b* of the cleaning head 14. As illustrated in FIG. 1, the cleaning sheet 13 can be easily attached to the cleaning head 14 (cleaning device body 11) to be replaceable in a detachably attachable manner by performing engagement as squeezing end parts of the cleaning sheet 13 into the engagement slits 24*a* of the sheet holding portion 24 at the upper face 14*a* of the cleaning head 14 after the cleaning sheet 13 is wound to the cleaning head 14 (cleaning device body 11) so as to cover the lower face (cleaning surface) 12 of the base body 15 which is integrally attached to the lower face side of the cleaning head 14.

As illustrated in FIGS. 17 to 19, the head-side yoke portion 72 including the pair of yoke projection portions 72*a* is integrally arranged at the upper face 14*a* of the head body 14*b* of the cleaning head 14 by swelling the center section thereof. Owing to the joint portion 71 including the head-side yoke portion 72, the handle 16 is joined to the cleaning head 14 as being rotatable in the circumferential direction R as well as the up-down direction V.

Here, in the present embodiment, a variety of publicly-known cleaning sheets such as olefinic ultrafine non-woven fabric, for example, can be used as the cleaning sheet 13 to which dust, dirt and the like are stuck as being attached to the cleaning head 14 as covering the cleaning surface 12, as described above.

Further, as described above, the handle 16 structuring the cleaning device 10 along with the cleaning head 14 includes the elongated rod-shaped handle body 28 and the holding portion 27 which is integrally joined and fixed to the upper part of the handle body 28.

The handle body 28 is assembled so that the handle portion 16 including the holding portion 27 has length on the order of 100 to 150 cm as a whole, for example, to be suitable for performing cleaning operation by joining the plurality of cylindrical pipes made of aluminum alloy or acrylonitrile butadiene styrene (ABS), for example, in the axial direction via the joint portion due to the abovementioned pipe joint structure 30. The handle-side yoke portion 73 having the pair of yoke pieces 73*a* is integrally arranged at the lower end part of the handle body 28 (handle 16).

In the present embodiment, the joint structure 70 of the cleaning head includes the bifurcated head-side yoke portion 72 which is arranged at the upper face 14*a* of the cleaning head 14, the bifurcated handle-side yoke portion 73 which is arranged at the lower end part of the handle 16, and the joint member 74 which is arranged as being interposed between the yoke portions 72 and 73.

In the present embodiment, as illustrated in FIGS. 17 to 19, the head-side yoke portion 72 has a shape of the oblong swell portion 77 having a spread skirt section arranged as being swelled like a baseball mound from the center section of the upper face 14*a* of the cleaning head 14 with a cutout of which width is on the order of 10 to 30 mm, for example, at the center section in the longitudinal direction of the swell portion 77. Thus, the head-side yoke portion 72 is provided with the pair of symmetrically-shaped yoke projection portions 72*a* arranged with the space width s corresponding to the cutout width having the sheer surfaces 77*a* approximately perpendicular to the cleaning surface 12 of the cleaning head 14 (cleaning device body 11) as the opposed surfaces 72*b*.

Owing to that the pair of symmetrically-shaped yoke projection portions 72*a* of the head-side yoke portion 72 is arranged as a part of the swell portion 77 having the spread skirt section, load during cleaning applied to the cleaning head 14 from the handle 16 via the joint portion 71 can be supported by the cleaning head 14 in a stable state.

Further, in the present embodiment, a first rotational pin member 78 is installed at a space section of the opposed surfaces 72*b* of the pair of yoke projection portions 72*a* arranged with the space width s and is arranged as having both end parts thereof joined integrally respectively with upper center sections of the opposed surfaces 72*b*. The first rotational axial center portion 74*a* of the joint member 74 is rotatably attached to and engaged with the first rotational pin member 78.

Further, in the present embodiment, the outer circumferential portions 75 of the opposed surfaces 72*b* of the pair of yoke projection portions 72*a* respectively have a symmetric mountain-shape of which skirt portions are smoothly merged to the upper face 14*a* of the cleaning head 14 from the crest portion 75*a* chamfered to be arc-shaped via the curved slope portions 75*b* at both sides curved as being gently concaved. As described later, when the handle 16 is rotated in the circumferential direction R in a state of being arranged approximately in parallel to the cleaning head 14, the edge portion 76 of the yoke piece 73*a* of the handle-side yoke portion 73 is capable of being moved while maintaining an abutting state with the outer circumferential portion 75 as running over or sliding down along the outer circumferential portion 75 of the yoke projection portion 72*a*.

With respect to the handle-side yoke portion 73 of the present embodiment, the bifurcated handle-side yoke portion 73 is formed by forming a penetration groove 79 having appropriate width at the lower end part of the handle 16 from the end surface side of the handle 16 in the axial direction. Then, the pair of zonal-plate-shaped yoke pieces 73*a* of which top edge part is chamfered to be arc-shaped and of which outer circumferential surface becomes to a gently-curved convex surface is arranged at both sides sandwiching the penetration groove 79.

A concave portion 79*a* having approximately the same shape as the external shape of the crest section of the yoke projection portion 72*a* is arranged at an upper part of the penetration groove 79. The crest section of the yoke projection portion 72*a* is fitted into the concave portion 79*a* when the handle 16 is laid to be approximately in parallel to the cleaning head 14, so that cleaning operation can be performed even at a low space.

Further, in the present embodiment, a second rotational pin member 80 is installed in the penetration groove 79 between the pair of yoke pieces 73*a* and is arranged as having both end parts thereof joined integrally respectively with the inner surfaces of the yoke pieces 73*a*. The second rotational axial center portion 74*b* of the joint member 74 is rotatably attached to and engaged with the second rotational pin member 80.

Further, in the present embodiment, the lateral width b of the pair of yoke pieces 73*a* is approximately the same as and slightly smaller than the space width s between the opposed surfaces 72*b* of the pair of yoke projection portions 72*a* (refer to FIG. 19). Accordingly, when the handle 16 is arranged approximately in parallel to the cleaning head 14, the edge portion 76 of the yoke piece 73*a* is arranged as being adjacent to the mountain-shaped outer circumferential portion 75 of the yoke projection portion 72*a*. When the handle 16 is rotated in the circumferential direction R relatively against the cleaning head 14 from the above state, the edge portion 76 of the yoke piece 73*c* is moved while maintaining the abutting state with the outer circumferential portion 75 as running over along the mountain-shaped outer circumferential portion 75 of the yoke projection portion 72*a*, for example (refer to FIGS. 21(*a*) to 21(*c*)).

Figure 20B:
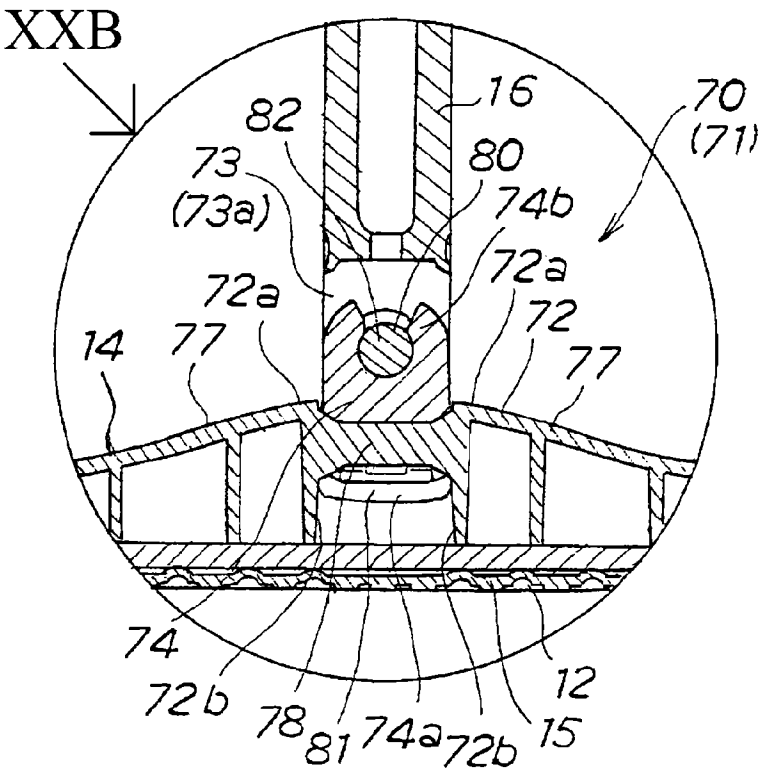
FIG. 20B is an enlarged sectional view of portion XXB of the main part illustrating the joint structure of the cleaning head illustrated in FIG. 20A.
Figure 20A:
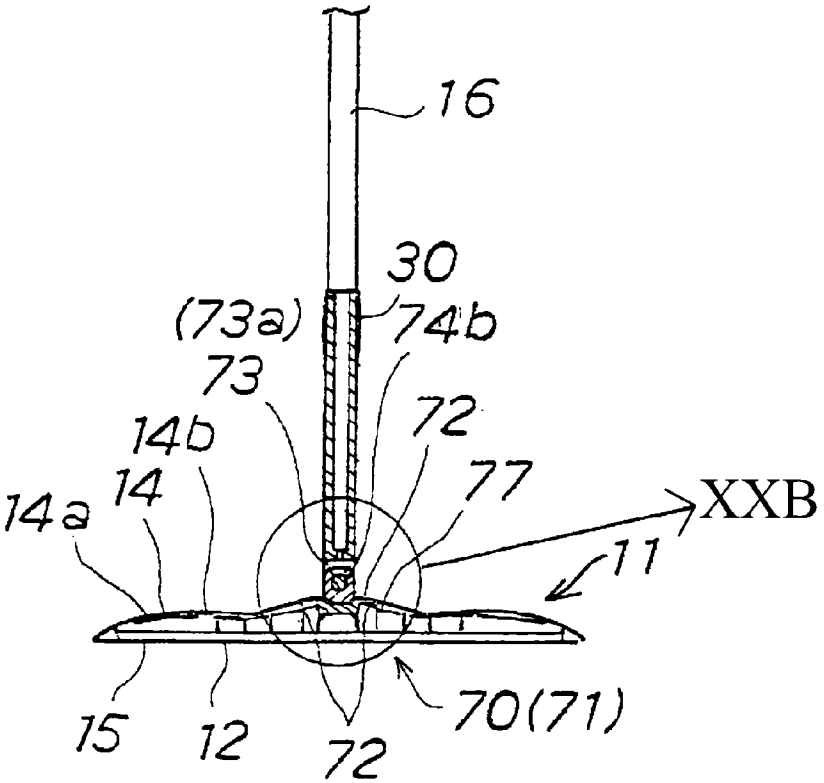
FIG. 20A is a fragmentary sectional view of a main part illustrating the joint structure of the cleaning head.

In the present embodiment, the joint member 74 which is arranged as being interposed between the head-side yoke portion 72 and the handle-side yoke portion 73 being a plastic-made molded component, for example, includes the first rotational axial center portion 74*a* and the second rotational axial center portion 74*b* of which center axes X2, Y2 are orthogonal in a grade separation manner, as illustrated in FIG. 18. As illustrated in FIGS. 19 and 20A-B as well, the first rotational axial center portion 74*a* has an approximately cylindrical shape in which a section opposite to a section to which the second rotational axial center portion 74*b* is joined as sandwiching the first rotational pin member 78 is zonally removed as an attaching opening 81. The center axis of the hollow inside of the approximately cylindrical shape is the center axis X2 of the first rotational axial center portion 74*a*.

The second rotational axial center portion 74*b* of the joint member 74 is a thick plate-shaped section which is arranged as outwardly projecting in the radial direction from the outer circumferential surface at the opposite side to the section where the attaching opening 81 of the first rotational axial center portion 74*a* is arranged. The second rotational axial center portion 74*b* includes an attaching concave portion 82 as removing a circumferential portion of a section at the opposite side to the joint portion with the first rotational axial portion 74*a*. The center axis of the attaching concave portion 82 is the center axis Y2 of the second rotational axial center portion 74*b*.

Here, it is preferable that clearance between the center axis X2 of the first rotational axis center portion 74*a* and the center axis Y2 of the second rotational axis center portion 74*b* of the joint member 74 is on the order of 7 to 15 mm at the crossing position of the center axis X2 and the center axis Y2 in a grade separation manner. Owing to that the clearance between the center axis X2 and the center axis Y2 at the position of grade separation is set to be on the order of 7 to 15 mm, it is possible to obtain the joint structure 70 of the cleaning head being compact with excellent operability in which the edge portion of the yoke piece 73*a* can be moved along the outer circumferential portion 75 of the opposed surface 72*b* of the yoke projection portion 72*a*.

In the present embodiment, the joint member 74 is attached to the lower end part of the handle 16 by rotatably attaching the second rotational axial center portion 74*b* to the second rotational pin member 80 while forcedly pushing the attaching concave portion 82 of the second rotational axial center portion 74*b* of the joint member 74 to the second rotational pin member 80 between the pair of yoke pieces 73*a* of the handle-side yoke portion 73, for example. Subsequently, the first rotational axis center portion 74*a* is rotatably attached to the first rotational pin member 78 while forcedly pushing the attaching opening 81 of the first rotational axial center portion 74*a* of the joint member 74 to the first rotational pin member 78 between the opposed surfaces 72*b* of the pair of yoke projection portions 72*a* of the head-side yoke portion 72. In this manner, the joint portion 71 (joint structure 70) is formed and the lower end part of the handle 16 is rotatably joined to the center section of the upper face 14*a* of the cleaning head 14.

With the above, cleaning of a floor surface and the like can be effectively performed while rotating the cleaning head 14 in the circumferential direction even in a state that the handle 16 is tilted against the cleaning head 14 over a remarkable angle range as well as a state that the handle 16 is vertically raised.

Further, according to the joint structure 70 of the cleaning head having the abovementioned structure, the handle 16 is smoothly rotatable in the circumferential direction about the joint portion 71 even in a state that the handle 16 is arranged approximately in parallel to the cleaning head 14. Accordingly, it is possible to effectively perform cleaning while rotating the cleaning head 14 in the circumferential direction with operation from the handle 16 even at a low or narrow space.

That is, according to the present embodiment, the opposed surfaces 72*b* of the pair of yoke projection portions 72*a* structuring the head-side yoke portion 72 respectively have the symmetrically mountain-shaped outer circumferential portion 75 which includes the slope portions 75*b* at both sides of the crest portion 75*a*. The pair of yoke pieces 73*a* structuring the handle-side yoke portion 73 has the lateral width b which is approximately the same as the space width s between the opposed surfaces 72*b* of the pair of yoke projection portions 72*a*. In a state that the handle 16 is arranged approximately in parallel to the cleaning head 14, the edge portion 76 of either yoke piece 73*a* is capable of being abutted to the outer circumferential portion 75 of the opposed surface 72*b* of either yoke projection portion 72*a*.

Figure 21A:
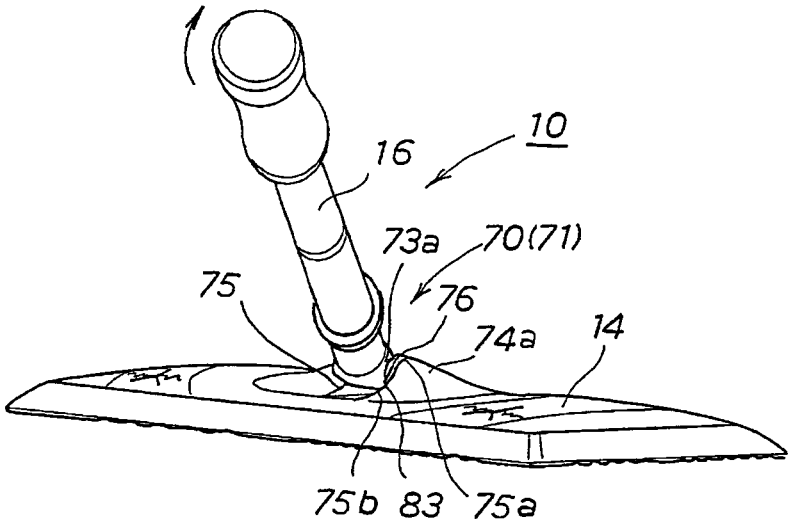
FIG. 21(*a*) is a perspective view illustrating a situation to rotate the handle in the circumferential direction against the cleaning head.
Figure 21B:
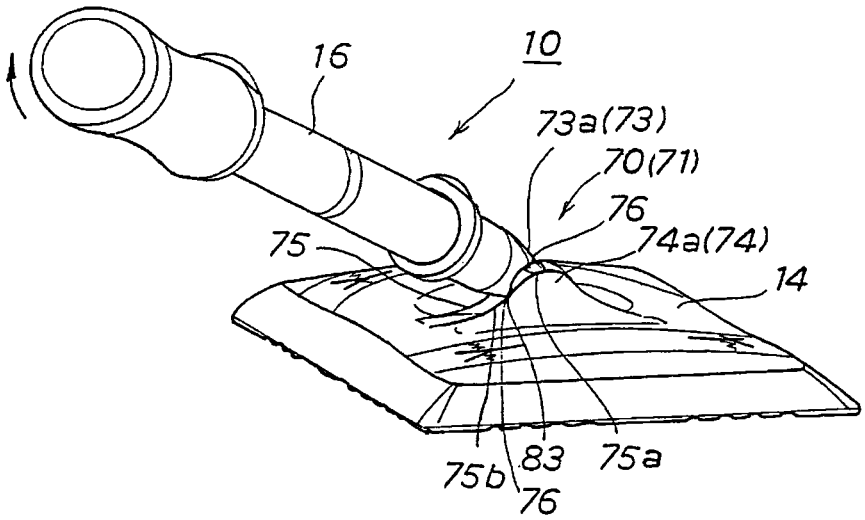
Figure 21C:
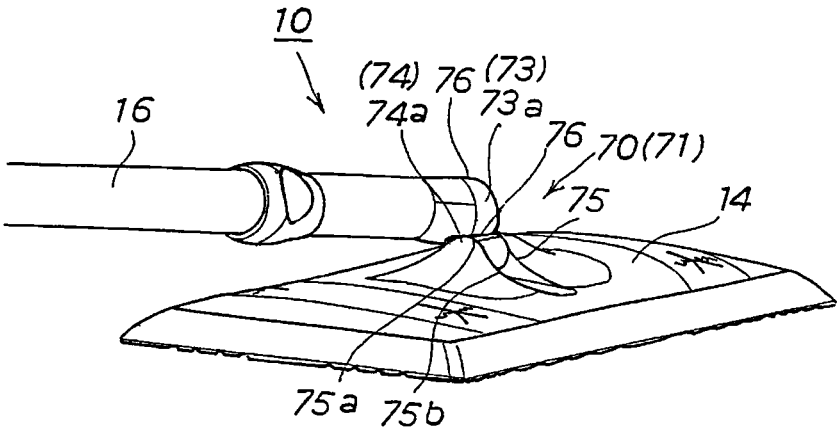
Figure 22A:
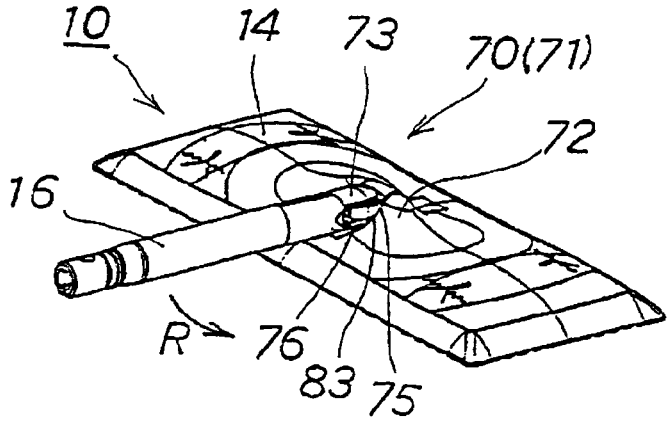
FIG. 22(*a*) is a perspective view illustrating a situation to rotate the handle in the circumferential direction against the cleaning head.
Figure 22B:
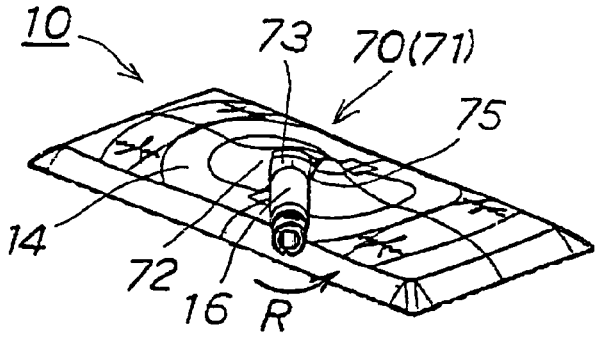
Figure 22C:
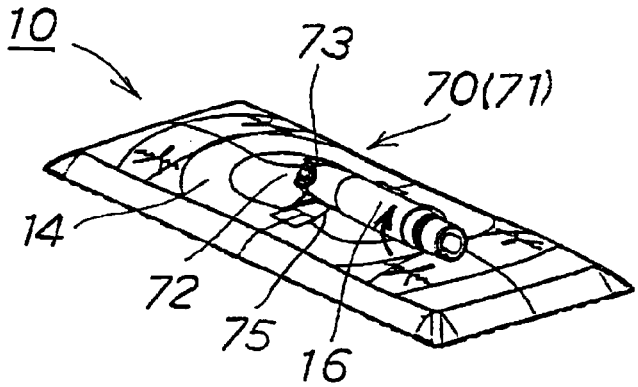
Figure 22D:
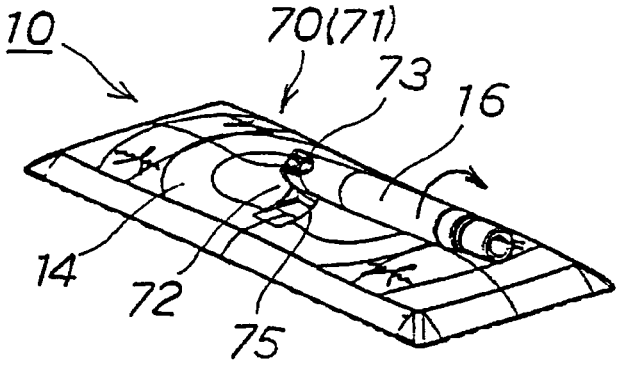
Figure 22E:
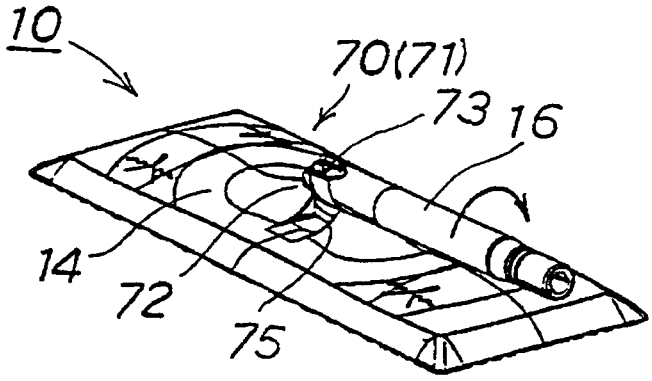
Figure 22F:
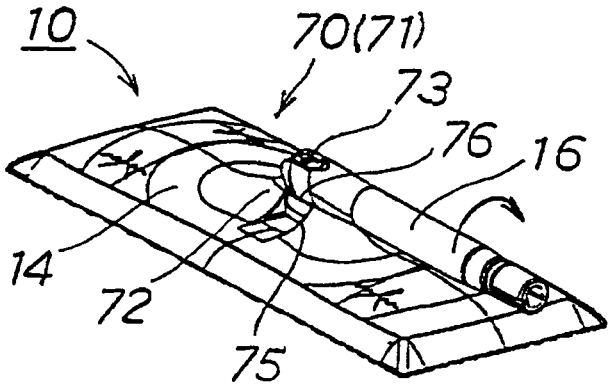
Figure 22G:
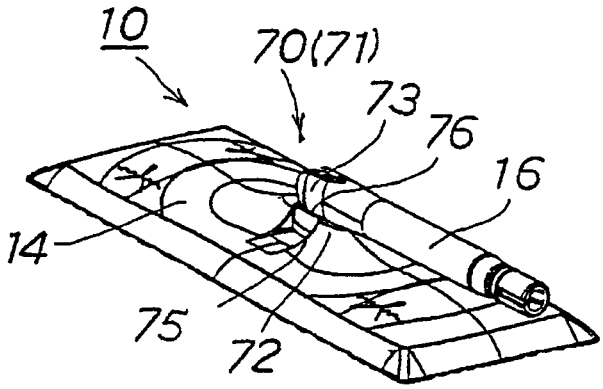

With the above, when the handle 16 is rotated in the circumferential direction R relatively against the cleaning head 14 from a state of being extended in a direction perpendicular to the long side of the cleaning head 14 while the handle 16 is arranged approximately in parallel to the cleaning surface 12 of the cleaning head 14 (cleaning device body 11) as illustrated in FIG. 17, for example, the edge portion 76 of one yoke piece 73*a* can be smoothly moved (refer to FIGS. 21(*a*) to 21(*c*)) in accordance with the above rotation as the handle 16 being rotated to be twisted while maintaining the abutting state at an abutting part 83 (refer to FIGS. 21(*a*) and 21(*b*)) with the outer circumferential portion 75 as running over toward the crest portion 75*a* along the curved slope portion 75*b* of the outer circumferential portion 75 after being abutted to a section close to the skirt portion at the mountain-shaped outer circumferential portion 75 of the opposed surface 72*b* of one yoke projection portion 72*a*, as illustrated in FIGS. 21(*a*) to 21(*c*) and 22(*a*) to 22(*g*).

When the handle-side yoke portion 73 reaches the crest portion 75*a* of the mountain-shaped outer circumferential portion 75 as the edge portion 76 of the yoke piece 73*a* running over along the outer circumferential portion 75 of the yoke projection portion 72*a*, the handle 16 becomes in a state of being extended in the direction parallel to the long side of the cleaning head 14 while being twisted by 90° as illustrated in FIG. 22(*g*) from a state of being extended in the direction perpendicular to the long side of the cleaning head 14 as illustrated in FIG. 17. When the handle 16 is further rotated in the circumferential direction R relatively against the cleaning head 14 with further twisting of the handle 16 from the above state, the edge portion 76 of the other yoke piece 73*a* of the handle-side yoke portion 73 can be smoothly moved while maintaining the abutting state at the abutting part 83 with the outer circumferential portion 75 as sliding down toward the skirt portion along the curved slope portion 75*b* of the outer circumferential portion 75 after being abutted to a section close to the crest portion 75*a* at the mountain-shaped outer circumferential portion 75 of the opposed surface of the one yoke projection portion 72*a*.

Here, for convenience, description is performed as the handle 16 is rotated in the circumferential direction R against the cleaning head 14. However, as described above, the rotation of the handle 16 is relative to the cleaning head 14. In actual cleaning operation, the cleaning head 14 is rotated in the circumferential direction R against the handle 16.

Thus, even in a state that the handle 16 is arranged approximately in parallel to the cleaning surface 12 of the cleaning head 14, the handle 16 can be easily rotated in the circumferential direction R by 180° relatively against the cleaning head 14, and further, the handle 16 can be easily rotated by 360° with reversed similar operation. Accordingly, even in a case that the cleaning head 14 (cleaning device body 11) is put into a low space such as a space below a bed, for example, cleaning of a floor surface and the like can be effectively performed with the cleaning device 10 as rotating the cleaning head 14 in the circumferential direction R with operation of the handle 16 including twisting action.

Here, the abovementioned joint structure 70 of the cleaning head 14 may be modified variously. For example, the slope portion of the outer circumferential portion of the opposed surface of the yoke projection portion is not necessarily required to be the curved slope portion curved in a concaved manner and the crest portion is not necessarily required to be chambered into an arc shape. The outer circumferential portion of the opposed surface of the yoke projection portion is only required to have a shape to make the edge portion of the yoke piece be abutted thereto and be moved smoothly. The slope portion may be a linear slope portion or the like. Further, not being necessarily required to be arranged as the swell portion, the pair of yoke projection portions of the head-side yoke portion may be arranged like projection ribs.

Figure 23:
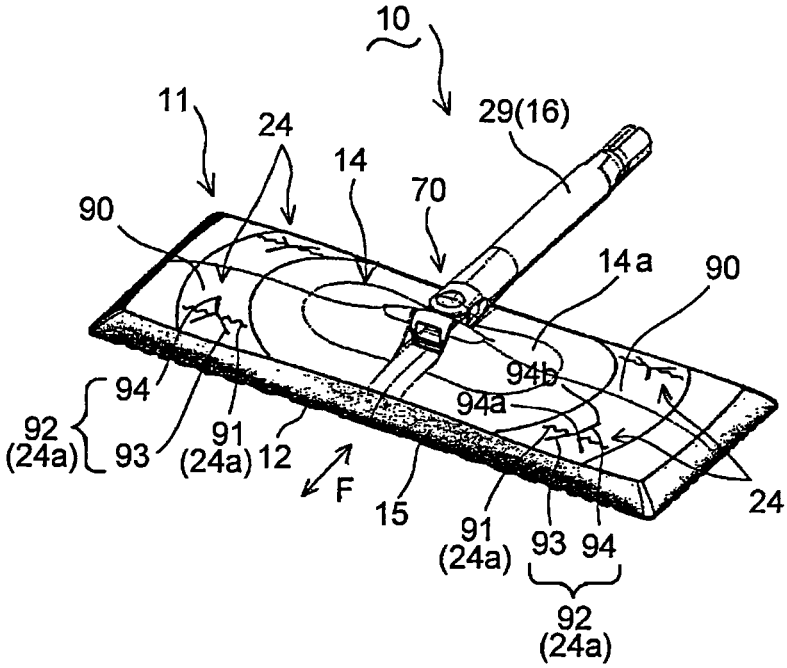
FIG. 23 is a perspective view of the cleaning head in a state before a cleaning sheet is attached.
Figure 24:
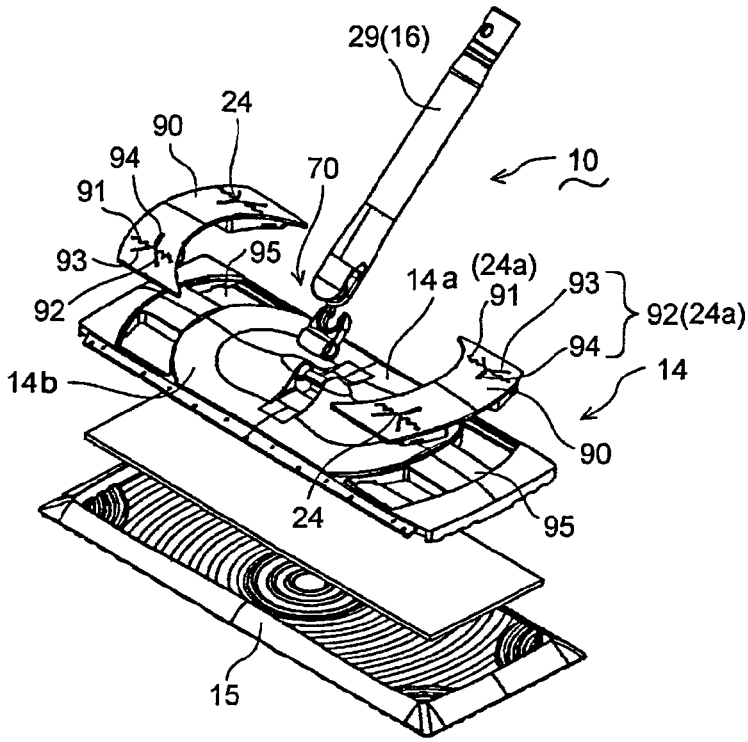
FIG. 24 is an exploded perspective view of the cleaning head.
Figure 25:
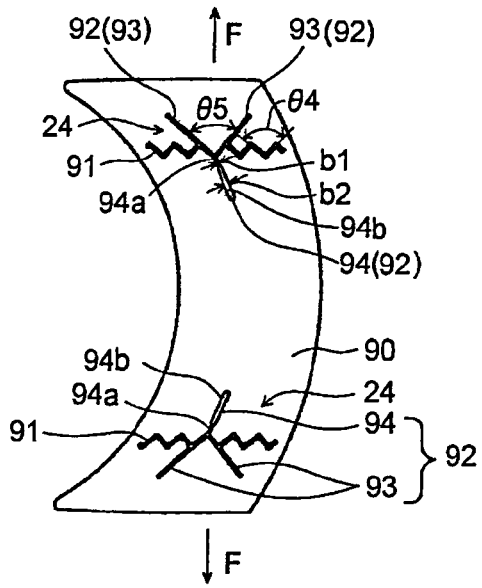
FIG. 25 is a plane view of an attaching member in which cleaning sheet attachments are formed.

In the cleaning device 10 of the present embodiment, the cleaning sheet attachment 24 which attaches the cleaning sheet 13 to be replaceable in a detachably attachable manner is arranged at the upper face portion 14*a* of the cleaning head 14 as the sheet holding portion. The end parts of the cleaning sheet 13 which is wound as covering the bottom surface portion (cleaning surface) 12 of the cleaning head 14 (cleaning device body 11) is attached to the cleaning sheet attachment 24 so as to maintain the state that the cleaning sheet 13 is attached to the cleaning head 14. In the present embodiment, as illustrated in FIGS. 23 to 25, the cleaning sheet attachment 24 as the sheet holding portion 24 is structured by forming a holding slit 91 and an opening slit 92 as attaching slits 24*a* at an attaching member 90 which is formed of soft elastic material. The holding slit 91 is formed into a saw-tooth shape as being extended in a direction at a right angle or approximately at a right angle against a direction F of tension force acting on the cleaning sheet 13 (a direction in parallel to or approximately in parallel to the short side direction of the cleaning head 14 having a rectangular plane shape in the present embodiment). The opening slit 92 includes a two-line slit 93 having two lines extended at one side as being continued to the holding slit 91 at a center section of the holding slit 91 and an oblique slit 94 extended at the other side obliquely against the extending direction of the holding slit 91 (in a range between 45° and 75° in the present embodiment) as sandwiching the holding slit 91. The oblique slit 94 includes a base end portion 94*a* (with slit width b1) being adjacent to the holding slit 91 and a widened portion 94*b* (with slit width b2) at the top end side from the base end portion 94*a* having slit width which is wider than that of the base end portion 94*a* (refer to FIG. 25). In the present embodiment, the widened portion 94*b* is arranged in a range from the top end of the oblique slit 94 at least to the center in the extending direction of the oblique slit 94.

Further, in the present embodiment, the two-line slit 93 of the opening slit 92 is arranged at the edge part side of the cleaning head 14 and the oblique slit 94 is arranged at the center side of the cleaning head 14 to sandwich the holding slit 91.

Further, in the present embodiment, the attaching member 90 at which the holding slit 91 and the opening slit 92 are formed is arc-shaped and zonal-plate-shaped. A pair of the attaching members 90 is attached integrally with the upper face portion 14*a* of the cleaning head 14 respectively in the short side direction across the cleaning head 14 having a rectangular plane shape between both sides in the long side direction. Since two of the cleaning sheet attachments 24 are arranged at both end sections of the respective attaching members 90 which are arc-shaped and zonal-plate-shaped, the cleaning sheet attachments 24 are arranged at four positions in total as being adjacent to corner sections of the upper face portion 14*a* of the cleaning head 14. Then, the oblique slits 94 of the opening slits 92 are extended respectively in parallel or approximately in parallel to a tangential direction of the arc-shape of the attaching member 90.

In the present embodiment, at both side sections of the upper face portion 14*a* of the cleaning head 14 in the long side direction, a pair of fitting openings 95 for fitting of the attaching members 90 is arranged respectively as being a cutout which is arc-shaped and zonal-plate-shaped corresponding to the plane shape of the attaching members 90 at symmetric positions while concaved part sides of the arc shapes are mutually faced (refer to FIG. 24). When the attaching members 90 are fitted respectively to the fitting openings 95, the pair of attaching members 90 having the cleaning sheet attachments 24 arranged at the both end parts thereof are respectively fitted and fixed integrally to the upper face portion 14*a* of the cleaning head 14 (refer to FIG. 23).

As described above, the cleaning sheet attachments 24 arranged at both end parts of the attaching member 90 are structured by forming the holding slit 91 and the opening slit 92 at each attaching member 90. In the present embodiment, as illustrated in FIG. 25, the holding slit 91 is formed into the saw-tooth shape of which aperture angle θ4 is on the order of 60° to 120° (90° in the present embodiment) and is arranged as being extended so that the continuing direction of the saw teeth is at a right angle or approximately at a right angle against the direction in parallel or approximately in parallel to the short side direction of the cleaning head 14 being the direction F of main tension force acting on the cleaning sheet 13. When the aperture angle θ4 is on the order of 60° to 120°, the cleaning sheet 13 is easily attached and the cleaning sheet 13 is more unlikely to accidentally come out from the holding slit against the tension force acting on the cleaning sheet 13. The holding slit 91 preferably has slit width on the order of 0.3 to 0.7 mm and is preferably formed as the slit width being gradually increased from the upper face side toward the back face side of the attaching member 90. In the present embodiment, the opening slit 92 is formed as being continued from the center section of the holding slit 91.

In the present embodiment, the opening slit 92 includes the two-line slit 93 which is arranged at the edge part side along the long side section of the cleaning head 14 to sandwich the holding slit 91 and the oblique slit 94 which is arranged at the center side of the cleaning head 14 at the opposite side to the edge part along the long side section of the cleaning head 14 to sandwich the holding slit 91. The two-line slit 93 is arranged as a V-shaped slit having a V-shape as extending distance between slits thereof toward the edge part side along the long side section at an aperture angle θ5 on the order of 60° to 120° similarly to the aperture angle θ4 of the holding slit 91 as being continued to the saw-tooth slit at the center of the holding slit 91. The two-line slit 93 preferably has slit width on the order of 0.3 to 0.7 mm and is preferably formed so that the slit width is gradually increased from the upper face side toward the back face side of the attaching member 90.

In the present embodiment, the oblique slit 94 is arranged continuously from a crest portion of a saw tooth at the center part of the holding slit 91 to which the two-line slit 93 is continued at the opposite side to the two-line slit 93 to sandwich the holding slit 91. Further, the oblique slit 94 is arranged as being extended in the direction in parallel or approximately in parallel to the tangential line of the arc shape of the attaching member 90 as the oblique direction against the direction F of the tension force acting on the cleaning sheet 13 (the direction in parallel or approximately in parallel to the short side direction of the cleaning head 14 having the rectangular plane shape in the present embodiment). Further, with respect to the oblique slit 94, the slit width b1 of the base end portion 94*a* being adjacent to the holding slit 91 is on the order of 0.3 to 0.7 mm and the slit width b2 of the widened portion 94*b* at the top end side from the base end portion 94*a* is on the order of 0.7 to 1.3 mm. Thus, the slit width b2 of the widened portion 94*b* is larger than the slit width b1 of the base end portion 94*a*. The oblique slit 94 is preferably formed as the slit width being gradually increased from the upper face side toward the back face side of the attaching member 90.

Figure 26A:
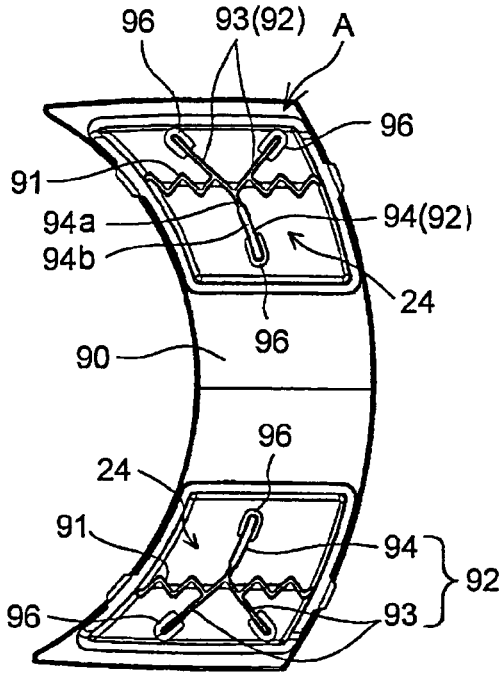
FIG. 26(*a*) is a back view of the attaching member in which the cleaning sheet attachments are formed.
Figure 26B:
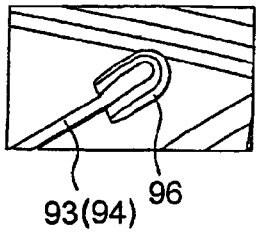
Figure 27A:
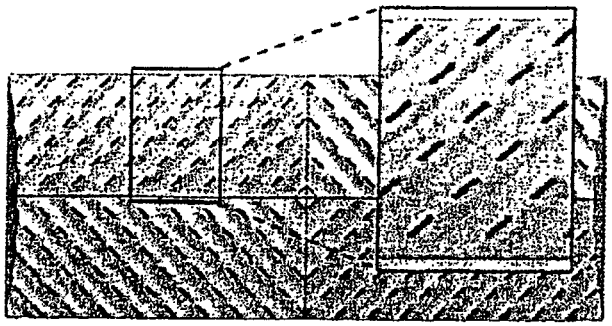
FIG. 27(*a*) is a bottom view of a cleaning device body exemplifying another embodiment of a wave-like corrugated surface portion.
Figure 27B:
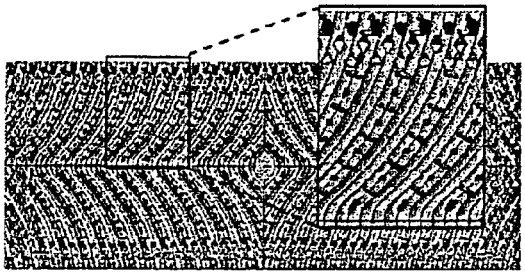
Figure 27C:
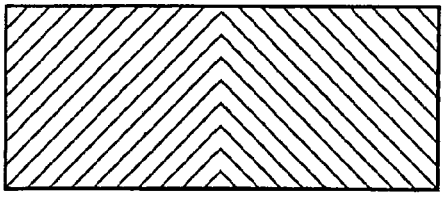
Figure 27D:
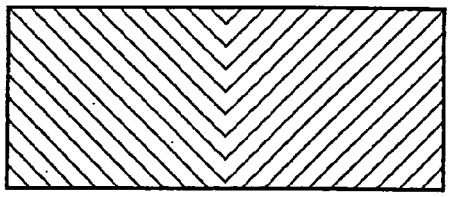
Figure 27E:
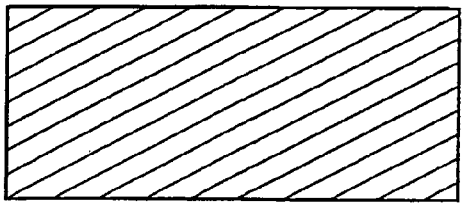
Figure 27F:
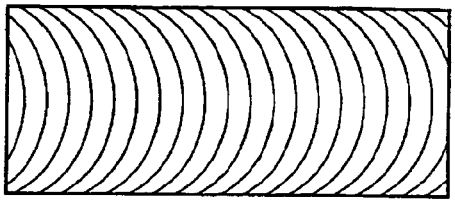

Further, in the present embodiment, as illustrated in FIGS. 26(*a*) and 26(*b*), top ends of the two-line slit 93 and the oblique slit 94 of the opening slit 92 are formed as being arc-shaped. Further, reinforcement ribs 96 are arranged as projecting to the back face side of the attaching member 90 at least along opening edge parts at the top end sections of the slits 93, 94. Since the reinforcement ribs 96 are arranged at the opening edge parts of the top end sections of the two-line slit 93 and the oblique slit 94, it is possible to effectively avoid breakage with tearing at the top ends of the two-line slit 93 and the oblique slit 94 even when attaching and detaching operation of the cleaning sheet 13 to the cleaning sheet attachments 24 is repeatedly performed.

Here, the attaching member 90 is formed of soft elastic material. It is possible to use polyolefin such as low-density polyethylene (LDPE) and linear low-density polyethylene (LLDPE), various types of elastomer resin, or the like as the material.

In the cleaning device 10 of the present embodiment having the abovementioned structure, for attaching the cleaning sheet 13 to the cleaning head 14, the cleaning sheet 13 is wound to the bottom surface portion 12 to be the cleaning surface of the cleaning head 14 (cleaning device body 11) and both edge parts of the cleaning sheet 13 are placed on the upper face portion 14*a*. Subsequently, the edge part of the cleaning sheet 13 is pushed in with a finger toward the cleaning sheet attachment 24, so that the cleaning sheet attachment 24 is deformed. When the finger is released in the above state, the cleaning sheet attachment 24 returns to the original shape and the edge part of the cleaning sheet 13 is engaged and held by being bitten by the holding slit 91 of the cleaning sheet attachment 24. In this manner, the cleaning sheet 13 is attached to the cleaning head 14 (cleaning device body 11) (refer to FIG. 1).

According to the cleaning device 10 of the present embodiment, the cleaning sheet 13 attached to the cleaning head 14 can be more unlikely to come out and operability to attach the cleaning sheet 13 can be further improved.

That is, according to the present embodiment, since the holding slit 91 of the cleaning sheet attachment 24 is formed into a saw-tooth shape as being extended in the direction at a right angle or approximately at a right angle against the direction F of the tension force action on the cleaning sheet 13, the cleaning sheet 13 can be more unlikely to be come out during cleaning while the edge parts of the cleaning sheet 13 pushed into the cleaning sheet attachments 24 are strongly engaged. Further, since the two-line slit 93 of the opening slit 92 continued to the center section of the holding slit 91 is arranged as extending the distance between the slits thereof toward the edge part side along the long side section of the cleaning head 14 at a constant angle of the aperture angle θ5, the cleaning sheet 13 can be engaged more strongly against the tension force action on the cleaning sheet 13.

Further, the oblique slit 94 of the opening slit 92 is arranged obliquely at a constant angle against the extending direction of the holding slit 91 (being extended in the direction in parallel or approximately in parallel to the tangential direction of the arc-shaped and zonal-plate-shaped attaching member 90 in the present embodiment) and the slit width b2 of the widened portion 94*b* at the top end side from the base end portion 94*a* is larger than the slit width of the base end portion 94*a* being adjacent to the holding slit 91. Accordingly, the cleaning sheet 13 is easily attached owing to that the edge part of the cleaning sheet 13 is easily pushed in when being pushed in toward the cleaning sheet attachment 24 with a finger, so that operability to attach the cleaning sheet 13 can be further improved.

Here, the attaching member 90 can be variously modified. For example, the attaching member is not necessarily required to be arc-shaped and zonal-plate-shaped and the oblique slit is not necessarily required to be arranged as being extended in parallel or approximately in parallel to the tangential direction of the arc shaped of the attaching member. Further, the reinforcement ribs are not necessarily required to be arranged at the opening edge parts of the two-line slit and the oblique slit.

Further, it is also possible that the holding slit adopts a waveform shape other than a saw-tooth shape.

The cleaning device of the present invention can be variously modified without being limited to the abovementioned embodiments. For example, the wave-like corrugated surface portion at the lower face of the base body is not necessarily required to be arranged as a part of a corrugated surface extended in a circular watering manner and may be arranged as a part of a corrugated surface extended in a rhomboid watering manner as illustrated in FIGS. 27(*a*) and 27(*b*). Further, other than the corrugated surface extended in a watering manner having the center section of the base body as the center thereof, the corrugated surface extended in a watering manner may be a corrugated surface extended in a watering manner having a position deviated from the center section as the center thereof. Further, a plurality of the center sections may exist. Furthermore, as illustrated in FIGS. 27(*c*) to 27(*f*), the wave-shaped corrugated surface portion may have other shapes other than watering shapes. Here, FIGS. 27(*c*) to 27(*f*) are views schematically illustrating valley portions.

Further, the projection ribs are not necessarily required to be linear rib pieces arranged in the width direction of the ridge portions and may be projection ribs which are dot-shaped. The cleaning device body may have various plane shapes such as ellipse shapes, oval shapes, and other shapes other than rectangular plane shapes. Further, the auxiliary wave-like corrugated surface portion and the center wave-like corrugated surface portion are not necessarily required to be arranged. The oblique guide portion (oblique valley portion) may be extended linearly and obliquely (refer to FIGS. 27(*c*) to 27(*f*)).

Further, bottom portions of the valley portions and crest portions of the ridge portions may be flat surfaces or curved surfaces. The number of the cushion members to be interposed between the lower face of the cleaning head and the base body may be one piece or three pieces or more.

Here, the base body can be manufactured with a general method of manufacturing such as cast molding and injection molding.

EXAMPLES

Figure 28:
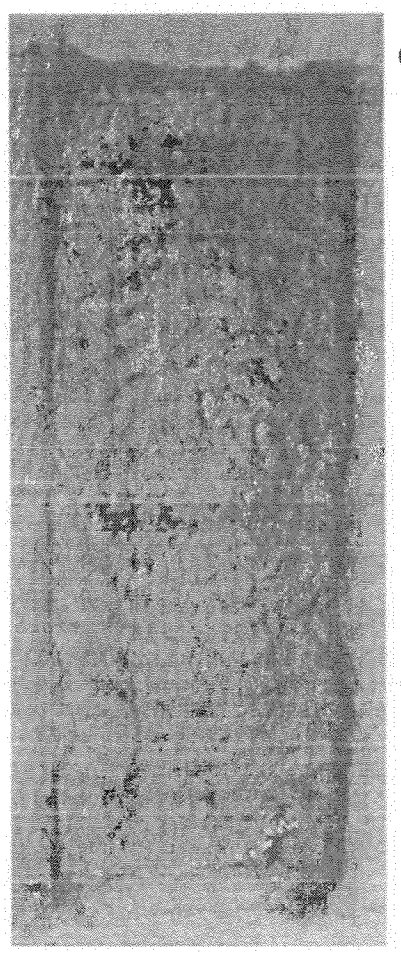
FIG. 28 illustrates a cleaning sheet to which objects to be stuck is stuck illustrating a stick situation of objects to be stuck such as dust after cleaning operation is performed using the cleaning device according to the preferable embodiment of the present invention.

Cleaning operation of a surface to be cleaned was performed with the following cleaning method using a cleaning device having the similar structure to the cleaning device of the abovementioned embodiment (refer to FIGS. 2-3) and a stuck state of solid matters such as dust, hair and dirt to the cleaning sheet 13 attached as covering the cleaning surface 12 of the cleaning device body 11 was observed. FIG. 28 indicates the test result.

[Cleaning Method]

Cleaning location: Standard home (family of four; a husband, a wife, and two children (an elementary school child and a junior high school child) with an indoor dog Cleaning area: Wooden floor (about 25-tatami room size), a hall way and a stairway Cleaning sheet (Product name): Quickie-wiper dry sheet (manufactured by Kao Corporation)

Base Body:

Material: urethane resin

Dimensions: 255 mm×100 mm

Manufacturing method: cast molding

Height of projection rib: 0.5 mm

Length of projection rib: 3 mm

Width of projection rib: 0.5 mm

Depth of valley portion: 1 mm

Interval of crest portions of ridge portions of wave-like corrugated surface portion: 10 mm Cushion member: urethane foam sponge Upper sponge member (dimensions): 245 mm×90 mm×3 mm Lower sponge member (dimensions): 210 mm×65 mm×3 mm.

Cleaning was performed on the abovementioned area using the cleaning device of the present application on the next day with normal living after normal cleaning was performed.

The test result indicated in FIG. 28 proved that cleaning of the surface to be cleaned was effectively performed by using the cleaning device of the present invention while solid matters such as dust, hair and dirt were stuck to a wide range of area of the cleaning sheet attached as covering the cleaning surface of the cleaning device body.

INDUSTRIAL APPLICABILITY

According to the cleaning device of the present invention, even when dust and the like are spread unevenly on a surface to be cleaned, dust and the like can be distributed to the entire cleaning sheet while having solid matters such as dust, hair and dirt stuck to a wide range of area of the cleaning sheet which is attached as covering the cleaning surface of the cleaning device body. Accordingly, cleaning of the surface to be cleaned can be effectively performed.

When the abovementioned pipe joint structure is provided, each pair of the cylindrical pipes structuring the handle can be joined more smoothly, the engaging projection can be prevented from being easily detached from the male-side projection insertion hole during usage, or cracking and breakage of the engaging projection and the like of the sleeve-like member can be effectively avoided when the cylindrical pipe is dropped to the floor.

With the abovementioned end cap arranged at the handle, stability when the handle of the cleaning device is propped to a wall surface or the like can be effectively improved and operability of the cleaning device can be improved.

When the abovementioned joint structure of the cleaning head is provided, the handle is smoothly rotatable in the circumferential direction about the joint portion even in a state that the handle is arranged approximately in parallel to the cleaning head. Accordingly, it is possible to effectively perform cleaning while rotating the cleaning head in the circumferential direction with operation from the handle even at a low or narrow space.

When the abovementioned cleaning sheet attachment is provided, the cleaning sheet attached to the cleaning head can be prevented from being easily detached and operability to attach the cleaning sheet can be further improved.

The invention claimed is:

1. A cleaning device to wipe a surface to be cleaned with a cleaning sheet which is attached as covering a cleaning surface being a lower face of a base body, comprising:

a cleaning device body which comprises a cleaning head and a base body attached as covering a lower face of the cleaning head; and a handle portion which is attached to a face at the opposite side to the lower face of the cleaning head, wherein the lower face of the base body comprises a wave-like corrugated surface portion of which cross-section in a direction perpendicular to a predetermined direction along which cleaning is performed with the cleaning device body in a planar view is wave-shaped as having a ridge portion and a valley portion arranged alternately and continuously;

the valley portion of the wave-like corrugated surface portion comprises an oblique valley portion of which an end part is opened to a side portion of the base body facing to the predetermined direction as being extended obliquely against the predetermined direction;

the wave-like corrugated surface portion is arranged as a part of a corrugated surface extended in a watering manner over an entire surface of the base body; and the corrugated surface extended in a watering manner is a corrugated surface extended over the entire surface of the base body as being circle-shaped or rhomboid-shaped.

2. The cleaning device according to claim 1, wherein the ridge portion of the wave-like corrugated surface portion comprises a plurality of projection ribs projecting from a crest portion of the ridge portion at intervals in an extending direction of the crest portion at least at a section along the oblique valley portion of the valley portion.

3. The cleaning device according to claim 2, wherein the projection ribs are line-shaped rib pieces arranged in a width direction of the ridge portion.

4. The cleaning device according to claim 3, wherein the line-shaped rib pieces are arranged obliquely against the predetermined direction.

5. The cleaning device according to claim 1, wherein the cleaning device body has a rectangular plane shape and the side portion of the base body facing to the predetermined direction is a long side portion of the rectangular plane shape.

6. The cleaning device according to claim 5, wherein the lower face of the base body comprises an auxiliary wave-like corrugated surface portion of which cross-section in the predetermined direction is wave-shaped as having a ridge portion and a valley portion arranged alternately and continuously; and the valley portion of the auxiliary wave-like corrugated surface portion comprises an auxiliary oblique valley portion of which an end part is opened to a short side portion of the rectangular plane shape of the base body as being extended obliquely against the short side portion.

7. The cleaning device according to claim 6, wherein the ridge portion of the auxiliary wave-like corrugated surface portion comprises a plurality of projection ribs projecting from a crest portion of the ridge portion at intervals in an extending direction of the crest portion at least at a section along the auxiliary oblique valley portion of the valley portion.

8. The cleaning device according to claim 1, wherein a cushion member is attached over approximately entire area of the lower face of the cleaning head as being interposed between the lower face of the cleaning head and the base body; and the lower face of the base body covered with the cleaning sheet is to be a flat surface while the cushion member is crushed with pressing force to the cleaning device body due to the handle portion from a state that the lower face of the base body projects to be a curved shape as pushing out the base body with the cushion member.

9. The cleaning device according to claim 1, wherein the handle portion is a handle;

the handle is formed by joining a plurality of cylindrical pipes with a pipe joint structure for integrally joining a pair of the cylindrical pipes in an axial direction;

the pipe joint structure is structured as a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion from the outside between the male-side end portion and the female-side end portion;

the female-side end portion comprises a positioning guide rib which inwardly projects from an inner circumferential surface of the female-side end portion at a section being apart from the female-side projection insertion hole in a circumferential direction;

the male-side end portion comprises a guide groove extended from a top edge part of the male-side end portion in an axial direction at a section being apart from the male-side projection insertion hole in the circumferential direction as corresponding to the positioning guide rib; and the male-side end portion is inserted to the female-side end portion until the male-side projection insertion hole is matched to the female-side projection insertion hole while the positioning guide rib of the female-side end portion is guided as being engaged with the guide groove of the male-side end portion.

10. The cleaning device according to claim 1, wherein the handle portion is a handle;

the handle is formed by joining a plurality of cylindrical pipes with a pipe joint structure for integrally joining a pair of the cylindrical pipes in an axial direction;

the pipe joint structure is structured as a male-side end portion of one cylindrical pipe is inserted to a female-side end portion of the other cylindrical pipe, an engaging projection is engaged from the outside after a male-side projection insertion hole and a female-side projection insertion hole are matched, and a sleeve-like member is attached as covering a joint line portion between the male-side end portion and the female-side end portion;

an abutment rib which abuts to an end surface of the female-side end portion from a back side is arranged at the sleeve-like member continuously or discontinuously in a circumferential direction as inwardly projecting from an inner circumferential surface of a section covering the joint line portion;

an insertion guide slope portion extended as being sloped outwardly in the circumferential direction toward a top end side of the sleeve-like member is arranged at the abutment rib continuously or discontinuously in the circumferential direction; and the male-side end portion of the one cylindrical pipe is inserted to the female-side end portion as being guided by the insertion guide slope portion in a state that the sleeve-like member is attached to the female-side end portion of the other cylindrical pipe while the end surface is abutted to an abutment surface of the abutment rib.

11. The cleaning device according to claim 1, wherein the handle portion is a handle;

an end cap is attached to an upper end part of the handle;

the end cap attached to the upper end part of the handle through an attachment hole is made of elastic material and a cover end surface of the end cap arranged to cover an end surface portion of the handle is formed as an oblique surface against a perpendicular surface to a center axis direction of the handle, so that a taper-shaped top edge section of the end cap forms a cushion portion capable of being elastically deformed inwardly and outwardly in a radial direction as having the center axis direction of the handle as the center.

12. The cleaning device according to claim 1, wherein the handle portion is a handle;

a joint structure of a cleaning head is provided to enable the handle to perform a 360-degree rotation in a circumferential direction about a joint portion in a state that the handle is arranged approximately in parallel to the cleaning head;

the joint structure of the cleaning head forms the joint portion capable of being rotated in an up-down direction and the circumferential direction by joining a bifurcated head-side yoke portion arranged as projecting from an upper face of the cleaning head and a bifurcated handle-side yoke portion arranged at a lower end part of the handle via a joint member which comprises a first rotational axial center portion and a second rotational axial center portion of which center axes are orthogonal;

mutually-distant opposed surfaces of a pair of yoke projection portions structuring the head-side yoke portion respectively have a symmetrically mountain-shaped outer circumferential portion which comprises slope portions at both sides of a crest portion;

a pair of yoke pieces structuring the handle-side yoke portion has lateral width being approximately the same as space width between the opposed surfaces of the pair of yoke projection portions;

an edge portion of either yoke piece is capable of being abutted to an outer circumferential portion of the opposed surface of either yoke projection portion in a state that the handle is arranged approximately in parallel to the cleaning head; and the edge portion of either yoke piece is arranged to be movable as running over or sliding down along the outer circumferential portion of the opposed surface of either yoke projection portion in accordance with rotation of the handle in the circumferential direction in a state of being arranged approximately in parallel to the cleaning head.

13. The cleaning device according to claim 1, wherein a cleaning sheet attachment which attaches a cleaning sheet to be replaceable in a detachably attachable manner is arranged at an upper face portion of the cleaning head and edge parts of the cleaning sheet which is wound as covering a bottom surface portion of the cleaning head are attached to the cleaning sheet attachment so as to maintain a state that the cleaning sheet is attached to the cleaning head;

the cleaning sheet attachment is structured by forming a holding slit and an opening slit at an attaching member;

the holding slit is formed into a saw-tooth shape or a waveform shape as being extended in a direction at a right angle or approximately at a right angle against a direction of tension force acting on the cleaning sheet;

the opening slit comprises a two-line slit having two lines extended at one side as being continued to the holding slit at a center section of the holding slit and an oblique slit extended at the other side obliquely against an extending direction of the holding slit as sandwiching the holding slit; and the oblique slit comprises a base end portion being adjacent to the holding slit and a widening portion at a top end side from the base end portion having slit width which is wider than that of the base end portion.

* * * * *